US007186501B2

(12) United States Patent
Yamamoto

(10) Patent No.: US 7,186,501 B2
(45) Date of Patent: Mar. 6, 2007

(54) PHOTOTHERMOGRAPHIC MATERIAL CONTAINING PARTICULAR HYDROPHILIC POLYMER

(75) Inventor: Seiichi Yamamoto, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/228,191

(22) Filed: Sep. 19, 2005

(65) Prior Publication Data

US 2006/0068342 A1 Mar. 30, 2006

(30) Foreign Application Priority Data

Sep. 24, 2004 (JP) ..... 2004-277856

(51) Int. Cl.
*G03C 1/00* (2006.01)
*G03C 1/005* (2006.01)
*G03C 1/494* (2006.01)

(52) U.S. Cl. ..... 430/617; 430/618; 430/619; 430/620; 430/531; 430/536; 430/627; 430/630

(58) Field of Classification Search ..... 430/617–620, 430/531, 536, 627, 630
See application file for complete search history.

(56) References Cited

U.S. PATENT DOCUMENTS 6,451,516 B1 * 9/2002 Irving et al. ..... 430/350
6,492,076 B1 * 12/2002 Goswami et al. ..... 430/502
6,730,462 B1 * 5/2004 Goswami et al. ..... 430/350
6,746,807 B1 * 6/2004 Goswami et al. ..... 430/350

* cited by examiner

*Primary Examiner*—Geraldina Visconti
(74) *Attorney, Agent, or Firm*—Margaret A. Burke; Sheldon J. Moss

(57) ABSTRACT

The present invention provides a photothermographic material, having a support and an image-forming layer containing a photosensitive silver halide, a non-photosensitive organic silver salt, and a reducer for the organic silver salt on at least one surface of the support, wherein the image-forming layer contains a hydrophilic polymer which has a vinyl monomer unit containing a quaternary nitrogen atom-containing group or a nitrogen-containing heterocyclic group.

19 Claims, No Drawings

PHOTOTHERMOGRAPHIC MATERIAL CONTAINING PARTICULAR HYDROPHILIC POLYMER

CROSS-REFERENCE TO RELATED APPLICATION

This application claims priority under 35 U.S.C. 119 from Japanese Patent Application No. 2004-277856, the disclosure of which is incorporated by reference herein.

BACKGROUND OF THE INVENTION

1. Field of the Invention

The present invention relates to a photothermographic material, and in particular to a photothermographic material that gives a high-quality image with reduced development irregularity and is improved in image storability.

2. Description of the Related Art

Recently, there has been a strong demand for a reduction in the amount of waste liquid in the field of medical imaging from the viewpoints of environmental conservation and space saving. For this reason, there is a need for technology regarding photothermographic materials serving as films for medical diagnosis and for photographic applications which photothermographic materials can be efficiently exposed to light with a laser image setter or a laser imager and which can form a clear black image with high resolution and high sharpness. Such photothermographic materials do not require use of liquid processing chemicals and can provide users with a thermal development system which is simpler and which does not contaminate the environment.

While similar requirements also exist in the field of general image forming materials, images for medical imaging is required to have particularly high image quality excellent in sharpness and granularity. This is because those for medical imaging are required to be finely represented. Moreover, those for medical imaging are characterized in that images of blue-black tones are preferred from the viewpoint of easy diagnosis. At present, various kinds of hard copy systems utilizing dyes or pigments such as ink jet printers and electrophotographic systems have been marketed as general image forming systems, but they are not satisfactory as output systems for medical images.

Meanwhile, photothermographic systems utilizing organic silver salts are already known. In particular, photothermographic materials generally have an image-forming layer in which the catalytically active amount of a photocatalyst (for example, silver halide), a reducer, a reducible silver salt (for example, an organic silver salt), and optionally a tone adjusting agent for controlling the color tone of silver are dispersed in a binder. After imagewise exposure, a photothermographic material is heated to a high temperature (for example, 80° C. or higher) to cause a redox reaction between a silver halide or a reducible silver salt (functioning as an oxidizer) and a reducer, forming a black silver image. The redox reaction is accelerated by the catalytic action of a latent image on the silver halide generated by the imagewise exposure. As a result, the black silver image is formed in an exposed region of the material. Much literature describes such photothermographic materials. FUDI MEDICAL DRY IMAGER FM-DP L™ serves as a medical image-forming system which uses photothermographic materials, and is put into practical use.

Thermal development does not require processing solutions, which are needed for wet development, and allows simple and rapid processing. However, the thermal development has unsolved problems that are not found in wet development. One of these is instable development. That is, the thermal development is advantageous in that it can be conducted by heating alone, but is problematic in that development irregularity occurs due to even a slight fluctuation or irregularity of the temperature of the heating surface of a heater. Moreover, the photographic characteristics of photothermographic materials are vulnerable to fluctuation in the environmental conditions surrounding heat development devices such as temperature and humidity. The other problem is that raw storage storability of photothermographic materials and storage stability of images formed should be improved. The reason why these properties are not good is that all the ingredients needed for image formation are contained in the coated films of the materials and, even after image formation, the unreacted ingredients and the reacted products remain in the film.

Use of a heat solvent to improve developing stability is known (see, for example, Japanese Patent Application Laid-Open (JP-A) Nos. 2004-78137 and 2004-86123). Use of a polymer latex binder containing a particular amount of polymerization initiator, a high-purity organic argentate salt, and/or a donor compound to improve storage stability is known (see, for example, JP-A Nos. 2003-337393, 2003-131336, and 2003-233149).

However, even with these compounds, such photothermographic materials are still unsatisfactory and there exists a demand for further improvement.

That is, there exists a need for a photothermographic material that gives a high-quality image with reduced development irregularity and is improved in image storability.

SUMMARY OF THE INVENTION

The invention provides a photothermographic material having a support and an image-forming layer containing a photosensitive silver halide, a non-photosensitive organic silver salt, and a reducer for the organic silver salt on at least one surface of the support, wherein the image-forming layer contains a hydrophilic polymer which has a vinyl monomer unit containing a quaternary nitrogen atom-containing group or a nitrogen-containing heterocyclic group.

Uniformity of image density is an important feature of image recording materials, especially those for medical diagnosis, because a slight irregularity in the density of an image for medical purposes may affect diagnosis significantly. In addition, storage stability is also an important requirement, because images are examined repeatedly after a certain period for evaluation of the progress of symptoms. After research into new ways of solving the problems associated with these photothermographic materials, the inventor has found that it is possible to solve such problems by mixing a hydrophilic polymer having a particular structure with the binder for the image-forming layer, and thus completed the invention.

The invention provides a photothermographic material that gives a high-quality image with reduced development irregularity and is improved in image storability.

DETAILED DESCRIPTION OF THE INVENTION

1. Photothermographic Material

The photothermographic material of the invention has a support and an image-forming layer containing a photosensitive silver halide, a non-photosensitive organic silver salt, a reducer, and a binder on at least one surface of the support. The image-forming layer may be provided on one surface or both surfaces of the support. Additionally, the photothermographic material may also have a surface protective layer on the image-forming layer. Moreover, when the photothermographic material has the image-forming layer on only one surface of the support, the material may have a back layer and a back surface protective layer on the other surface of the support.

Non-photosensitive Organic Silver Salt

1) Composition

The organic silver salt which can be used in the invention is relatively stable to light but, when heated to a temperature of 80° C. or higher in the presence of an exposed photosensitive silver halide and a reducer, serves as a silver ion-supplying matter and forms a silver image. The organic silver salt may be any organic material which can supply silver ions reducible by the reducer. Such a non-photosensitive organic silver salt is disclosed in, for example, JP-A No. 10-62899 (paragraph Nos. 0048 to 0049), EP No. 0803764A1 (page 18, line 24 to page 19, line 37), EP No. 0962812A1, and JP-A Nos. 11-349591, 2000-7683, and 2000-72711. The organic silver salt is preferably the silver salt of an organic acid, particularly the silver salt of a long-chain aliphatic carboxylic acid (having 10 to 30 carbon atoms, and preferably having 15 to 28 carbon atoms). Typical examples of the silver salt of a fatty acid include silver lignocerate, silver behenate, silver arachidate, silver stearate, silver oleate, silver laurate, silver caproate, silver myristate, silver palmitate, and silver erucate, and mixtures thereof. In the invention, it is preferred to use the silver salt of a fatty acid with a silver behenate content of 50 mol % or more among these silver salts of fatty acids, more preferably 85–100 mol %, and still more preferably 95–100 mol %. Further, it is preferred to use the silver salt of a fatty acid with a silver erucate content of 2 mol % or less, more preferably 1 mol % or less, and still more preferably 0.1 mol % or less.

The content of silver stearate in the organic silver salt is preferably 1 mol % or less. When the content of silver stearate is 1 mol % or less, the silver salt of an organic acid having low Dmin, high sensitivity and excellent image storability can be obtained. The content of silver stearate in the organic silver salt is more preferably 0.5 mol % or less, and is still more preferably substantially 0 mol %.

When the silver salt of an organic acid includes silver arachidate, the content of silver arachidate is preferably 6 mol % or less in order to obtain a silver salt of organic acid having low Dmin and excellent image storability. The content of silver arachidate is more preferably 3 mol % or less.

2) Shape

There is no particular restriction on the shape of the organic silver salt grains usable in the invention and they may have a needle-like, rod-like, tabular or flaky shape.

However, the organic silver salt grains preferably have a flaky shape in the invention. Also, short needle-like, rectangular parallelopiped, cuboidal, or potato-like, indefinitely shaped grains with a ratio of the major axis length to the minor axis length of 5 or less are preferably as the organic silver salt. Such organic silver grains have a lower level of fogging during thermal development than long needle-like grains with a ratio of the major axis length to the minor axis length of more than 5. In particular, the organic silver salt grains more preferably have a ratio of the major axis length to the minor axis length of 3 or less, since such grains can improve the mechanical stability of a coating film. In this specification, the flaky organic silver salt grains are defined as follows. When an organic acid silver salt grain is observed under an electron microscope, and the shape of the organic acid silver salt grain is approximated to a rectangular parallelopiped with sides having lengths of a, b and c in ascending order (the length c may be equal to the length b), a value of x is calculated from the shortest length a and the next shortest length b as follows.

$$x=b/a$$

When the values x of about 200 grains are calculated in the above manner and averaged, and the average satisfies the relation of x (average)≧1.5, grains having such an average value x are regarded as flaky. The flaky grains preferably satisfy the relation of 30≧x (average)≧1.5, and more preferably satisfy the relation of 15≧x (average)≧1.5. Needle-like grains satisfy the relation of 1≦x (average)≦1.5.

In the flaky grains, the length a corresponds to the thickness of a tabular grain having, as a principal plane, a plane with sides having lengths b and c. The average of lengths a is preferably 0.01 μm to 0.3 μm, and more preferably 0.1 μm to 0.23 μm. The average of the ratios of the lengths c to the lengths b is preferably 1 to 9, more preferably 1 to 6, still more preferably 1 to 4, and most preferably 1 to 3.

A sphere-equivalent diameter maintained within the range of from 0.05 to 1 μm hinders coagulation in the photosensitive material and provides satisfactory image storability. The sphere-equivalent diameter is preferably 0.1 to 1 μm. In the invention, the sphere-equivalent diameter can be determined by directly taking a photograph of a sample by an electron microscope and then executing image processing of the resultant negative film.

In the aforementioned flaky grains, the ratio of sphere-equivalent diameter/a of each grain is defined as an aspect ratio. The aspect ratio of the flaky grains is preferably within the range of 1.1 to 30 and more preferably within the range of 1.1 to 15 in view of hindering coagulation in the photosensitive material and improving image storability.

The grain size distribution of the organic silver salt grains is preferably monodisperse. The term "monodisperse" means that the percentage of a value obtained by dividing the standard deviations of the lengths of the shorter axis and the longer axis of each grain respectively by the shorter axis and the longer axis is preferably 100% or less, more preferably 80% or less and still more preferably 50% or less. The shapes of the organic silver salt grains can be determined from a transmission electron microscopic image of an organic silver salt dispersion. The check to determine whether the organic silver salt grains are monodisperse can be made as follows. The standard deviation of the volume-weighted average diameter of the organic silver salt grains is obtained, and the percentage (variation factor) of a value obtained by dividing the standard deviation by the volume-weighted average diameter is preferably 100% or less, more preferably 80% or less and still more preferably 50% or less. The volume-weighted average diameter can be obtained by irradiating the organic silver salt dispersed in liquid with laser light and determining the self-correlation function of the fluctuation of the scattered light with respect to time.

3) Preparation

Methods known in the art may be applied to a method for producing the organic silver salt used in the invention and to a dispersing method thereof. For example, reference can be made to JP-A No. 10-62899, EP-A Nos. 0803763A1 and 0962812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868.

When a photosensitive silver salt is present together with the organic silver salt during dispersion of the organic silver salt, the level of fogging increases and sensitivity becomes remarkably lower. Therefore, it is preferred that the photosensitive silver salt is not substantially contained in the system including the organic silver salt during the dispersion. In the invention, the amount of the photosensitive silver salt in an aqueous dispersion in which the organic silver salt is to be dispersed is preferably 1 mol % or less, more preferably 0.1 mol % or less per mol of the organic acid silver salt in the dispersion. It is even more preferable that positive addition of the photosensitive silver salt is not conducted.

In the invention, the aqueous dispersion of the organic silver salt and that of the photosensitive silver salt can be mixed in producing the photosensitive material, and the mixing ratio of the organic silver salt to the photosensitive silver salt can be selected depending on purpose. The ratio of the photosensitive silver salt to the organic silver salt is preferably in the range of 1 mol % to 30 mol %, more preferably in the range of 2 mol % to 20 mol %, and still more preferably in the range of 3 mol % to 15 mol %. Mixing two or more kinds of the aqueous dispersions of organic silver salts and two or more kinds of the aqueous dispersions of photosensitive silver salts is preferable to control photographic properties.

4) Addition Amount

The organic silver salt usable in the invention may be used in a desired amount, but the total amount of silver including silver contained in the organic silver salt and the silver halide is preferably 0.1 to 3.0 g/m$^2$, more preferably 0.5 to 2.0 g/m$^2$, and still more preferably 0.8 to 1.7 g/m$^2$. In particular, to improve image storability, the total coating silver amount is preferably 1.5 g/m$^2$ or less and more preferably 1.3 g/m$^2$ or less. Use of a reducer preferably used in the invention allows sufficiently high image density even at such a low silver amount.

Reducer for Organic Silver Salt

The photothermographic material of the invention preferably includes a thermal development agent which is a reducer for the organic silver salt. The reducer for the organic silver salt can be any substance (preferably organic substance) capable of reducing a silver ion into metal silver. Examples of such a reducer are described in JP-A No. 11-65021, paragraph Nos. 0043–0045 and EP-A No. 0803764A1, page 7, line 34 to page 18, line 12.

The reducer employed in the invention is preferably a bisphenol reducer or a so-called hindered phenol reducer having a substituent in an ortho-position with respect to the phenolic hydroxyl group, and is more preferably a compound represented by the following Formula (R).

Formula (R)

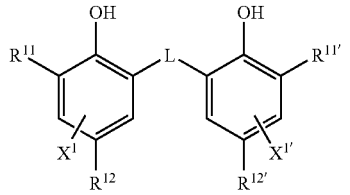

In Formula (R), $R^{11}$ and $R^{11'}$ independently represent an alkyl group having 1 to 20 carbon atoms. $R^{12}$ and $R^{12'}$ independently represent a hydrogen atom or a substituent group which can bond to the benzene ring. L represents an —S— or —CHR$^{13}$— group. $R^{13}$ represents a hydrogen atom or an alkyl group having 1 to 20 carbon atoms. $X_1$ and $X_1'$ independently represent a hydrogen atom or a group which can bond to the benzene ring.

A detailed explanation on Formula (R) will be given in the following.

1) $R^{11}$ and $R^{11'}$ $R^{11}$ and $R^{11'}$ independently represent a substituted or unsubstituted alkyl group having 1 to 20 carbon atoms. The type of the substituent of the substituted alkyl group is not particularly limited, but the substituent is preferably an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group or a halogen atom.

2) $R^{12}$ and $R^{12'}$, and $X_1$ and $X_1'$ $R^{12}$ and $R^{12'}$ independently represent a hydrogen atom or a substituent group which can bond to the benzene ring, and $X_1$ and $X_1'$ independently represent a hydrogen atom or a substituent group which can bond to the benzene ring. Typical examples of the group which can bond to the benzene ring include alkyl groups, aryl groups, halogen atoms, alkoxy groups, and acylamino groups.

3) L

L represents an —S— or —CHR$^{13}$— group. $R^{13}$ represents a hydrogen atom or a substituted or unsubstituted alkyl group having 1 to 20 carbon atoms. When $R^{13}$ is the unsubstituted alkyl group, typical examples thereof include methyl, ethyl, propyl, butyl, heptyl, undecyl, isopropyl, 1-ethylpentyl, 2,4,4-trimethylpentyl, cyclohexyl, 2,4-dimethyl-3-cyclohexenyl, and 3,5-dimethyl-3-cyclohexenyl groups. As in the examples of the substituent group for $R^{11}$, examples of the substituent group of the substituted alkyl group include halogen atoms, alkoxy groups, aklylthio groups, aryloxy groups, arylthio groups, acylamino groups, sulfonamide groups, sulfonyl groups, phosphoryl groups, oxycarbonyl groups, carbamoyl groups, and sulfamoyl groups.

4) Preferable Substituent Group

Each of $R^{11}$ and $R^{11'}$ is preferably a primary, secondary or tertiary alkyl group having 1 to 15 carbon atoms, and specific examples thereof include methyl, isopropyl, t-butyl, t-amyl, t-octyl, cyclohexyl, cyclopentyl, 1-methylcyclohexyl, and 1-methylcyclopropyl groups. Each of $R^{11}$ and $R^{11'}$ is more preferably an alkyl group having 1 to 4 carbon atoms. Among these, each of $R^{11}$ and $R^{11'}$ is more preferably a methyl, t-butyl, t-amyl, or 1-methylcyclohexyl group, and is most preferably a methyl or t-butyl group.

Each of $R^{12}$ and $R^{12'}$ is preferably an alkyl group having 1 to 20 carbon atoms, and specific examples thereof include methyl, ethyl, propyl, butyl, isopropyl, t-butyl, t-amyl, cyclohexyl, 1-methylcyclohexyl, benzyl, methoxymethyl, and methoxyethyl groups. Each of $R^{12}$ and $R^{12'}$ is more preferably a methyl, ethyl, propyl, isopropyl, or t-butyl group, and is most preferably a methyl or ethyl group.

Each of $X_1$ and $X_1'$ is preferably a hydrogen or halogen atom, or an alkyl group, and more preferably a hydrogen atom.

L is preferably a —CHR$^{13}$— group.

$R^{13}$ is preferably a hydrogen atom or an alkyl group having 1 to 15 carbon atoms. The alkyl group can be chain-like or cyclic. Also, an alkyl group having a C=C bond in the above alkyl group is also preferable. Typical examples of the alkyl group include methyl, ethyl, propyl, isopropyl, 2,4,4-trimethylpentyl, cyclohexyl, 2,4-dimethyl-3-cyclohexenyl, and 3,5-dimethyl-3-cyclohexenyl groups. $R^{13}$ is more preferably a hydrogen atom, or a methyl, ethyl, propyl, isopropyl, or 2,4-dimethyl-3-cyclohexenyl group.

When $R^{11}$ and $R^{11'}$ are tertiary alkyl groups and $R^{12}$ and $R^{12'}$ are methyl groups, $R^{13}$ is preferably a primary or secondary alkyl group having 1 to 8 carbon atoms such as a methyl, ethyl, propyl, isopropyl, or 2,4-dimethyl-3-cyclohexenyl group.

When $R^{11}$ and $R^{11'}$ are tertiary alkyl groups and $R^{12}$ and $R^{12'}$ are alkyl groups other than a methyl group, $R^{13}$ is preferably a hydrogen atom.

When $R^{11}$ and $R^{11'}$ are not tertiary alkyl groups, $R^{13}$ is preferably a hydrogen atom or a secondary alkyl group, and more preferably a secondary alkyl group. The secondary alkyl group is preferably an isopropyl or 2,4-dimethyl-3-cyclohexenyl group.

The reducer exerts different types of influence on thermal developability, and the silvery tone of developed images, depending on the combination of $R^{11}$, $R^{11'}$, $R^{2}$, $R^{12'}$ and $R^{13}$. Two or more of the reducers are preferably used together according to application, because the above properties can be controlled by a proper combination of two or more reducers.

Specific examples of the reducer used in the invention, including the compounds represented by Formula (R) are shown below, but the invention is not limited by such examples.

R-1

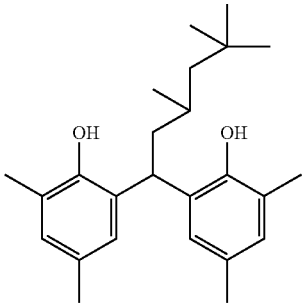

R-2

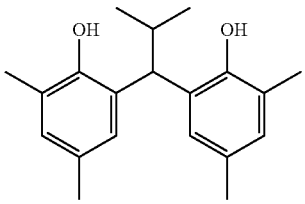

R-3

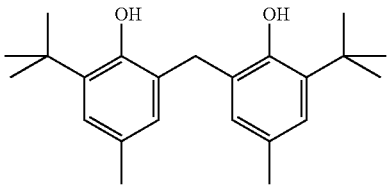

R-4

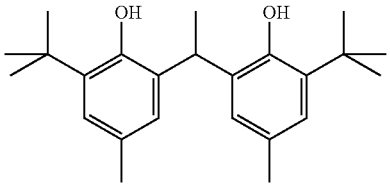

-continued

R-5

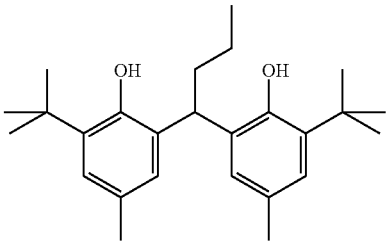

R-6

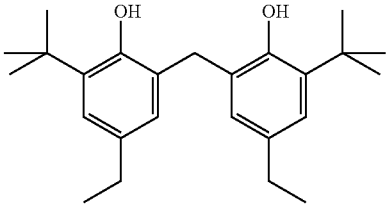

R-7

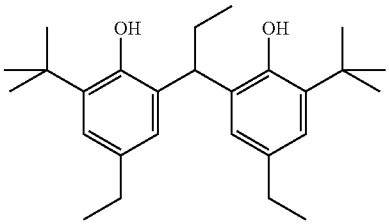

R-8

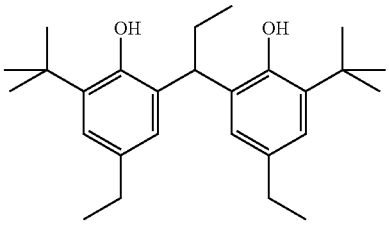

R-9

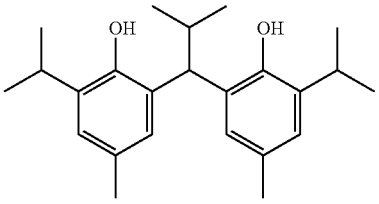

R-10

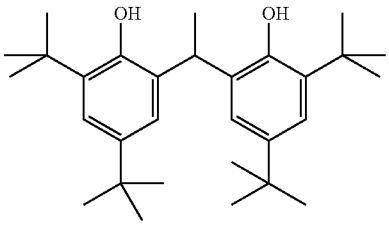

R-11

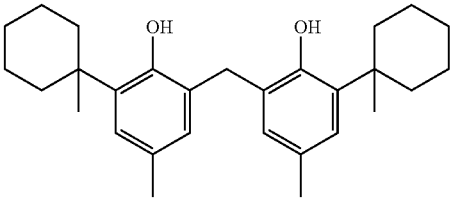

-continued

R-12

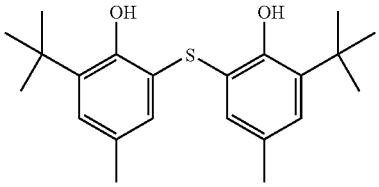

R-13

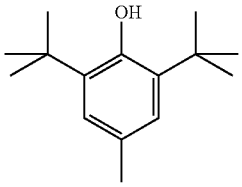

R-14

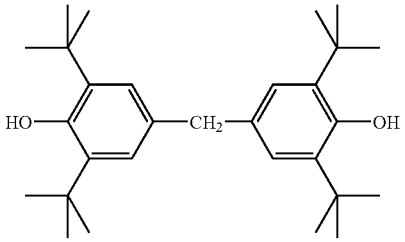

R-15

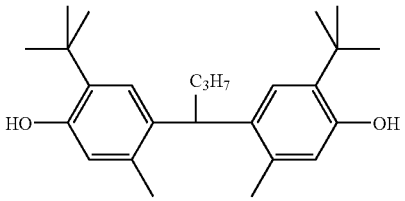

R-16

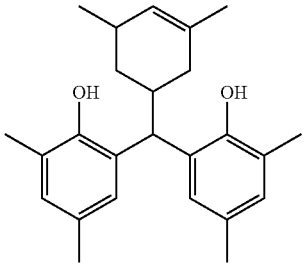

R-17

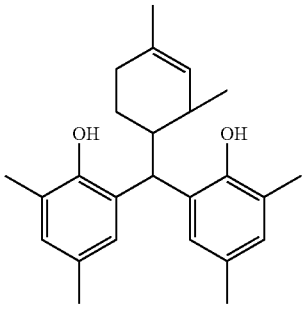

-continued

R-18

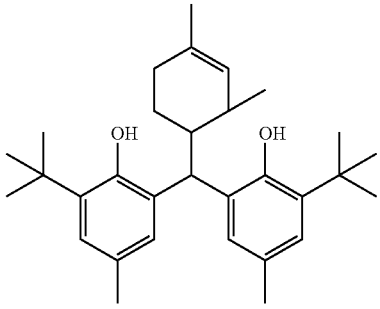

Typical examples of the reducer used in the invention other than those described above include compounds described in JP-A Nos. 2001-188314, 2001-209145, 2001-350235, and 2002-156727, and EP No. 1278101A2.

In the invention, the amount of the reducer added is preferably 0.1 to 3.0 g/m$^2$, more preferably 0.2 to 1.5 g/m$^2$, and still more preferably 0.3 to 1.0 g/m$^2$. The amount of the reducer is preferably 5 to 50 mol. % per mole of silver contained in a layer or layers of the thermographic material which are provided on the surface of a support on which the image-forming layer is provided, more preferably 8 to 30 mol. %, and still more preferably 10 to 20 mol. %. The reducer is preferably included in the image-forming layer.

The reducer may be contained in a coating liquid used in preparing the photosensitive material in any form of a solution, emulsified dispersion, or solid fine particle dispersion.

In a well-known emulsification dispersion method, an emulsified dispersion is mechanically prepared by dissolving the reducer in oil such as dibutyl phthalate, tricresyl phosphate, glyceryl triacetate or diethyl phthalate and a supplementary solvent such as ethyl acetate or cyclohaxanone and emulsifying and dispersing the resultant solution in water.

In a method for dispersing solid fine particles, powder of the reducer is dispersed in an appropriate solvent such as water by means of a ball mill, a colloid mill, a vibrating ball mill, a sand mill, a jet mill, a roller mill, or ultrasonic waves, thereby obtaining a solid dispersion. In this case, a protective colloid such as polyvinyl alcohol, or a surfactant (for instance, an anionic surfactant such as sodium triisopropylnaphthalenesulfonate (a mixture of compounds having the isopropyl groups in different substitution sites) may be added to the dispersion. The above-described mill generally contains, as dispersion media, zirconia beads, and zirconium derived from the beads may contaminate the dispersion. The amount of zirconium in the dispersion depends on the dispersing conditions, but is generally in the range of 1 ppm to 1000 ppm. Zirconium being contained in an amount of 0.5 mg or less per g of silver is practically acceptable.

The aqueous dispersion preferably contains an antiseptic agent (e.g., benzisothiazolinone sodium salt).

In the invention, the reducer is preferably used as a solid particle dispersion, and the mean particle size of the reducer fine particles is generally 0.01 μm to 10 μm, preferably 0.05

μm to 5 μm, and still more preferably 0.1 μm to 2 μm. In the invention, particles contained in other solid dispersions preferably have a mean particle size within the above range.

Photosensitive Silver Halide

1) Halogen Composition

The type of the halogen composition of a photosensitive silver halide to be employed in the invention is not particularly restricted, and the photosensitive silver halide can be silver chloride, silver chlorobromide, silver bromide, silver iodobromide, silver iodochlorobromide or silver iodide. Among these, the photosensitive silver halide is preferably silver bromide, silver iodobromide or silver iodide. The halogen composition within each grain may be uniform, or may stepwise change or continuously change. Also, silver halide grains having a core/shell structure may be preferably employed as the photosensitive silver halide. The core/shell structure is preferably a 2- to 5-layered structure, and more preferably 2- to 4-layered structure. A Silver bromide or silver iodide layer may be provided on the surface of each of silver chloride, silver bromide or silver chlorobromide grains.

2) Grain Forming Method

A method for forming photosensitive silver halide grains is well known in the art, and can be, for example, any of methods described in Research Disclosure 17029, June 1978 and U.S. Pat. No. 3,700,458. More specifically, a method can be used in which a silver-supplying compound and a halogen-supplying compound are added to a solution of gelatin or other polymer to prepare a photosensitive silver halide, which is then mixed with an organic silver salt. Alternatively, any of methods described in JP-A No. 11-119374, paragraph Nos. 0217 to 0224, and JP-A Nos. 11-352627 and 2000-347335 can be used.

3) Grain Size

The sizes of the photosensitive silver halide grains are preferably small to suppress turbidity after image formation. More specifically, it is preferably 0.20 μm or less, more preferably 0.01 to 0.15 μm and even more preferably 0.02 to 0.12 μm. The grain size means a diameter of a circle having the same area as the projected area of a silver halide grain (in the case where the photosensitive silver halide grains are tabular, the projected area of the principal plane thereof).

4) Grain Shape

The shapes of the silver halide grains can be cubic, octahedral, tabular, spherical, rod-like, or potato-like, but the silver halide grains are preferably cubic in the invention. Moreover, silver halide grains having rounded corners can also be advantageously employed. The plane index (Miller's index) of the external surface of each photosensitive silver halide grain is not particularly restricted. However, it is preferable that the proportion of a {100} plane, which, when the grain adsorbs a spectrally sensitizing dye, shows high spectral sensitization efficiency, is high. The proportion is preferably 50% or higher, more preferably 65% or higher and still more preferably 80% or higher. The Miller's index of the {100} plane can be determined by a method described in T. Tani; J. Imaging Sci., 29, 165 (1985), utilizing adsorption dependences of {111} and {100} planes in the adsorption of a sensitizing dye.

5) Heavy Metal

The photosensitive silver halide grains used in the invention may include a metal or a complex of a metal of Groups 3 to 13 of the periodic table having Groups 1 to 18. The metal or the central metal of the metal complex preferably belongs to Groups 8 to 10 of the periodic table. Such a metal or central metal is preferably iron, rhodium, ruthenium or iridium. Such a metal complex may be used alone, or two or more complexes having the same metal or different metals can be used together. The content of the metal or metal complex is preferably within the range of $1\times10^{-9}$ to $1\times10^{-3}$ moles per mole of silver. The heavy metals, and complexes thereof and a method of addition thereof are described in JP-A Nos. 7-225449, 11-65021, paragraph Nos. 0018 to 0024, and 11-119374, paragraph Nos. 0227 to 0240.

In the invention, the silver halide grains preferably contain a hexacyano metal complex in the outermost surface portion thereof. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. In the invention, the hexacyano metal complex is preferably a hexacyano iron complex.

Since the hexacyano metal complex is present in the form of ions in an aqueous solution, the counter cation is not important. However, the counter cation is preferably an alkali metal ion such as a sodium ion, a potassium ion, a rubidium ion, a cesium ion or a lithium ion, an ammonium ion or an alkylammonium ion (such as a tetramethylammonium ion, a tetraethylammonium ion, a tetrapropylammonium ion or a tetra(n-butyl)ammonium ion), because it is easily miscible with water and is suitable for precipitating operation of a silver halide emulsion.

The hexacyano metal complex can be mixed with water, or a mixed solvent of water and a suitable organic solvent miscible with water (for example, alcohol, ether, glycol, ketone, ester or amide), or gelatin in preparing the photothermographic material.

The amount of the hexacyano metal complex added is preferably $1\times10^{-5}$ to $1\times10^{-2}$ moles per mole of silver, and more preferably $1\times10^{-4}$ to $1\times10^{-3}$ moles per mole of silver.

In order to for the hexacyano metal complex to exist in the outermost surface portion of each silver halide grain, the hexacyano metal complex is directly added to a system before the end of a charging step, or during a rinsing step or a dispersing step, or before a chemical sensitization step, namely within a period from the end of addition of an aqueous silver nitrate solution for grain formation to the start of the chemical sensitization step, such as a chalcogen sensitization including sulfur sensitization, selenium sensitization or tellurium sensitization, or a precious metal sensitization including gold sensitization. In order to prevent the growth of the silver halide fine grains, it is preferable to add the hexacyano metal complex to the system soon after the grain formation, and to execute the addition before the end of the charging step.

The addition of the hexacyano metal complex is preferably started after 96 mass % of the total amount of silver nitrate for grain formation is added to the system, more preferably after 98 mass % of the total amount of silver nitrate for grain formation is added to the system and still more preferably after 99 mass % of the total amount of silver nitrate for grain formation is added to the system.

When the hexacyano metal complex is added after the addition of the last portion of an aqueous silver nitrate solution to be added immediately before the completion of grain formation, the metal complex can be adsorbed on the outermost surfaces of silver halide grains, and most thereof and silver ions on the surfaces of the grains form a poorly soluble salt. The resultant silver salt of hexacyanoferrate (II) is less soluble than AgI. Therefore, even when the silver halide grains are small, re-dissolution of the silver salt of hexacyanoferrate can be prevented, thereby enabling production of silver halide grains having a small size.

The metal atom or metal complex (for example, $[Fe(CN)_6]^{4-}$) that can be included in the silver halide grains employed in the invention, a desalting method and a chemical sensitizing method of the silver halide emulsion are described in JP-A No. 11-84574, paragraph Nos. 0046–0050, No. 11-65021, paragraph Nos. 0025–0031, and No. 11-119374, paragraph Nos. 0242–0250.

6) Gelatin

Any type of gelatin can be contained in the photosensitive silver halide emulsion employed in the invention. It is necessary to maintain a satisfactory dispersion state of the photosensitive silver halide emulsion in a coating liquid containing an organic silver salt, and it is preferable to use gelatin having a molecular weight of 10,000 to 1,000,000. It is also preferable to phthalate the substituent of gelatin. Such gelatin may be used at the time of grain formation, or dispersion after a desalting process, however it is preferably used at the time of grain formation.

7) Sensitizing Dye

In the invention, it is preferable that, when adsorbed on the silver halide grains, a sensitizing dye can spectrally sensitize the silver halide grains in a desired wavelength region and has spectral sensitivity suitable for the spectral characteristics of an exposure light source. Examples of the sensitizing dye and a method of addition thereof are described in, for example, JP-A No. 11-65021, paragraph Nos. 0103–0109, JP-A No. 10-186572 (a compound represented by Formula (II)), JP-A No. 11-119374 (a dye represented by Formula (I) and the descriptions of paragraph No. 0106), U.S. Pat. No. 5,510,236, U.S. Pat. No. 3,871,887 (a dye described in Example 5), JP-A Nos. 2-96131 and 59-48753 (dyes disclosed therein), EP-A No. 0803764A1 (page 19, line 38 to page 20, line 35), and JP-A Nos. 2001-272747, 2001-290238 and 2002-23306. One of these sensitizing dyes may be used alone or two or more of these can be used together. In the invention, adding the sensitizing dye to the silver halide emulsion is preferably conducted in a period from the end of a desalting process to a coating process, and more preferably in a period from the end of the desalting process to the end of a chemical ripening process.

The amount of the sensitizing dye added in the invention can be selected according to a desired sensitivity or a desired fog level, however it is preferably within the range of $10^{-6}$ to 1 mole per mole of silver halide in the image-forming layer, and more preferably $10^{-4}$ to $10^{-1}$ moles.

In the invention, in order to improve spectral sensitizing efficiency, the photosensitive silver halide emulsion may contain a super sensitizer. Examples of the super sensitizer employable in the invention include compounds described in EP-A No. 587,338, U.S. Pat. Nos. 3,877,943 and 4,873,184 and JP-A Nos. 5-341432, 11-109547 and 10-111543.

8) Chemical Sensitization

The photosensitive silver halide grains in the invention are preferably chemically sensitized by a sulfur, selenium and/or tellurium sensitization method. Any of known compounds, for example, those described in JP-A No. 7-128768, may be used as the compound for use in the sulfur, selenium, and/or tellurium sensitization method. In particular, the grains are preferably subjected to tellurium sensitization in the invention, and any of compounds described in literature shown in paragraph No. 0030 of JP-A No. 11-65021 and compounds represented by Formulae (II), (III), and (IV) of JP-A No. 5-313284 is preferably used in the sensitization.

The photosensitive silver halide grains used in the invention are preferably chemically sensitized by a gold sensitization method or a combination of a gold sensitization method and the chalcogen sensitization. A gold sensitizer preferably contains a monovalent or trivalent gold, and is preferably an ordinarily employed gold sensitizer. Typical examples thereof include chloroauric acid, bromoauric acid, potassium chloroaurate, potassium bromoaurate, auric trichloride, potassium auric thiocyanate, potassium iodoaurate, tetracyanoauric acid, ammonium aurothiocyanate, and pyridyl trichlorogold. In addition, any of gold sensitizers described in U.S. Pat. No. 5,858,637 and JP-A No. 2002-278016 can also be preferably used.

In the invention, the chemical sensitization may be executed any time after grain formation and before coating, and can be executed, after desalting, and (1) before spectral sensitization, (2) simultaneously with spectral sensitization, (3) after spectral sensitization, or (4) immediately before coating.

The amount of the sulfur, selenium or tellurium sensitizer employed in the invention depends on the type of the silver halide grains to be used and chemical ripening conditions. However, it is generally within the range of $10^{-8}$ to $10^{-2}$ moles per mole of silver halide, and preferably $10^{-7}$ to $10^{-3}$ moles.

The amount of the gold sensitizer to be added depends on various conditions. However, it is generally within the range of $10^{-7}$ to $10^{-3}$ moles per mole of silver halide, and preferably $10^{-6}$ to $5\times10^{4}$ moles.

The conditions of the chemical sensitization in the invention are not particularly restricted. Generally, the pH of the emulsion is 5 to 8, the pAg of the emulsion is 6 to 11 and the temperature is 40 to 95° C.

The silver halide emulsion to be employed in the invention may contain a thiosulfonic acid compound by a method described in EP-A No. 293,917.

The photosensitive silver halide grains used in the invention preferably contain a reduction sensitizer. The compound used in reduction sensitization is preferably ascorbic acid, thiourea dioxide, stannous chloride, aminoiminomethane sulfinic acid, a hydrazine derivative, a borane compound, a silane compound, or a polyamine compound. The reduction sensitizer may be added in any step in the photosensitive emulsion preparing process from a grain growing step to an adjusting step immediately before coating. It is also preferred to execute the reduction sensitization by ripening the emulsion at a pH value of 7 or higher or at a pAg value of 8.3 or lower, or by introducing a single addition part of silver ions in the course of grain formation.

9) Compound that can be One-electron-oxidized to Provide a One-electron Oxidant which Releases One or More Electrons The photothermographic material of the invention preferably contains a compound that can be one-electron-oxidized to provide a one-electron oxidant which releases one or more electrons. The compound is used alone or used together with the chemical sensitizer(s) described above, and increases the sensitivity of silver halide.

The compound that can be one-electron-oxidized to provide a one-electron oxidant which releases one or more electrons, and which is contained in the photosensitive material of the invention is selected from the following type-1 compound and type-2 compound.

Type-1 Compound

A compound that can be one-electron-oxidized to provide a one-electron oxidant which further releases one or more electrons, due to being subjected to a subsequent bond cleavage reaction Type-2 Compound A compound that can be one-electron-oxidized to provide a one-electron oxidant, which further releases one or more electrons after being subjected to a subsequent bond formation reaction At first type-1 compound will be explained.

Examples of type-1 compound that can be one-electron-oxidized to provide a one-electron oxidant which further releases one or more electrons, due to being subjected to a subsequent bond cleavage reaction include compounds described as "1-photon 2-electron sensitizers" or "deprotonated electron-donating sensitizers" in JP-A No. 9-211769 (compounds PMT-1 to S-37 described in Tables E and F on pages 28 to 32), JP-A No. 9-211774, JP-A No. 11-95355 (compounds INV 1–36), JP-A No. 2001-500996 (compounds 1–74, 80–87, and 92–122), U.S. Pat. Nos. 5,747,235 and 5,747,236, EP No. 786692A1 (compounds INV 1–35), EP No. 893732A1, U.S. Pat. Nos. 6,054,260 and 5,994,051. Preferred embodiments of these compounds are the same as those described in the specifications of the above applications.

Examples of type-1 compound that can be one-electron-oxidized to provide a one-electron oxidant which further releases one or more electrons, due to being subjected to a subsequent bond cleavage reaction include compounds represented by Formula (1) (the same as Formula (1) described in JP-A No. 2003-114487), Formula (2) (the same as Formula (2) described in JP-A No. 2003-114487), Formula (3) (the same as Formula (1) described in JP-A No. 2003-114488), Formula (4) (the same as Formula (2) described in JP-A No. 2003-114488), Formula (5) (the same as Formula (3) described in JP-A No. 2003-114488), Formula (6) (the same as Formula (1) described in JP-A No. 2003-75950), Formula (7) (the same as Formula (2) described in JP-A No. 2003-75950), and the Formula (8) (the same as Formula (1) described in Japanese Patent Application No. 2003-25886), and compounds which can cause a reaction represented by Chemical Reaction Formula (1) (the same as Chemical Reaction Formula (1) described in Japanese Patent Application No. 2003-33446) and which are represented by Formula (9) (the same as Formula (3) described in Japanese Patent Application No. 2003-33446). Preferred embodiments of these compounds are also the same as those described in the specifications of the above applications.

Formula (1)

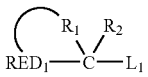

Formula (2)

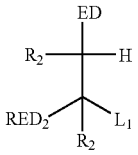

-continued

Formula (3)

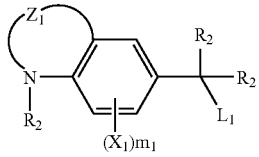

Formula (4)

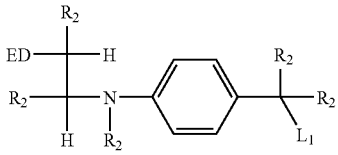

Formula (5)

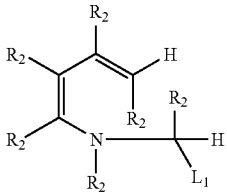

Formula (6)

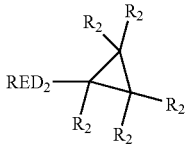

Formula (7)

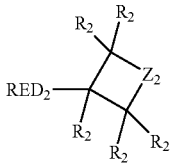

Formula (8)

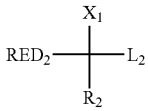

Chemical reaction formula (1)

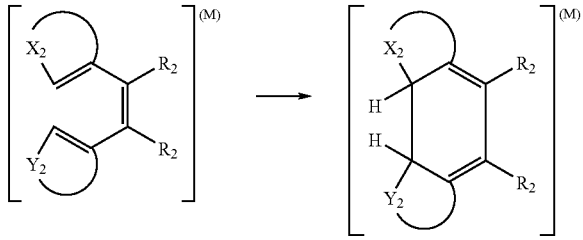

Formula (9)

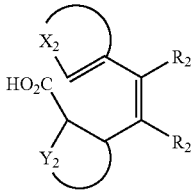

In these formulae, $RED_1$ and $RED_2$ represent a reductive group. $R_1$ represents a non-metal atomic group which, together with a carbon atom (C) and $RED_1$, can form a cyclic structure equivalent to a tetrahydro derivative or an octahydro derivative of a five- or six-membered aromatic ring (including a hetero aromatic ring). $R_2$ represents a hydrogen atom or a substituent. In the case where plural $R_2$ exist in the same molecule, these may be identical with or different from each other. $L_1$ represents a leaving group. ED represents an electron-donating group. $Z_1$ represents an atomic group which, together with a nitrogen atom and two carbon atoms of a benzene ring, can form a six-membered ring. $X_1$ represents a substituent, and $m_1$ represents an integer of 0 to 3. $Z_2$ represents —$CR_{11}R_{12}$—, —$NR_{13}$—, or —O—. $R_{11}$ and $R_{12}$ independently represent a hydrogen atom or a substituent. $R_{13}$ represents a hydrogen atom, an alkyl group, an aryl group, or a heterocyclic group. $X_1$ represents an alkoxy group, an aryloxy group, a heterocyclic oxy group, an alkylthio group, an arylthio group, a heterocyclic thio group, an alkylamino group, an arylamino group, or a heterocyclic amino group. $L_2$ represents a carboxyl group or a salt thereof, or a hydrogen atom. $X_2$ represents a group which, together with a C═C group, forms a five-membered heterocycle. M represents a radical, a radical cation, or a cation.

Next, type-2 compound of will be explained.

Specific examples of type-2 compound, a compound that can be one-electron-oxidized to provide a one-electron oxidant, which further releases one or more electrons after being subjected to a subsequent bond formation reaction, include the compound represented by Formula (10) (the same as Formula (1) described in JP-A No. 2003-140287), and the compound represented by Formula (11) (the same as Formula (2) described in Japanese Patent Application No. 2003-33446) which can cause the chemical reaction represented by Chemical Reaction Formula (1) (the same as Chemical Reaction Formula (1) described in Japanese Patent Application No. 2003-33446). Preferred embodiments of these compounds are the same as those described in the specifications of the above applications.

$X—L_2—Y$ Formula (10)

Chemical Reaction Formula (1)

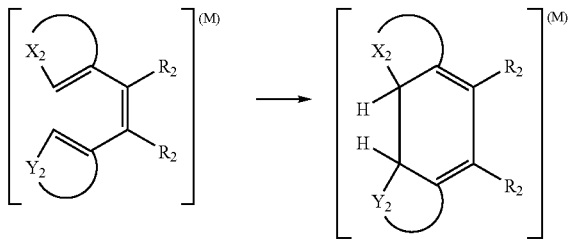

Formula (11)

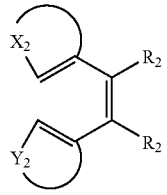

In these formulae, X represents a reductive group to be one-electron-oxidized. Y represents a reactive group containing a carbon-carbon double or triple bond, an aromatic group site, or a benzo-fused non-aromatic heterocyclic ring site that can react with the one-electron oxidant generated by one-electron oxidation of X to form a new bond. $L_2$ represents a connecting group connecting X and Y $R_2$ represents a hydrogen atom or a substituent. When plural $R_2$ groups are present in the same molecule, these may be the same as or different from each other. $X_2$ represents a group that, together with a C═C group, forms a five-membered heterocyclic ring. $Y_2$ represents a group that, together with a C═C group, forms a five- or six-membered aryl or heterocyclic group. M represents a radical, radical cation, or cation.

Type-1 or 2 compound is preferably a "compound having an adsorptive group to silver halide in the molecule thereof" or "compound having the partial structure of a spectral sensitizing dye in the molecule thereof". Typical examples of the adsorptive group to silver halide include groups described in JP-A No. 2003-156823, page 16, line 1 of right column to page 17, line 12 of right column. The partial structure of a spectral sensitizing dye is the structure described in JP-A No. 2003-156823, page 17, line 34 of right column to page 18, line 6 of left column.

Type-1 or 2 compound is more preferably a "compound having at least one adsorptive group to silver halide in the molecule thereof", and still more preferably a "compound having two or more adsorptive groups to silver halide in the molecule thereof". In the case where two or more adsorptive groups exist in the same molecule, these adsorptive groups may be identical with or different from each other.

The adsorptive group is preferably a mercapto-substituted, nitrogen-containing heterocyclic group (e.g., a 2-mercaptothiadiazole, 3-mercapto-1,2,4-triazole, 5-mercaptotetrazole, 2-mercapto-1,3,4-oxadiazole, 2-mercaptobenzoxazole, 2-mercaptobenzthiazole, or 1,5-dimethyl-1,2,4-triazolium-3-thiolate group), or a nitrogen-containing heterocyclic group having, as the partial structure of the heterocyclic ring, an —NH— group that can form imino silver (>NAg) (e.g., a benztriazole, benzimidazole, or indazole group). The adsorptive group is more preferably a 5-mercaptotetrazole, 3-mercapto-1,2,4-triazole, or benztriazole group, and most preferably a 3-mercapto-1,2,4-triazole or 5-mercaptotetrazole group.

The adsorptive group particularly preferably has two or more mercapto groups as the partial structure within the molecule. The mercapto group (—SH) may become a thion group in the case where the compound including the mercapto group can tautomerize. Typical examples of the adsorptive group having two or more mercapto groups as the partial structure (such as dimercapto-substituted, nitrogen-containing heterocyclic group) include a 2,4-dimercaptopyrimidine group, a 2,4-dimercaptotriazine group, and a 3,5-dimercapto-1,2,4-triazole group.

The quaternary salt structure of nitrogen or phosphor can also be advantageously employed as the adsorptive group. Specific examples of the quaternary salt structure of nitrogen include ammonio groups (such as trialkylammonio groups, dialkylaryl (or heteroaryl) ammonio groups, and alkyldiaryl (or heteroaryl) ammonio groups), and groups including a nitrogen-containing heterocyclic group with a quaternary nitrogen atom. Examples of the quaternary salt structure of phosphor include phosphonio groups (such as trialkylphosphonio groups, dialkylaryl (or heteroaryl) phosphonio groups, alkyldiaryl (or heteroaryl) phosphonio group, and triaryl (or heteroaryl) phosphonio groups). The quaternary salt structure of nitrogen is more preferable, and a five- or six-membered, nitrogen-containing aromatic heterocyclic group including a quaternary nitrogen atom is still more preferable. A pyridinio group, a quinolinio group or an isoquinolinio group is particularly preferable. Such a nitrogen-containing aromatic heterocyclic group including a quaternary nitrogen atom may have any substituent.

Examples of the counter anion of the quaternary salt include a halogen ion, a carboxylate ion, a sulfonate ion, a sulfate ion, a perchlorate ion, a carbonate ion, a nitrate ion, a $BF_4^-$ ion, a $PF_6^-$ ion and a $Ph_4B^-$ ion. In the case where a group having a negative charge such as a carboxylate group is present in the molecule, the counter anion and such a group can form an intramolecular salt. The counter anion not present within the molecule is particularly preferably a chloride ion, a bromide ion or a methanesulfonate ion.

Preferable structures of type-1 and type-2 compounds having the quaternary salt structure of nitrogen or phosphorus as an adsorptive group are represented by Formula (X).

$$(P—Q_1—)_i—R(—Q_2—S)_j \qquad \text{Formula (X)}$$

In Formula (X), P and R independently represent the quaternary salt structure of nitrogen or phosphorus which quaternary salt structure is not the partial structure of a sensitizing dye. $Q_1$ and $Q_2$ independently represent a connecting group, and specifically is a single bond, an alkylene group, an arylene group, a heterocyclic group, —O—, —S—, —$NR_N$—, —C(═O)—, —$SO_2$—, —SO—, or —P(═O)—, or a group having a combination of two or more of these groups. RN represents a hydrogen atom, or an alkyl, aryl, or heterocyclic group. S is a residue obtained by removing an atom from type-1 or type-2 compound. i and j independently represent an integer of 1 or more, and are selected so that the sum of them is 2 to 6. Preferably, i is 1 to 3 and j is 1 or 2. More preferably, i is 1 or 2 and j is 1. Still more preferably, i is 1 and j is 1. The compound represented by Formula (X) preferably has 10 to 100 carbon atoms, more preferably 10 to 70 carbon atoms, still more preferably 11 to 60 carbon atoms, and most preferably 12 to 50 carbon atoms in total.

Type-1 or type-2 compound in the invention may be used in any step of a process for preparing the photosensitive silver halide emulsion and that for producing the photothermographic material. The compound may be used, for example, during preparation of photosensitive silver halide grains, a desalting step, or chemical sensitization, or before coating. The compound may be added to a system plural times in these processes. The compound is added preferably during the period starting at the end of formation of photosensitive silver halide grains and ending before a desalting step, during chemical sensitization (period starting immediately before initiation of chemical sensitization and ending immediately after termination of the chemical sensitization), or before coating, and more preferably during the period starting at initiation of chemical sensitization and ending before mixing the photosensitive silver halide grains with a non-photosensitive organic silver salt.

Type-1 or type-2 compound in the invention is preferably dissolved in water, a water-soluble solvent such as methanol or ethanol, or a mixture of these solvents in adding the compound to a system. When the compound can be dissolved in water and can be more soluble in an aqueous medium having an increased or decreased pH value, such an aqueous medium may be prepared from water and the compound may be dissolved in the medium.

Type-1 or type-2 compound in the invention is preferably contained in the image-forming layer containing a photosensitive silver halide and a non-photosensitive organic silver salt, but may be contained in a coating liquid for at least one of a protective layer and an intermediate layer as well as a coating liquid for image-forming layer containing a photosensitive silver halide and a non-photosensitive organic silver salt and be diffused during coating. The compound may be added to a system regardless of a sensitization dye having been added or not. The amount of the compound in the silver halide emulsion layer (image-forming layer) is preferably $1\times10^{-9}$ moles to $5\times10^{-1}$ moles, and more preferably $1\times10^{-8}$ moles to $5\times10^{-2}$ moles with respect to 1 mole of silver halide.

10) Adsorptive Redox Compound Having an Adsorptive Group and a Reductive Group

The photothermographic material of the invention preferably contains an adsorptive redox compound having an adsorptive group to silver halide and a reductive group in the molecule. The adsorptive redox compound is preferably a compound represented by the following Formula (I):

$$A\text{-}(W)n\text{-}B \qquad \text{Formula (I)}$$

In Formula (I), A represents a group that is adsorptive to silver halide (hereinafter, referred to as an adsorptive group); W represents a bivalent connecting group; n is an integer of 0 or 1; and B represents a reductive group.

In Formula (I), the adsorptive group represented by A is a group which adsorbs directly to silver halide or a group which promotes adsorption of the compound of Formula (I) to silver halide. Typical examples thereof include a mercapto group (or a salt thereof), a thione group (—C(═S)—), a heterocyclic group containing at least one atom selected from a nitrogen atom, a sulfur atom, a selenium atom and a tellurium atom, a sulfide group, a disulfide group, a cationic group, and an ethynyl group.

The mercapto group (or a salt thereof) serving as the adsorptive group can be a mercapto group (or a salt thereof), or a heterocyclic, aryl, or alkyl group substituted with at least one mercapto group (or a salt thereof), and is more preferably such a heterocyclic, aryl, or alkyl group. The heterocyclic group is a five- to seven-membered, monocyclic or condensed, aromatic or non-aromatic heterocyclic group. Typical examples thereof include imidazole, thiazole, oxazole, benzimidazole, benzthiazole, benzoxazole, triazole, thiadiazole, oxadiazole, tetrazole, purine, pyridine, quinoline, isoquinoline, pyrimidine, and triazine ring groups. The heterocyclic group may contain a quaternary nitrogen atom, and in such a case, the mercapto group serving as the substituent may dissociate to become a meso ion. When the mercapto group forms a salt, the counter ion can be a cation of an alkali, alkaline earth, or heavy metal ion (e.g., $Li^+$, $Na^+$, $K^+$, $Mg^{2+}$, $Ag^+$, or $Zn^{2+}$), an ammonium ion, a heterocyclic group containing a quaternary nitrogen atom, or a phosphonium ion.

The mercapto group serving as the adsorptive group may tautomerize to become a thione group.

Examples of the thione group serving as the adsorptive group include chain-like or cyclic thioamido, thioureido, thiourethane, and dithiocarbamate groups.

The heterocyclic group containing at least one atom selected from nitrogen, sulfur, selenium and tellurium atoms and serving as the adsorptive group is a nitrogen-containing heterocyclic group having, as the partial structure of the heterocyclic ring, an —NH— group that can form imino silver (>NAg), or a heterocyclic group having, as the partial structure of the heterocyclic ring, an —S—, —Se—, —Te—, or ═N— group that can bind to a silver ion via a coordinate bond. Examples of the former group include benztriazole, triazole, indazole, pyrazole, tetrazole, benzimidazole, imidazole, and purine groups, whereas examples of the latter group include thiophene, thiazole, oxazole, benzthiophene, benzthiazole, benzoxazole, thiadiazole, oxadiazole, triazine, selenoazole, benzoselenoazole, tellurazole, and benzotellurazole groups.

Examples of the sulfide and disulfide groups serving as the adsorptive group include all the groups having a partial structure of —S— or —S—S—.

The cationic group serving as the adsorptive group means a group containing a quaternary nitrogen atom, and specifically, is an ammonio group or a group having a nitrogen-containing heterocyclic group with a quaternary nitrogen atom. Examples of the nitrogen-containing heterocyclic group with a quaternary nitrogen atom include pyridinio, quinolinio, isoquinolinio, and imidazolio groups.

The ethynyl group serving as the adsorptive group means a —C≡CH group, and the hydrogen atom may be substituted.

The adsorptive group may have one or more substituents.

Other typical examples of the adsorptive group include those described on pp. 4 to 7 of JP-A No. 11-95355.

The adsorptive group represented by A in formula (I) is preferably a mercapto-substituted, heterocyclic group (e.g., a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazolium-3-thiolate group, a 2,4-dimercaptopyrimidine group, a 2,4-dimercaptotriazine group, a 3,5-dimercapto-1,2,4-triazole group, or a 2,5-dimercapto-1,3-thiazole group), or a nitrogen-containing heterocyclic group having, as the partial structure of the heterocyclic group, an —NH— group which can form imino silver (>NAg) (e.g., a benzotriazole group, a benzimidazole group, or an indazole group), and more preferably a 2-mercaptobenzimidazole group or a 3,5-dimercapto-1,2,4-triazole group.

In Formula (I), W represents a bivalent connecting group. The bivalent connecting group can be any group which does not adversely affect photographic properties. Examples thereof include bivalent connecting groups including a carbon, hydrogen, oxygen, nitrogen, or sulfur atom, or a combination of two or more of these. Specific examples thereof include alkylene groups having 1 to 20 carbon atoms (e.g., methylene, ethylene, trimethylene, tetramethylene, and hexamethylene groups), alkenylene group having 2 to 20 carbon atoms, alkynylene group having 2 to 20 carbon atoms, arylene group having 6 to 20 carbon atoms (e.g., phenylene and naphthylene groups), —CO—, —$SO_2$—, —O—, —S—, —$NR_1$—, and combinations of two or more of these connecting groups. $R_1$ represents a hydrogen atom, or an alkyl, heterocyclic, or aryl group.

The connecting group represented by W may be substituted with any substituent(s).

In Formula (I), the reductive group represented by B represents a group that can reduce silver ions, and examples thereof include a formyl group, an amino group, a triple bond-containing group such as an acetylene or propargyl group, a mercapto group, and a residue obtained by removing a hydrogen atom from any one of hydroxylamines, hydroxamic acids, hydroxyureas, hydroxyurethanes, hydroxysemicarbazides, reductones (including reductone derivatives), anilines, phenols (including chroman-6-ols, 2,3-dihydrobenzofuran-5-ols, aminophenols, sulfonamidophenols, and polyphenols such as hydroquinones, catechols, resorcinols, benzenetriols, and bisphenols), acylhydrazines, carbamoylhydrazines, and 3-pyrazolidones. These groups may also be substituted with any substituent group(s).

The oxidation potential of the reductive group represented by B in Formula (I) can be measured by a measuring method described in "Denkikagaku Sokuteihou", written by Akira Fujishima, pages 150 to 208, and published by Gihoudo Shuppan or The Chemical Society of Japan, "Zikken Kagakukouza", 4th ed., vol. 9, pages 282 to 344, and published by Maruzen. For example, a method of rotating disc voltammetry can be used. In the method, a sample is dissolved in a solution including methanol having a pH value of 6.5 and a Britton-Robinson buffer at a volume ratio of 10%:90% and nitrogen gas is introduced into the resultant solution for 10 minutes. Thereafter, a voltamograph can be obtained at a rotational speed of 1000 rpm, a sweep rate of 20 mV/second and 25° C. by using a rotating disc electrode (RDE) made of glassy carbon and serving as a working electrode, a platinum electrode serving as a counter electrode and a saturated calomel electrode serving as a reference electrode. The half-wave potential (E1/2) can be calculated from the voltamograph.

The reductive group represented by B in the invention preferably has an oxidation potential, measured by the method described above, in the range of about −0.3 V to about 1.0 V, more preferably about −0.1 V to about 0.8 V, and still more preferably about 0 V to about 0.7 V.

In Formula (I), the reductive group represented by B is preferably a residue obtained by removing one hydrogen atom from one of hydroxylamines, hydroxamic acids, hydroxyureas, hydroxysemicarbazides, reductones, phenols, acylhydrazines, carbamoylhydrazides, and 3-pyrazolidones.

The compound represented by Formula (I) of the invention may contain a ballast group or a polymer chain commonly included in immobile photographic additives such as couplers. Examples of the polymer include those described in JP-A No. 1-100530.

The compound represented by Formula (I) in the invention may be a bis- or tris-compound. The molecular weight of the compound represented by Formula (I) in the invention is preferably in the range of 100 to 10,000, more preferably 120 to 1,000, and still more preferably 150 to 500.

Examples of the compound represented by Formula (I) in the invention will be shown below, but the invention is not restricted by these examples.

(1)

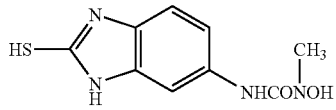

(2)

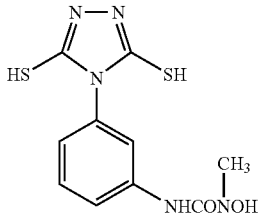

(3)

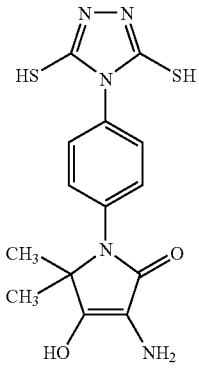

-continued (4)

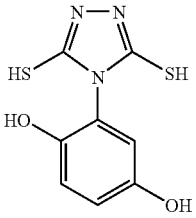

(5)

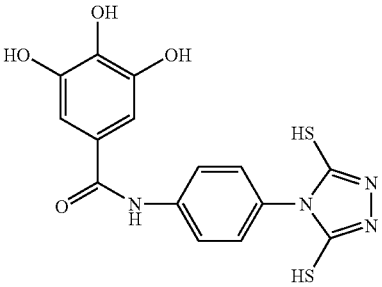

(6)

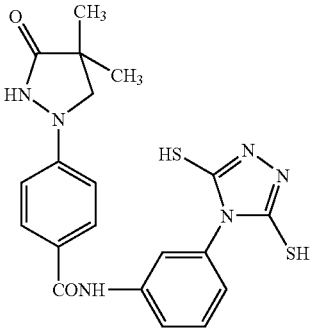

(7)

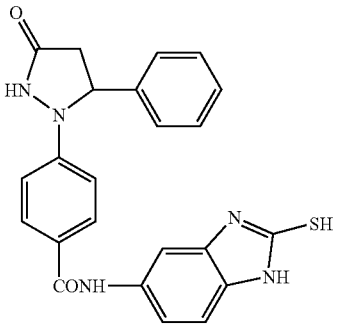

(8)

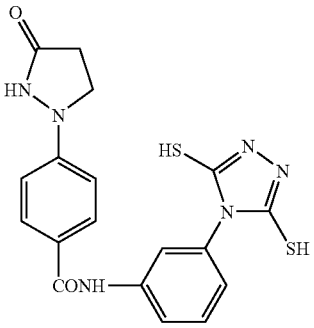

-continued (9)

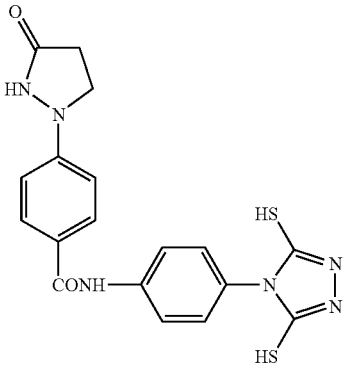

(10)

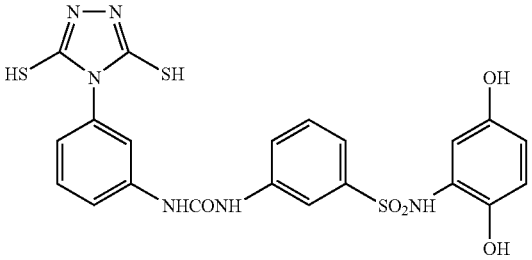

(11)

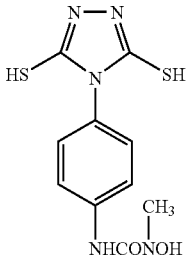

(12)

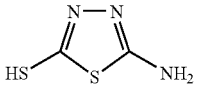

(13)

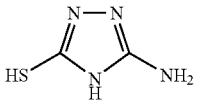

Further, the compound having an adsorptive group and a reductive group in the invention is also preferably any of exemplified compounds 1 to 30 and 1"-1 to 1"-77 shown in EP-A No. 1308776A2, pages 73 to 87.

These compounds can be easily synthesized by known methods. One compound of Formula (I) in the invention can be used alone, but it is preferred to use two or more kinds of such compounds together. When two or more kinds of the compounds are used together, these may be included in the same layer or different layers. Moreover, adding methods thereof may be different from each other.

The compound represented by Formula (I) in the invention is preferably included in the silver halide image-forming layer. To attain this, the compound is preferably added to a silver halide emulsion which is being prepared. If added during emulsion preparation, the compound may be added any time in the process, for example, in a step of forming silver halide grains, before initiation of a desalting step, during the desalting step, before initiation of chemical aging, during the chemical aging, or during a step before preparing a final emulsion. Moreover, it may be added multiple times in these steps. As described above, the compound is preferably contained in the image-forming layer, but may be included in a coating liquid for at least one of a protective layer and an intermediate layer which are adjacent to the image-forming layer as well as in a coating liquid for image-forming layer, and may be diffused during coating.

The addition amount of the compound greatly depends on the addition method and the type of the compound added, but is generally $1\times10^{-6}$ mole to 1 mole, preferably $1\times10^{-5}$ mole to $5\times10^{-1}$ mole, and more preferably $1\times10^{4}$ mole to $1\times10^{-1}$ mole with respect to 1 mole of photosensitive silver halide.

The compound represented by Formula (I) in the invention may be dissolved in water, a water-soluble solvent such as methanol or ethanol, or a mixture of these solvents in adding it to the coating liquid. At this time, the pH of the solution may be adjusted properly with an acid or base, and/or a surfactant may be added to the solution. Alternatively, the compound may be added as an emulsified dispersion obtained by emulsifying and dispersing the compound in a high-boiling point organic solvent. Yet alternatively, it may be added as a solid dispersion.

11) Combined Use of Multiple Types of Silver Halides

The photosensitive material for use in the invention may include one photosensitive silver halide emulsion or two or more photosensitive silver halide emulsions (e.g., those having different average particle sizes, halogen compositions, and/or crystal habits, or those which are chemically sensitized under different conditions). Combined use of multiple photosensitive silver halides having different sensitivities allows adjustment of color tone. Descriptions concerning the combined use are found in JP-A Nos. 57-119341, 53-106125, 47-3929, 48-55730, 46-5187, 50-73627, and 57-150841. The difference in sensitivity between the respective emulsions is preferably 0.2 log E or more.

12) Coating Amount

The amount of the photosensitive silver halide(s) added is such that the amount of coated silver per $m^2$ of a photosensitive material is preferably 0.03 $g/m^2$ to 0.6 $g/m^2$, more preferably 0.05 $g/m^2$ to 0.4 $g/m^2$, most preferably 0.07 $g/m^2$ to 0.3 $g/m^2$. Moreover, the amount of photosensitive silver halide is preferably 0.01 mole to 0.5 mole, more preferably 0.02 mole to 0.3 mole, and still more preferably 0.03 mole to 0.2 mole with respect to 1 mole of organic silver salt.

13) Mixing of Photosensitive Silver Halide and Organic Silver Salt

The photosensitive silver halide and the organic silver salt separately prepared may be mixed with, for example, a high speed stirrer, a ball mill, a sand mill, a colloid mill, a vibrating mill, or a homogenizer. Alternatively, the photosensitive silver halide already prepared may be added to a system in which an organic silver salt is being prepared any time in the process for preparing the organic silver salt. However, a mixing method of these and conditions thereof are not particularly limited, as long as the effects of the invention can be sufficiently obtained. For control of photographic properties, it is preferable to mix two or more aqueous organic silver salt dispersions and two or more aqueous photosensitive silver salt dispersions.

14) Mixing Silver Halide with Coating Liquid

In the invention, the silver halide is preferably added to a coating liquid for image-forming layer for a period starting at 180 minutes before coating and ending at 10 seconds before the coating. However, there is no restriction on a mixing method and mixing conditions other than addition timing, as long as the effects of the invention can be sufficiently obtained. Specific examples of the mixing method include a method of mixing these in a tank so that the average residence time calculated from the flow rate of liquid added and the rate of liquid supplied to a coater is controlled to a desired value, and a method using a static mixer which is described in the eighth chapter of "Ekitai Kongo Gijutu" written by N. Hamby, M. F. Edwards and A. W. Nienow, translated by Koji Takahashi, and published by Nikkan Kogyo Shinbunsha in 1989.

Hydrophilic Polymer Having Vinyl Monomer Unit Containing a Quaternary Nitrogen Atom-containing Group or Nitrogen-containing Heterocyclic Group The hydrophilic polymer having a vinyl monomer unit containing having a quaternary nitrogen atom-containing group or a nitrogen-containing heterocyclic group for use in the invention will be described below.

A hydrophilic polymer means that the polymer can be soluble in water. The hydrophilic polymer preferably has a solubility of 1 mass % or more and more preferably 10 mass % or more in water.

In the hydrophilic polymer having a vinyl monomer unit containing a nitrogen-containing heterocyclic group, the vinyl monomer unit is preferably a repeating unit represented by Formula (N).

Formula (N)

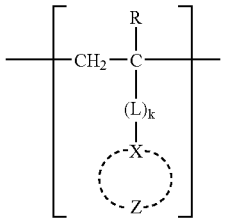

In the formula, R represents a hydrogen atom or an alkyl group, preferably a methyl, ethyl, n-butyl, n-amyl, or n-hexyl group, and more preferably a hydrogen atom or a methyl group. k denotes 0 or 1.

L represents a bivalent connecting group having 1 to 20 carbon atoms or a simple bond, and is preferably an alkylene group (e.g., a methylene, ethylene, trimethylene, or hexamethylene group), a phenylene group (e.g., an o-phenylene, p-phenylene, or m-phenylene group), an arylenealkylene group represented by the following Formula (wherein, $R_2$ represents an alkylene group having 1 to approximately 12 carbon atoms),

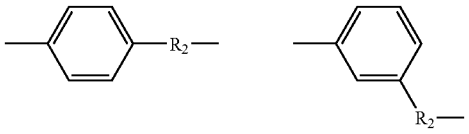

a —$CO_2$— group, a —$CO_2$—$R_3$— group (wherein, $R_3$ represents an alkylene, phenylene, or arylenealkylene group), a —CONH—$R_3$— group (wherein, $R_3$ is the same as that described above), or an acylamino group represented by the following Formula (wherein, $R_1$ and $R_3$ are the same as those described above).

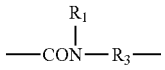

$R_1$, $R_2$ and $R_3$ are alkyl groups. $R_1$, $R_2$, and $R_3$ may bind to each other to form a ring.

L is more preferably one of the following bivalent groups,

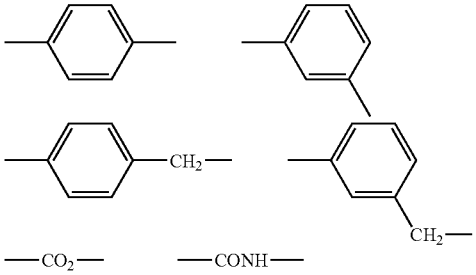

—$CH_2$—, —$CO_2$—$CH_2CH_2$—, —$CO_2$—$CH_2CH_2CH_2$—, —$CONHCH_2$—, —$CONHCH_2CH_2$—, or —$CONHCH_2CH_2CH_2$—.

X represents a nitrogen atom, or a "—CH—" or "—C═" group; Z represents a bivalent group containing at least one of nitrogen and carbon atoms; and at least one of X and Z contains a nitrogen atom.

The cyclic substituent containing X and Z represents a heterocyclic substituent containing a nitrogen atom having a carbon-nitrogen double bond, and is preferably an imidazole, triazole, pyrazole, pyridine, or pyrimidine ring shown below and more preferably an imidazole or pyridine ring.

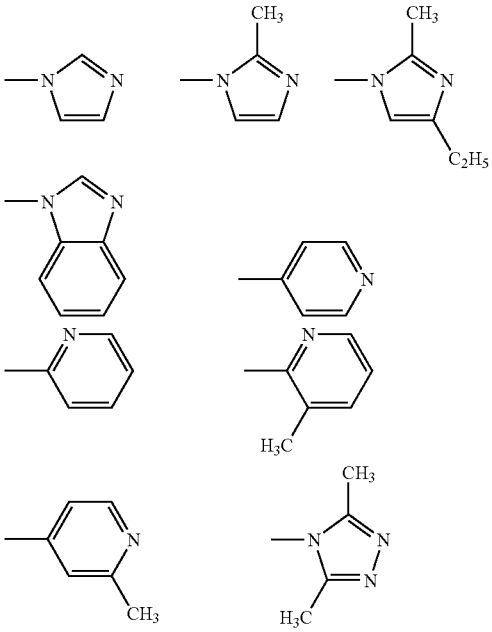

-continued

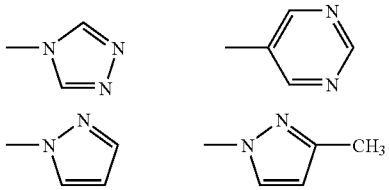

Typical examples of the polymer containing a vinyl monomer unit containing a nitrogen-containing heterocyclic group represented by Formula (N) include, but are not limited to, the following polymers including polymers described in U.S. Pat. Nos. 4,282,305, 4,115,124, and 3,148,061.

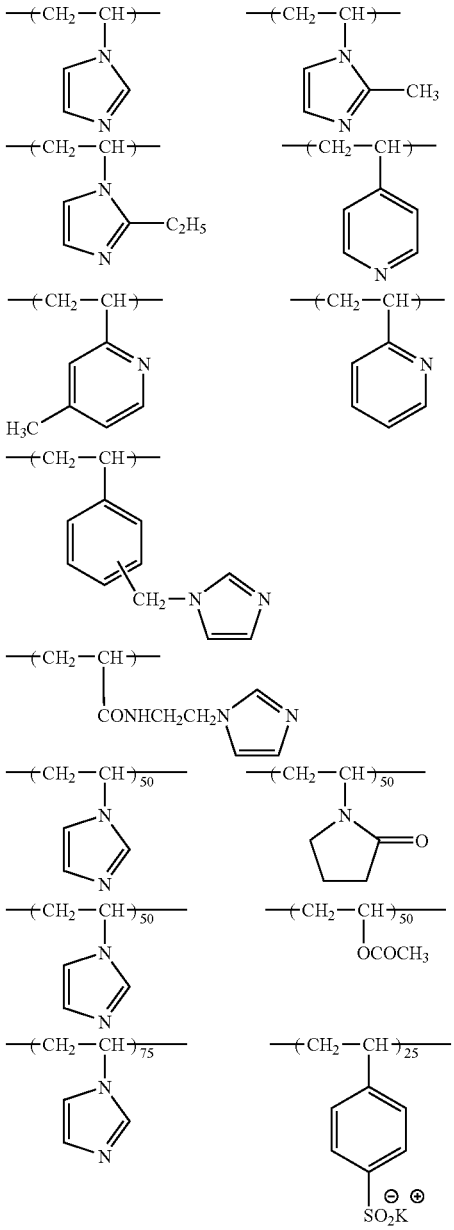

-continued

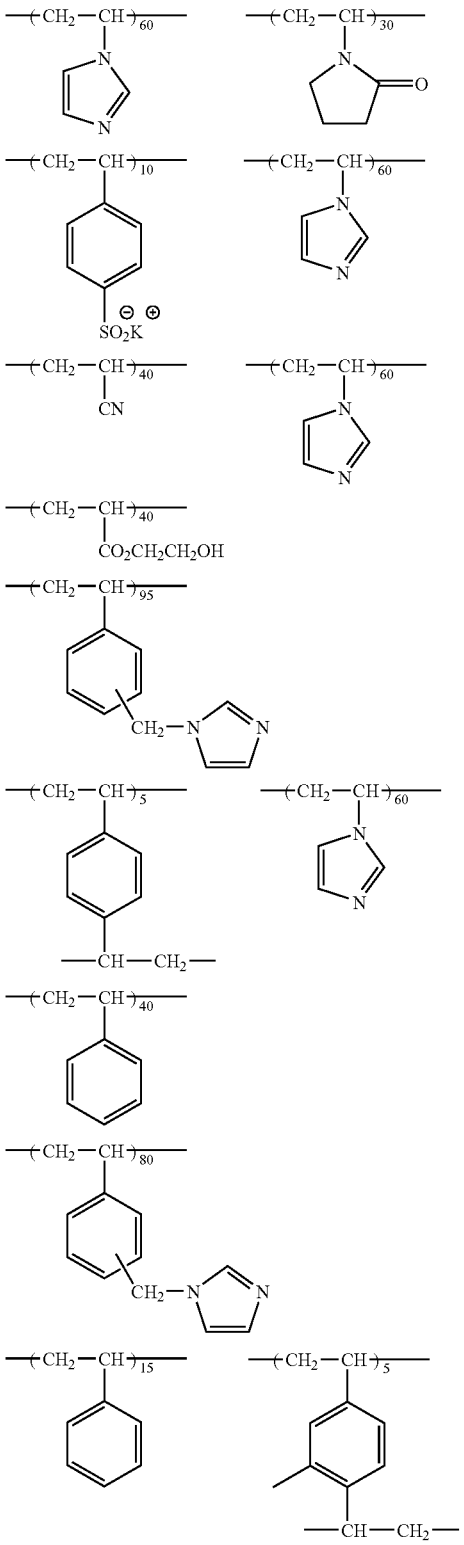

(number: mole %)

The vinyl monomer unit having a quaternary nitrogen atom is preferably a repeating unit represented by Formula (M).

Formula (M)

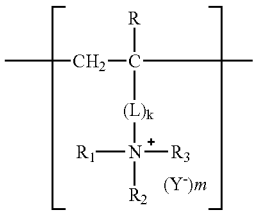

In the above formula, R represents a hydrogen atom or an alkyl group; L represents a bivalent connecting group or a simple bond; and $R_1$, $R_2$, and $R_3$ are substituted or unsubstituted alkyl groups. $Y^-$ represents an anionic atom or group. k denotes 0 or 1. m denotes the number of $Y^-$ needed for neutralizing the cationic charge in the molecule. If any one of $R_1$ to $R_3$ has an anionic charge neutralizing the ammonium cation, m denotes 0. $R_1$, $R_2$, and $R_3$ may bind to each other to form a ring.

In addition, the repeating unit represented by Formula (M) is preferably a repeating unit represented by the following Formula (NB).

Formula (NB)

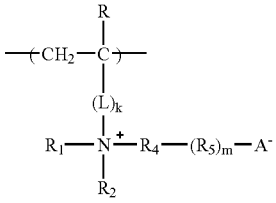

In the above formula, R, L, k, $R_1$, and $R_2$ are the same as those in Formula (M). $R_4$ and $R_5$ each represent a bivalent connecting group. m denotes 0 or 1. $A^-$ represents an anionic residue containing an anionic group selected from sulfonate, carboxylate, and phosphate groups.

$R_1$, $R_2$, and $R_3$ each preferably represent an unsubstituted alkyl group (e.g., a methyl, ethyl, n-propyl, n-butyl, n-amyl, n-hexyl group, n-nonyl group, n-decyl group, or n-dodecyl group), a substituted alkyl group (a methoxyethyl, 3-cyanopropyl, ethoxycarbonylethyl, acetoxyethyl, hydroxyethyl, or 2-butenyl), an unsubstituted aralkyl group (a benzyl, phenethyl, diphenylmethyl, or naphthylmethyl group), or a substituted aralkyl group (a 4-methylbenzyl, 4-isopropylbenzyl, 4-methoxybenzyl, 4-(4-methoxyphenyl)benzyl, or 3-chlorobenzyl group).

$R_4$ and $R_5$ each are preferably a bivalent group obtained by removing one hydrogen atom from $R_1$, $R_2$, or $R_3$.

$Y^-$ represents a monovalent anion. The anion is preferably a halide ion (e.g., a chloride or bromide ion), a sulfonate ion (e.g., a methanesulfonate or p-toluenesulfonate ion), a carboxylate ion (e.g., an acetate or propionate ion), a hydroxide ion, a monoalkyl sulfate ion (e.g., a monomethyl sulfate and monoethyl sulfate ion), $PF_6^-$, or $BF_4^-$. Among these, $Y^-$ is more preferably a chloride, sulfonate, carboxylate, or p-toluenesulfonate ion.

Examples of the cyclic structures formed by binding $R_1$, $R_2$, and $R_3$ and the nitrogen atom to each other include the following:

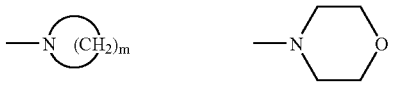

In the above groups, m represents an integer of 4 to 12.

The group of Formula (M) is also preferably a heterocyclic ring containing, as the component thereof, a quaternary nitrogen atom with a nitrogen-carbon double bond. Examples thereof include imidazolium salts such as the following compounds:

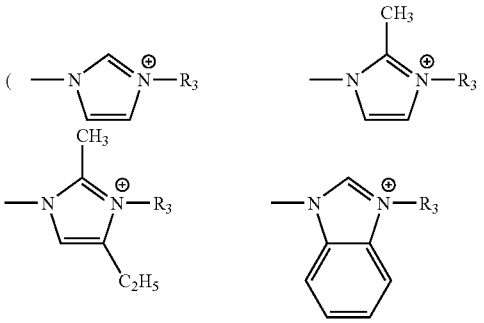

triazolium salts such as the following compound:

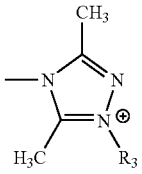

and pyridinium salts such as the following compounds.

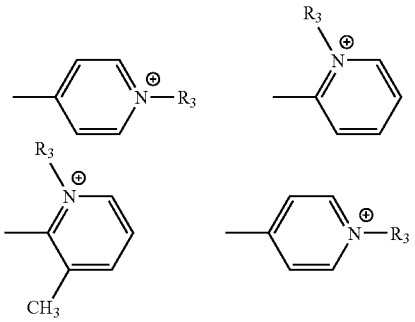

Among these, the group of Formula (M) is preferably a imidazolium or pyridinium salt. $R_3$ is the same as that in Formula (M) and is preferably a methyl, ethyl, or benzyl group.

Typical examples of the polymer containing a vinyl monomer unit having a quaternary ammonio group represented by Formula (M) include the followings:

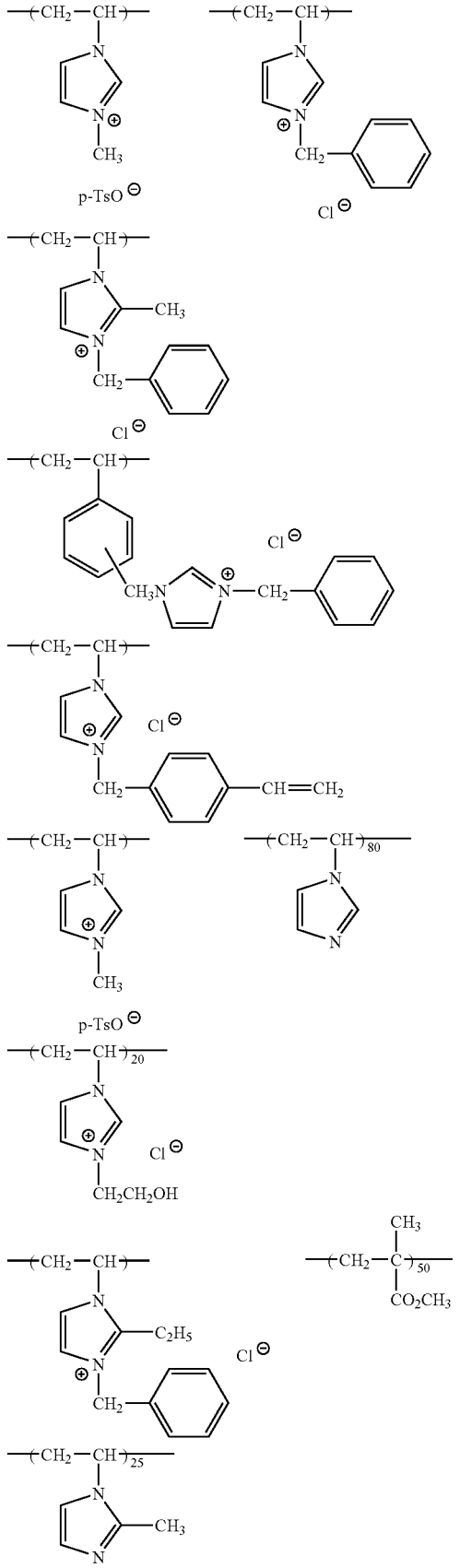

-continued
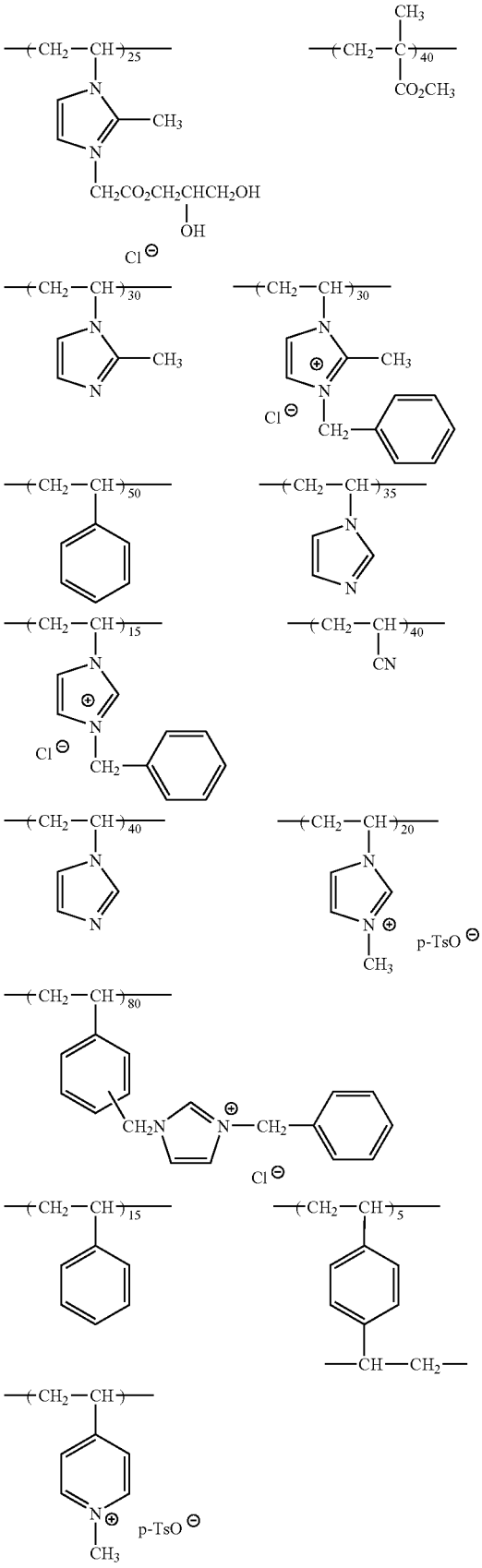
-continued
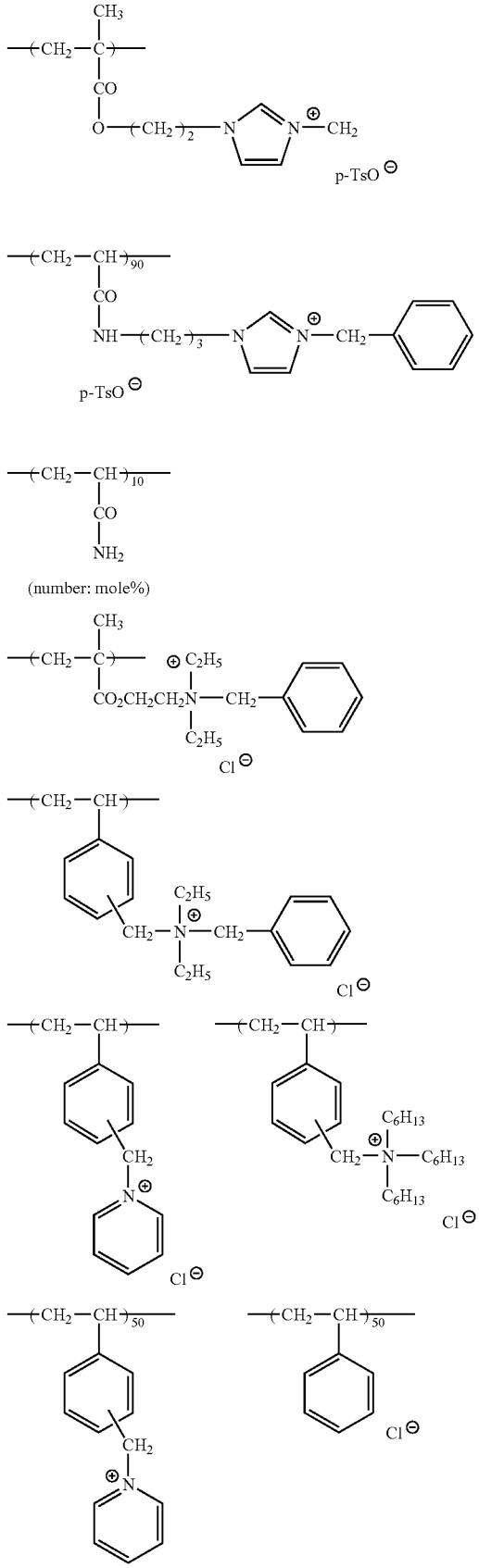

-continued
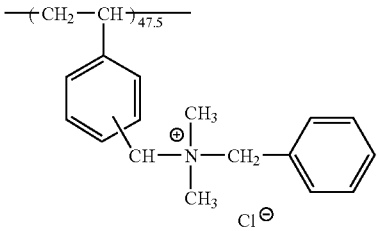
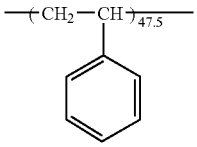
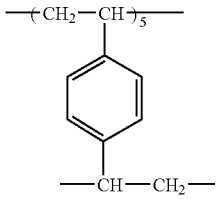
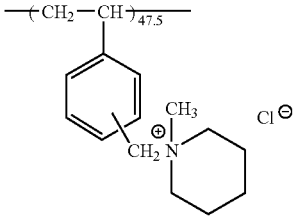
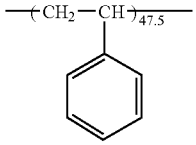
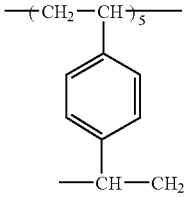
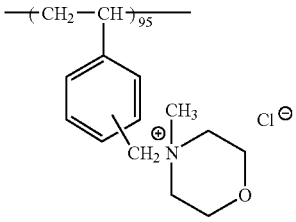
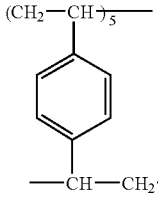
(number: mole%)
p-TsO represents $CH_3-C_6H_4-SO_3^-$.
Typical examples of the group of Formula (NB) preferably used in the invention are shown below, but the invention is not limited by these examples.
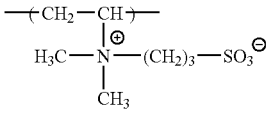
-continued
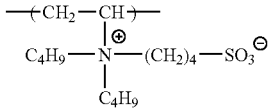
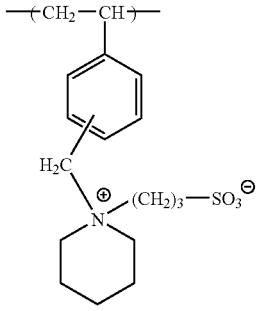
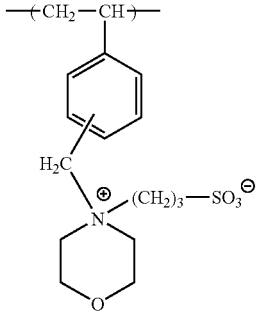
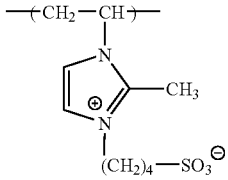
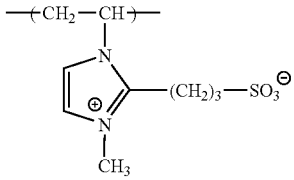
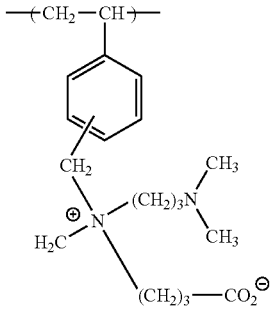
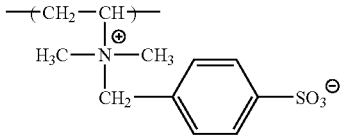

-continued

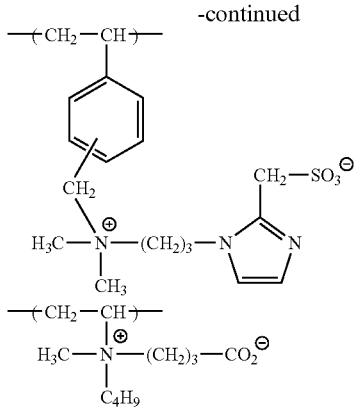

Other examples of the hydrophilic polymer for use include vinylpyridine polymers disclosed in U.S. Pat. Nos. 2,548,564, 2,484,430, 3,148,061, and 3,756,814; hydrophilic polymer crosslinkable, for example, with gelatin and disclosed in U.S. Pat. Nos. 3,625,694, 3,859,096, and 4,128,538, and British Patent No. 1,277,453; aqueous sol-type hydrophilic polymers disclosed in U.S. Pat. Nos. 3,958,995, 2,721,852, and 2,798,063, and JP-A Nos. 54-115228, 54-145529, and 54-126027; water-insoluble hydrophilic polymers disclosed in U.S. Pat. No. 3,898,088; reactive hydrophilic polymers that can covalently bind to a dye disclosed in U.S. Pat. No. 4,168,976 (JP-A No. 54-137333); hydrophilic polymers disclosed in U.S. Pat. Nos. 3,709,690, 3,788,855, 3,642,482, 3,488,706, 3,557,066, 3,271,147, and 3,271,148, JP-A Nos. 50-71332, 53-30328, 52-155528, 53-125, and 53-1024; and hydrophilic polymers described in U.S. Pat. Nos. 2,675,316 and 2,882,156.

The molecular weight of the hydrophilic polymer for use in the invention is preferably 1,000 to 1,000,000, and more preferably 10,000 to 200,000.

The hydrophilic polymer is contained in combination with a binder, i.e., a hydrophilic colloid in a system containing a water-soluble dye. Typical examples of the hydrophilic colloid include natural materials such as proteins (gelatin, and gelatin derivatives), cellulose derivatives, and polysaccharides (starch, and gum arabic); and synthetic polymers such as polyvinyl alcohol, polyvinylpyrrolidone, and polyacrylamide. Among these, the hydrophilic polymer is preferably gelatin or polyvinyl alcohol.

The blending ratio of the hydrophilic polymer to the hydrophilic colloid and the coating amount of the hydrophilic polymer can be determined easily by a person skilled in the art according to the amount of the water-soluble dye to be fixed and the kind and composition of the hydrophilic polymer, but the mass ratio of the hydrophilic polymer to the hydrophilic colloid is preferably 20/80 to 80/20, and the coating amount of the hydrophilic polymer is generally approximately 0.02 to approximately 5 g/m$^2$ and preferably 0.1 to 2 g/m$^2$.

Explanations on Binder

The binder of the organic silver salt-containing layer in the invention can be any one, and is preferably transparent or translucent and is generally colorless. Examples thereof include natural resins, polymers and copolymers, synthetic resins, polymers and copolymers, other film-forming materials, such as rubbers, cellulose acetates, cellulose acetate butyrates, polyvinyl chlorides, polymethacrylic acids, styrene-maleic anhydride copolymers, styrene-acrylonitrile copolymers, styrene-butadiene copolymers, polyvinyl acetals (such as polyvinyl formal or polyvinyl butyral), polyesters, polyurethanes, phenoxy resins, polyvinylidene chlorides, polyepoxides, polycarbonates, polyvinyl acetates, polyolefins, cellulose esters and polyamides. The binder may be used with water, or an organic solvent or used as an emulsion to form a coating liquid.

In the invention, the glass transition temperature (Tg) of the binder which can be contained in the image-forming layer is generally in the range of from 0° C. to 80° C., preferably from 10° C. to 70° C., and more preferably from 15° C. to 60° C. The binder may be referred to as a high Tg polymer hereinafter.

In this specification, Tg is calculated by the following equation:

$$1/Tg=\Sigma(Xi/Tgi)$$

In the equation, it is assumed that the polymer is obtained by copolymerizing n monomer components. In other words, i is an integer of 1 to n. Xi represents the mass fraction of an i-th monomer ($\Sigma Xi=1$), and Tgi represents the glass transition temperature (absolute temperature) of a homopolymer of the i-th monomer. $\Sigma$ indicates the sum of values respectively corresponding to i of 1 to n. The glass transition temperature (Tgi) of a homopolymer of each monomer is obtained from "Polymer Handbook (3rd edition)" (J. Brandrup, E. H. Immergut (Wiley-Interscience, 1989)).

Two or more binders may be used together, if necessary. For example, a polymer having Tg of 20° C. or more and that having Tg of less than 20° C. can be used together. In the case where two or more kinds of polymers having different Tgs may be blended, it is preferred that the mass-averaged Tg is within the range mentioned above.

In the invention, it is preferred that the image-forming layer is formed by applying a coating liquid containing water in an amount of 30% by mass or more with respect to the total amount of solvent(s) and drying the resultant coating.

In the case where the image-forming layer is formed by first applying a coating liquid containing water in an amount of 30% by mass or more with respect to the total amount of solvent(s) and drying the resultant coating, and in the case where the binder of the image-forming layer is soluble or dispersible in an aqueous solvent (water solvent), particularly in the case where a polymer latex having an equilibrium moisture content of 2% by mass or lower at 25° C. and 60% RH is used as the binder, improved performance can be obtained. Most preferably, the ionic conductivity of the binder is adjusted to 2.5 mS/cm or lower. To attain this, a process for purifying a prepared polymer with a separation functional membrane can be conducted.

The aqueous solvent in which the polymer is soluble or dispersible, as referred herein, is water or a mixture of water and 70% by mass or less of a water-miscible organic solvent. The water-miscible organic solvent can be, for example, alcohol such as methyl alcohol, ethyl alcohol, or propyl alcohol; cellosolve such as methyl cellosolve, ethyl cellosolve, or butyl cellosolve; or ethyl acetate, or dimethylformamide.

In this specification, a system in which the polymer is not thermodynamically dissolved but is dispersed is also called an aqueous solvent.

The term "equilibrium moisture content at 25° C. and 60% RH" as referred herein can be expressed as follows:

$$\text{Equilibrium moisture content at 25° C. and 60\% RH}=[(W1-W0)/W0]\times 100\ (\%\text{ by mass})$$

wherein W1 is the mass of a polymer in moisture-controlled equilibrium in an atmosphere of 25° C. and 60% RH, and W0 is the bone dry mass of the polymer at 25° C.

For the definition of the term and a method of measuring moisture content, reference can be made to Polymer Engineering Course Series 14, "Testing methods for polymeric materials" (The Society of Polymer Science, Japan, published by Chijin Shokan).

The equilibrium moisture content at 25° C. and 60% RH is preferably 2% by mass or lower, more preferably 0.01% by mass to 1.5% by mass, and still more preferably 0.02% by mass to 1% by mass.

The equilibrium moisture content at 25° C. and 60% RH is preferably 2% by mass or lower, more preferably 0.01% by mass to 1.5% by mass, and still more preferably 0.02% by mass to 1% by mass.

The binder used in the invention is particularly preferably a polymer dispersible in the aqueous solvent. Examples of a system in which the polymer is dispersed include a latex in which water-insoluble fine particles of hydrophobic polymer are dispersed, or a system in which polymer molecules or micelles formed by the polymer molecules are dispersed. Among these, a latex in which polymer particles are dispersed is preferable. The average size of the dispersed particles is generally in the range of from 1 nm to 50,000 nm, preferably from 5 nm to 1,000 nm, more preferably from 10 nm to 500 nm, and still more preferably from 50 nm to 200 nm. There is no particular limitation on the particle size distribution of the dispersed particles, and the dispersed particles may have a broad distribution or a monodisperse particle size distribution. From the viewpoint of controlling the physical properties of a coating liquid, mixing two or more types of particles each having a monodisperse particle distribution is preferable.

In the invention, the polymer dispersible in the aqueous solvent is preferably a hydrophobic polymer such as acrylic polymer, polyester, rubber (e.g., an SBR resin), polyurethane, polyvinyl chloride, polyvinyl acetate, polyvinylidene chloride, or polyolefin. The polymer may be linear, branched or cross-linked, and may be a homopolymer obtained by polymerizing one kind of monomer, or a copolymer obtained by polymerizing two or more kinds of monomers. In the case of a copolymer, it may be a random copolymer or a block copolymer. The number-average molecular weight of the polymer is in the range of from 5,000 to 1,000,000, and preferably from 10,000 to 200,000. Those having too small molecular weight result in an image-forming layer having an insufficient mechanical strength, whereas those having too large molecular weight have a poor film-forming property. Further, the binder is particularly preferably a cross-linkable polymer latex.

-Specific Examples of Latex-

Specific examples of the polymer latex are given below, and are expressed by starting monomers. The numerical values in parentheses represent the mass percentages of the left monomers. The molecular weight is the number average molecular weight. Latexes whose starting monomers include a polyfunctional monomer form a cross-linked structure, and the concept of molecular weight is not applicable thereto. Hence, they are denoted as "cross-linking", and the molecular weight is not shown. Tg represents the glass transition temperature of the polymer.

P-1; latex of MMA(70)-EA(27)-MAA(3) (molecular weight of 37,000, and Tg of 61° C.)

P-2; latex of MMA(70)-2EHA(20)-St(5)-AA(5) (molecular weight of 40,000, and Tg of 59° C.)

P-3; latex of St(50)-Bu(47)-MAA(3) (cross-linking, and Tg of −17° C.)

P-4; latex of St(68)-Bu(29)-AA(3) (cross-linking, and Tg of 17° C.)

P-5; latex of St(71)-Bu(26)-AA(3) (cross-linking, and Tg of 24° C.)

P-6; latex of St(70)-Bu(27)-IA(3) (cross-linking)

P-7; latex of St(75)-Bu(24)-AA(1) (cross-linking, and Tg of 29° C.)

P-8; latex of St(60)-Bu(35)-DVB(3)-MAA(2) (cross-linking)

P-9; latex of St(70)-Bu(25)-DVB(2)-AA(3) (cross-linking)

P-10; latex of VC(50)-MMA(20)-EA(20)-AN(5)-AA(5) (molecular weight of 80,000)

P-11; latex of VDC(85)-MMA(5)-EA(5)-MAA(5) (molecular weight of 67,000)

P-12; latex of Et(90)-MAA(10) (molecular weight of 12,000)

P-13; latex of St(70)-2EHA(27)-AA(3) (molecular weight of 130,000, and Tg of 43° C.)

P-14; latex of MMA(63)-EA(35)-AA(2) (molecular weight of 33,000, and Tg of 47° C.)

P-15; latex of St(70.5)-Bu(26.5)-AA(3) (cross-linking, and Tg of 23° C.)

P-16; latex of St(69.5)-Bu(27.5)-AA(3) (cross-linking, and Tg of 20.5° C.)

In the above structures, MMA represents methyl metacrylate, EA represents ethyl acrylate, MAA represents methacrylic acid, 2EHA represents 2-ethylhexyl acrylate, St represents styrene, Bu represents butadiene, AA represents acrylic acid, DVB represents divinylbenzene, VC represents vinyl chloride, AN represents acrylonitrile, VDC represents vinylidene chloride, Et represents ethylene, and IA represents itaconic acid.

The above polymer latexes are available commercially. Specifically, the commercial products are as follows: those of acrylic polymers include CEVIAN A-4635, 4718, and 4601 (manufactured by Daicel Chemical Industries, Ltd.), and NIPOL Lx811, 814, 821, 820, and 857 (manufactured by Zeon Corporation); those of polyesters include FINETEX ES 650, 611, 675, and 850 (manufactured by Dainippon Ink and Chemicals), and WD-SIZE, and WMS (manufactured by Eastman Chemical); those of polyurethanes include HYDRAN AP10, 20, 30, and 40 (manufactured by Dainippon Ink and Chemicals); those of rubbers include LACSTAR 7310K, 3307B, 4700H, and 7132C (manufactured by Dainippon Ink and Chemicals), and NIPOL Lx416, 410, 438C, and 2507 (manufactured by Zeon Corporation); those of polyvinyl chlorides include G351 and G576 (manufactured by Zeon Corporation); those of polyvinylidene chlorides include L502 and L513 (manufactured by Asahi Kasei Corp.); and those of polyolefins include CHEMIPEARL S120 and SA100 (manufactured by Mitsui Chemicals, Inc.).

One of these polymer latexes may be used alone, or two or more of them may be used together.

<Preferable Latex>

The polymer latex for use in the invention is preferably a latex of styrene-butadiene copolymer. The mass ratio of the styrene monomer unit to the butadiene monomer unit of the styrene-butadiene copolymer is preferably in the range of from 40:60 to 95:5. Further, the styrene and butadiene monomer units preferably account for 60 to 99% by mass with respect to all the monomers of the copolymer. Further, the monomers of the polymer latex used in the invention preferably contain acrylic acid or methacrylic acid in the range from 1 to 6% by mass with respect to the sum of styrene and butadiene, and more preferably from 2 to 5% by mass.

The monomers of the polymer latex in the invention preferably contain acrylic acid. The preferable range of the molecular weight of the polymer latex is similar to that described above.

Typical examples of the styrene-butadiene-acid copolymer latex for use in the invention include the above-exemplified polymers P-3 to P-8 and P-15; and commercially available LACSTAR-3307B, 7132C, and NIPOL Lx416.

The organic silver salt-containing layer of the photothermographic material of the invention may contain a hydrophilic polymer such as gelatin, polyvinyl alcohol, methyl cellulose, hydroxypropyl cellulose, or carboxymethyl cellulose, if necessary. The amount of the hydrophilic polymer is generally 30% by mass or less, and preferably 20% by mass or less with respect to the total mass of the binder(s) contained in the image-forming layer.

The organic silver salt-containing layer in the invention, namely image-forming layer, is preferably formed using the polymer latex as its binder. As for the amount of the binder of the organic silver salt-containing layer, the mass ratio of all the binders to the organic silver salt is generally in the range of from 1/10 to 10/1, preferably from 1/3 to 5/1, and more preferably from 1/1 to 3/1.

Such an organic silver salt-containing layer is usually a photosensitive layer (image-forming layer) containing a photosensitive silver salt, i.e., a photosensitive silver halide, and in such a case, the mass ratio of all the binders to the silver halide is generally in the range of 400 to 5 and preferably in the range of 200 to 10.

The total amount of the binder(s) in the image-forming layer in the invention is preferably in the range from 0.2 $g/m^2$ to 30 $g/m^2$, more preferably from 1 $g/m^2$ to 15 $g/m^2$, and even more preferably from 2 $g/m^2$ to 10 $g/m^2$. The image-forming layer in the invention may contain a cross-linking agent for cross-linking the binder, and/or a surfactant to improve coating properties.

Preferable Solvent for Coating Liquid

In the invention, the solvent for use in the coating liquid for the image-forming layer of the photosensitive material (hereinafter, both a solvent and a dispersion medium are called solvents for simplicity) is preferably an aqueous solvent containing water in an amount of 30 mass % or more. In addition to water, the aqueous solvent may contain any water-miscible organic solvent such as methyl alcohol, ethyl alcohol, isopropyl alcohol, methyl cellosolve, ethyl cellosolve, dimethylformamide, or ethyl acetate. The water content of the solvent for coating liquid is preferably 50 mass % or more and more preferably 70 mass % or more. Typical examples of the solvent composition include water, a mixture of water and methyl alcohol at a mass ratio of 90/10, a mixture of water and methyl alcohol at a mass ratio of 70/30, a mixture of water, methyl alcohol and dimethylformamide at a mass ratio of 80/15/5, a mixture of water, methyl alcohol and ethyl cellosolve at a mass ratio of 85/10/5, and a mixture of water, methyl alcohol and isopropyl alcohol at a mass ratio of 85/10/5.

Development Accelerator

The photothermographic material of the invention preferably contains a development accelerator, and typical examples thereof include sulfonamidophenol compounds described in JP-A Nos. 2000-267222 and 2000-330234 (Formula (A)); hindered phenol compounds represented by Formula (II) described in JP-A No. 2001-92075; hydrazine compounds described in JP-A Nos. 10-62895 and 11-15116 (Formula (I)), and represented by Formula (D) described in JP-A No. 2002-156727, and Formula (1) described in JP-A No. 2002-278017; and phenol and naphthol compounds represented by Formula (2) described in JP-A No. 2001-264929. The development accelerator is used in an amount in the range of 0.1 to 20 mole %, preferably 0.5 to 10 mole %, and more preferably 1 to 5 mole % with respect to the reducer. The development accelerator may be introduced into the photosensitive material in the same manner as the reducer, but is particularly preferably added as a solid dispersion or an emulsified dispersion. If added as an emulsified dispersion, it is added preferably as an emulsified dispersion including a high-boiling solvent, which is solid at room temperature, and a low-boiling supplementary solvent, or as a so-called oilless emulsified dispersion that includes no high-boiling solvent.

In the invention, among the above-described compounds, the development accelerator is preferably a hydrazine compound represented by Formula (D) described in JP-A No. 2002-156727 and/or a phenol or naphthol compound represented by Formula (2) described in JP-A No. 2001-264929.

The development accelerator in the invention is more preferably a compound represented by the following Formula (A-1) or (A-2).

$$Q_1—NHNH—Q_2 \qquad \text{Formula (A-1)}$$

In the formula, $Q_1$ represents an aromatic or heterocyclic group that binds to —NHNH—$Q_2$ via a carbon atom; and $Q_2$ represents a carbamoyl, acyl, alkoxycarbonyl, aryloxycarbonyl, sulfonyl, or sulfamoyl group.

In Formula (A-1), the aromatic group or heterocyclic group represented by $Q_1$ is preferably a five- to seven-membered unsaturated ring. Typical examples thereof include benzene, pyridine, pyrazine, pyrimidine, pyridazine, 1,2,4-triazine, 1,3,5-triazine, pyrrole, imidazole, pyrazole, 1,2,3-triazole, 1,2,4-triazole, tetrazole, 1,3,4-thiadiazole, 1,2,4-thiadiazole, 1,2,5-thiadiazole, 1,3,4-oxadiazole, 1,2,4-oxadiazole, 1,2,5-oxadiazole, thiazole, oxazole, isothiazole, isoxazole, and thiophene rings. The aromatic or heterocyclic group is also preferably a fused ring in which at least two of these rings are fused.

The ring may have one or more substituents. When the ring has two or more substituents, these substituents may be the same as or different from each other. Examples of the substituent include halogen atoms, and alkyl, aryl, carbonamide, alkylsulfonamide, arylsulfonamide, alkoxy, aryloxy, aklylthio, arylthio, carbamoyl, sulfamoyl, cyano, alkylsulfonyl, arylsulfonyl, alkoxycarbonyl, aryloxycarbonyl, and acyl groups. These substituents may have additional substituents, if possible. Typical examples of the substituent of the above-exemplified substituent include halogen atoms, and alkyl, aryl, carbonamide, alkylsulfonamide, arylsulfonamide, alkoxy, aryloxy, aklylthio, arylthio, acyl, alkoxycarbonyl, aryloxycarbonyl, carbamoyl, cyano, sulfamoyl, alkylsulfonyl, arylsulfonyl, and acyloxy groups.

The carbamoyl group represented by $Q_2$ preferably has 1 to 50 carbon atoms and more preferably 6 to 40 carbon atoms. Example thereof include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl groups.

The acyl group represented by $Q_2$ preferably has 1 to 50 carbon atoms and more preferably 6 to 40 carbon atoms. Examples thereof include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl groups. The alkoxycarbonyl group represented by $Q_2$ preferably has 2 to 50 carbon atoms and more preferably 6 to 40 carbon atoms, and examples thereof include methoxycarbonyl, ethoxycarbonyl, isobutyloxycarbonyl, cyclohexyloxycarbonyl, dodecyloxycarbonyl, and benzyloxycarbonyl groups.

The aryloxycarbonyl group represented by $Q_2$ preferably has 7 to 50 carbon atoms and more preferably 7 to 40 carbon atoms. Examples thereof include phenoxycarbonyl, 4-octyloxyphenoxycarbonyl, 2-hydroxymethylphenoxycarbonyl, and 4-dodecyloxyphenoxycarbonyl groups. The sulfonyl group represented by $Q_2$ preferably has 1 to 50 carbon atoms and more preferably 6 to 40 carbon atoms. Examples thereof include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl groups.

The sulfamoyl group represented by $Q_2$ preferably has 0 to 50 carbon atoms and more preferably 6 to 40 carbon atoms. Examples thereof include unsubstituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl groups. The group represented by $Q_2$ may have, at a site or sites at which the group can be substituted, one or more of groups the same as those described as the examples of the substituent of the five- to seven-membered unsaturated ring represented by $Q_1$. When the group represented by $Q_2$ has two or more substituents, these may be the same as or different from each other.

In the following, typical examples of the compound represented by Formula (A-1) will be described. $Q_1$ is preferably a five-membered or six-membered unsaturated ring, and more preferably a benzene, pyrimidine, 1,2,3-triazole, 1,2,4-triazole, tetrazole, 1,3,4-thiadiazole, 1,2,4-thiadiazole, 1,3,4-oxadiazole, 1,2,4-oxadiazole, thiazole, oxazole, isothiazole, or isoxazole ring, or a fused ring in which at least one of these rings is fused with a benzene or unsaturated heterocyclic ring. $Q_2$ is preferably a carbamoyl group, in particular, a carbamoyl group having a hydrogen atom on the nitrogen atom.

Formula (A-2)

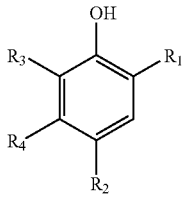

In Formula (A-2), $R_1$ represents an alkyl, acyl, acylamino, sulfonamide, alkoxycarbonyl, or carbamoyl group. $R_2$ represents a hydrogen or halogen atom, or an alkyl, alkoxy, aryloxy, aklylthio, arylthio, acyloxy, or carbonic acid ester group. $R_3$ and $R_4$ each represent a group that may bond to a benzene ring and examples thereof include those described as the examples of the substituent in the compound of Formula (A-1). $R_3$ and $R_4$ may bind to each other to form a fused ring.

$R_1$ is preferably an alkyl group having 1 to 20 carbon atoms (e.g., a methyl, ethyl, isopropyl, butyl, tert-octyl, or cyclohexyl group), an acylamino group (e.g., an acetylamino, benzoylamino, methylureido, or 4-cyanophenylureido group), or a carbamoyl group (e.g., a n-butylcarbamoyl, N,N-diethylcarbamoyl, phenylcarbamoyl, 2-chlorophenylcarbamoyl, or 2,4-dichlorophenylcarbamoyl group); or an acylamino group (including ureido and urethane groups). $R_2$ is preferably a halogen atom (more preferably, a chlorine or bromine atom), an alkoxy group (e.g., a methoxy, butoxy, n-hexyloxy, n-decyloxy, cyclohexyloxy, or benzyloxy group), or an aryloxy group (e.g., a phenoxy or naphthoxy group).

$R_3$ is preferably a hydrogen atom or a halogen atom, or an alkyl group having 1 to 20 carbon atoms, and more preferably a halogen atom. $R_4$ is preferably a hydrogen atom, an alkyl group, or an acylamino group, and more preferably an alkyl or acylamino group. Typical examples of these substituents are the same as in the explanations of $R_1$. When $R_4$ is an acylamino group, it is preferable that $R_4$ binds to $R_3$ to form a carbostyryl ring.

When $R_3$ and $R_4$ in Formula (A-2) bind to each other to form a fused ring, the fused ring is preferably a naphthalene ring. The naphthalene ring may have one or more substituents identical with the substituents described in the explanations of Formula (A-1). When the compound represented by Formula (A-2) is a naphthol compound, $R_1$ is preferably a carbamoyl group. Among them, $R_1$ is more preferably a benzoyl group. $R_2$ is preferably an alkoxy or aryloxy group, and more preferably an alkoxy group.

Typical examples of the development accelerator in the invention are shown bellow, but the invention is not restricted by these examples.

A-1

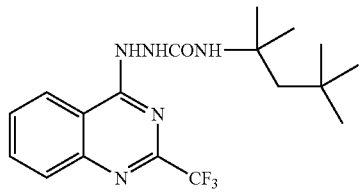

A-2

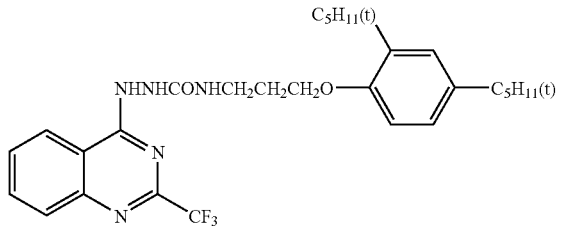

A-3

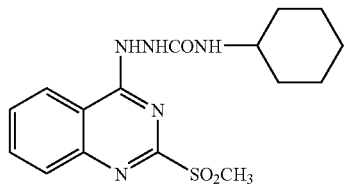

-continued

A-4

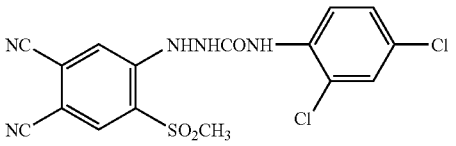

A-5

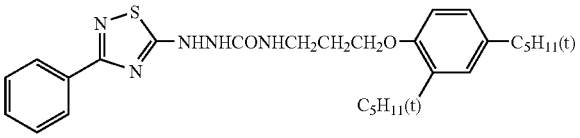

A-6

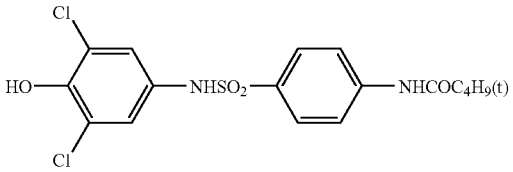

A-7

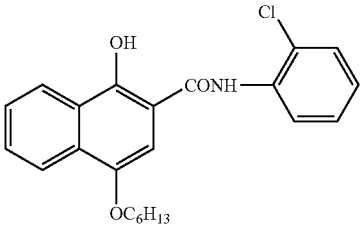

A-8

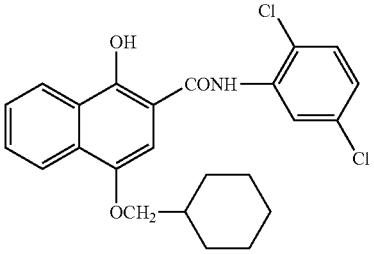

A-9

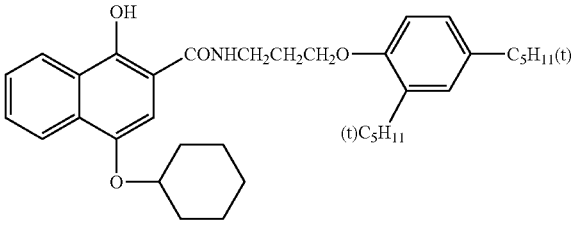

A-10

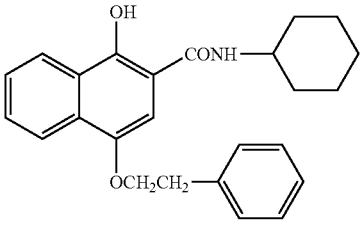

-continued

A-11

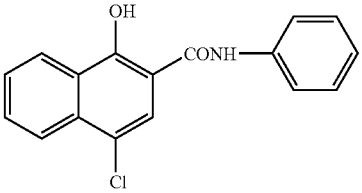

A-12

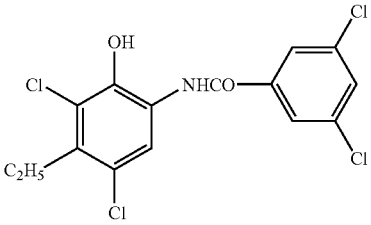

Hydrogen-bonding Compound

When the reducer in the invention has an aromatic hydroxyl group (—OH) or an amino group (—NHR group, wherein R is a hydrogen atom or an alkyl group), especially when it is one of the bisphenols described above, the photothermographic material of the invention preferably contains a non-reducing compound having a group that can form a hydrogen bond together with the aromatic hydroxyl group or the amino group.

Examples of the group that form a hydrogen bond together with the hydroxyl or amino group include phosphoryl, sulfoxide, sulfonyl, carbonyl, amido, ester, urethane, ureido group, tertiary amino, and nitrogen-containing aromatic groups. Among these, the group is preferably a phosphoryl group, a sulfoxide group, an amido group (not having an >N—H moiety but blocked in the form of >N—Ra wherein Ra represents a substituent other than H), a urethane group (not having an >N—H moiety but blocked in the form of >N—Ra wherein Ra represents a substituent other than H), or a ureido group (not having an >N—H moiety but blocked in the form of >N—Ra wherein Ra represents a substituent other than H).

The hydrogen-bonding compound in the invention is particularly preferably a compound represented by the following Formula (D).

Formula (D)

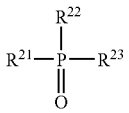

In Formula (D), $R^{21}$ to $R^{23}$ independently represent an alkyl, aryl, alkoxy, aryloxy, amino or heterocyclic group, and these groups may be unsubstituted or have one or more substituents.

When at least one of $R^{21}$ to $R^{23}$ is substituted, examples of the substituent include halogen atoms, and alkyl, aryl, alkoxy, amino, acyl, acylamino, alkylthio, arylthio, sulfonamido, acyloxy, oxycarbonyl, carbamoyl, sulfamoyl, sulfonyl, and phosphoryl groups. The substituent is preferably an alkyl or aryl group. Examples thereof include methyl, ethyl, isopropyl, t-butyl, t-octyl, phenyl, 4-alkoxyphenyl, and 4-acyloxyphenyl groups.

Specific examples of the alkyl groups represented by $R^{21}$ to $R^{23}$ include methyl, ethyl, butyl, octyl, dodecyl, isopropyl, t-butyl, t-amyl, t-octyl, cyclohexyl, 1-methylcyclohexyl, benzyl, phenethyl, and 2-phenoxypropyl groups.

Examples of the aryl groups represented by $R^{21}$ to $R^{23}$ include phenyl, cresyl, xylyl, naphthyl, 4-t-butylphenyl, 4-t-octylphenyl, 4-anisidyl, and 3,5-dichlorophenyl groups.

Examples of the alkoxy groups represented by $R^{21}$ to $R^{23}$ include methoxy, ethoxy, butoxy, octyloxy, 2-ethylhexyloxy, 3,5,5-trimethylhexyloxy, dodecyloxy, cyclohexyloxy, 4-methylcyclohexyloxy, and benzyloxy groups.

Examples of the aryloxy groups represented by $R^{21}$ to $R^{23}$ include phenoxy, cresyloxy, isopropylphenoxy, 4-t-butylphenoxy, naphthoxy, and biphenyloxy groups.

Examples of the amino groups represented by $R^{21}$ to $R^{23}$ include dimethylamino, diethylamino, dibutylamino, dioctylamino, N-methyl-N-hexylamino, dicyclohexylamino, diphenylamino, and N-methyl-N-phenylamino groups.

Each of $R^{21}$ to $R^{23}$ is preferably an alkyl, aryl, alkoxy, or aryloxy group. From the viewpoint of the effects of the invention, at least one of $R^{21}$ to $R^{23}$ is preferably an alkyl or aryl group. More preferably, two or more of them each are an alkyl or aryl group. From the viewpoint of inexpensive availability, $R^{21}$ to $R^{23}$ are preferably the same group.

Specific examples of the hydrogen-bonding compound in the invention, including that represented by Formula (D), are shown below, but the invention is not limited by these examples.

D-1

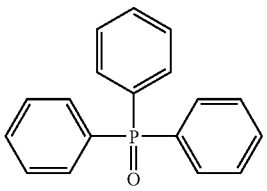

D-2

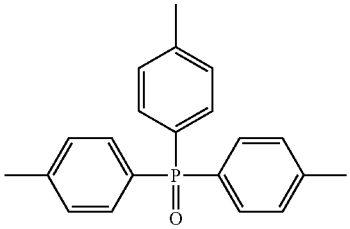

D-3

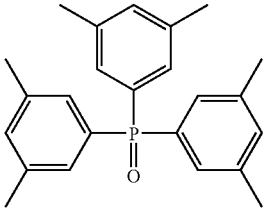

-continued

D-4

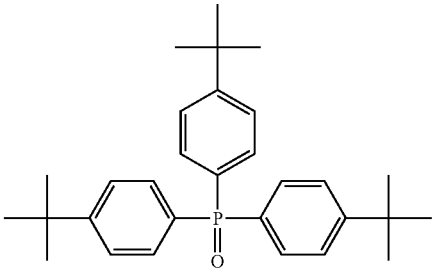

D-5

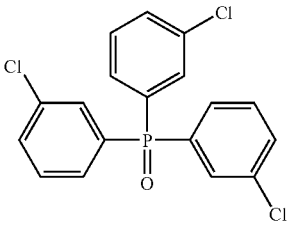

D-6

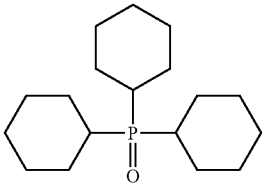

D-7

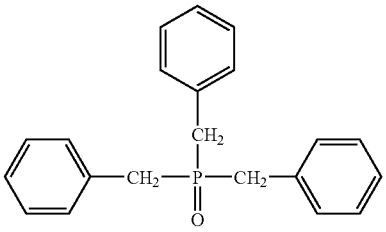

D-8

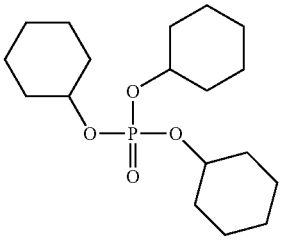

D-9

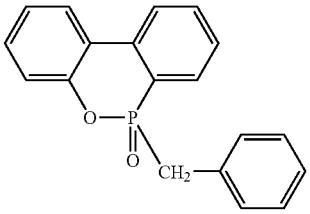

D-10

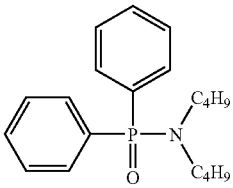

-continued

D-11

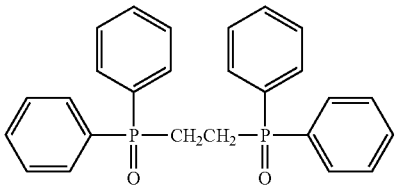

D-12

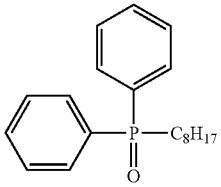

D-13

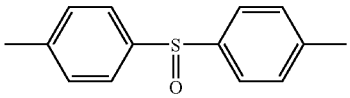

D-14

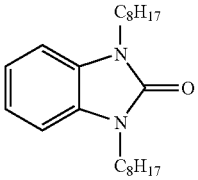

D-15

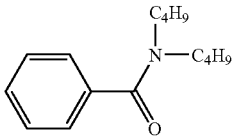

Specific examples of the hydrogen-bonding compounds other than those exemplified above include those described in EP No. 1096310 and in JP-A Nos. 2002-156727 and 2002-318431.

As in the reducer, the compound represented by Formula (D) used in the invention can be added to a coating liquid in the form of a solution, an emulsified dispersion, or a solid fine particle dispersion in incorporating it into the photothermographic material. However, the compound is preferably added in the form of a solid dispersion. In the solution, the compound represented by Formula (D) and the compound having a phenolic hydroxyl group or an amino group form a hydrogen-bonding complex. The compound of Formula (D) can be isolated as the crystal of the complex depending on the combination of the reducer and the compound of Formula (D).

It is particularly preferred to use the crystal powder thus isolated in the form of a solid fine particle dispersion, because it provides stable performance. Further, it is also preferable that powder of the reducer and that of the compound represented by Formula (D) are mixed with each other and that the resultant mixture, together with an appropriate dispersant, is stirred with, for example, a sand grinder mill to form a complex during dispersion.

The amount of the compound of Formula (D) is preferably 1 mol % to 200 mol %, more preferably 10 mol % to 150 mol %, and still more preferably 20 mol % to 100 mol % with respect to the reducer.

Anti-foggant

1) Organic Polyhalogen Compound

Hereinafter, an organic polyhalogen compound preferably used in the invention will be described in detail. The polyhalogen compound in the invention is preferably a compound represented by the following Formula (H).

$$Q—(Y)n—C(Z_1)(Z_2)X \qquad \text{Formula (H)}$$

In Formula (H), Q represents an alkyl, aryl or heterocyclic group; Y represents a bivalent connecting group; n denotes 0 to 1; $Z_1$ and $Z_2$ each represent a halogen atom; and X represents a hydrogen atom or an electron-attractive group.

In Formula (H), Q is preferably an alkyl group having 1 to 6 carbon atoms, an aryl group having 6 to 12 carbon atoms, or a heterocyclic group containing at least one nitrogen atom (e.g., a pyridine, or quinoline group).

In Formula (H), when Q is an aryl group, Q is preferably a phenyl group substituted with an electron-attractive group having a positive Hammett substituent constant σp. The Hammett substituent constant is described in, for example, Journal of Medicinal Chemistry, 1973, Vol. 16, No. 11, 1207–1216. Examples of such an electron-attractive group include halogen atoms, alkyl groups substituted with an electron-attractive group, aryl groups substituted with an electron-attractive group, heterocyclic groups, alkyl-or arylsulfonyl groups, acyl groups, alkoxycarbonyl groups, carbamoyl groups, and sulfamoyl groups. The electron-attractive group is preferably a halogen atom, a carbamoyl group, or an arylsulfonyl group, and more preferably a carbamoyl group.

X is preferably an electron-attractive group. Typical examples of the electron-attractive group include halogen atoms, aliphatic, aryl or heterocyclic sulfonyl groups, aliphatic, aryl or heterocyclic acyl groups, aliphatic, aryl or heterocyclic oxycarbonyl groups, carbamoyl groups, and sulfamoyl groups. The electron-attractive group is preferably a halogen atom or a carbamoyl group, and more preferably a bromine atom.

Each of $Z_1$ and $Z_2$ is preferably a bromine or iodine atom, and more preferably a bromine atom.

Y is preferably —C(═O)—, —SO—, —$SO_2$—, —C(═O)N(R)—, or —$SO_2$N(R)—, more preferably —C(═O)—, —$SO_2$—, or —C(═O)N(R)—, and still more preferably —$SO_2$—, or —C(═O)N(R)—. R represents a hydrogen atom, or an aryl or alkyl group, and is preferably a hydrogen atom or an alkyl group, and more preferably a hydrogen atom.

n denotes 0 or 1, and is preferably 1.

In Formula (H), when Q is an alkyl group, Y is preferably —C(═O)N(R)—. When Q is an aryl group or heterocyclic group, Y is preferably —$SO_2$—.

Also, the organic polyhalogen compound is preferably a compound in which at least two residues each obtained by removing a hydrogen atom from the compound represented by Formula (H) bind to each other (generally called a bis-, tris-, or tetrakis-compound).

The compound of Formula (H) preferably has, as a substituent, a dissociative group (e.g., a COOH group or a salt thereof, an $SO_3H$ group or a salt thereof, or a $PO_3H$ group or a salt thereof), a quaternary ammonium-containing group (e.g., an ammonium group, or a pyridinium group), a polyethyleneoxy group, or a hydroxyl group.

Specific examples of the compound of Formula (H) are shown below.
H-1
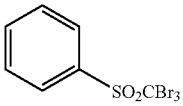
H-2
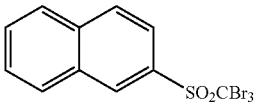
H-3
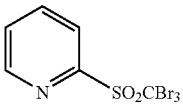
H-4
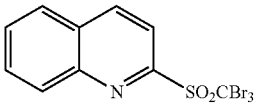
H-5
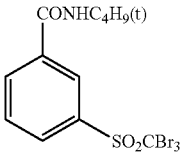
H-6
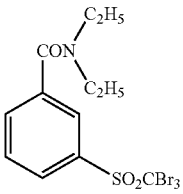
H-7
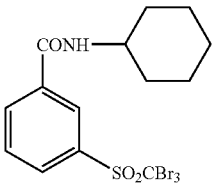
H-8
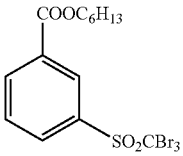
H-9
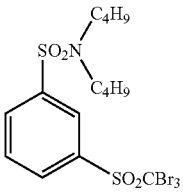
-continued
H-10
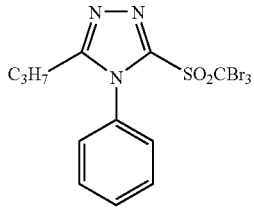
H-11
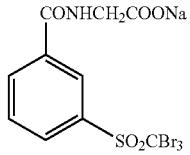
H-12
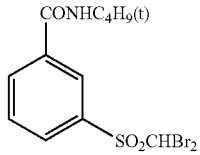
H-13
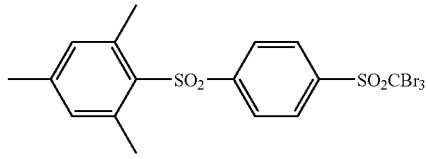
H-14
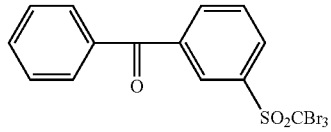
H-15
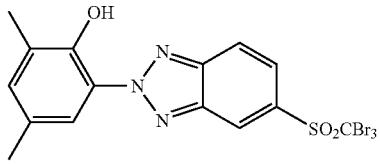
H-16
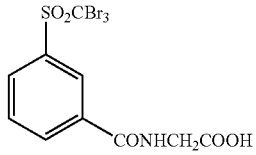
H-17
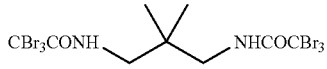
H-18
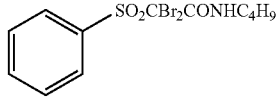
H-19
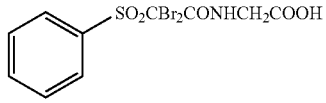

Other than those described above, the organic polyhalogen compound in the invention is preferably at least one of compounds disclosed in U.S. Pat. Nos. 3,874,946, 4,756,999, 5,340,712, 5,369,000, 5,464,737, and 6,506,548, JP-A Nos. 50-137126, 50-89020, 50-119624, 59-57234, 7-2781, 7-5621, 9-160164, 9-244177, 9-244178, 9-160167, 9-319022, 9-258367, 9-265150, 9-319022, 10-197988, 10-197989, 11-242304, 2000-2963, 2000-112070, 2000-284410, 2000-284412, 2001-33911, 2001-31644, 2001-312027, and 2003-50441. Among these, the organic polyhalogen compound is more preferably at least one of compounds disclosed in JP-A Nos. 7-2781, 2001-33911 and 20001-312027.

The amount of the compound represented by Formula (H) in the invention is preferably $10^{-4}$ to 1 mole, more preferably $10^{-3}$ to 0.5 mole, and still more preferably $10^{-2}$ to 0.2 mole with respect to 1 mole of the non-photosensitive silver salt in the image-forming layer.

In the invention, the anti-foggant may be incorporated into the photosensitive material in the same manner as the reducer, and the organic polyhalogen compound is preferably added to a coating liquid as a solid fine particle dispersion.

2) Other Anti-foggants

Other examples of the anti-foggant include mercury (II) salts described in JP-A No. 11-65021, paragraph No. 0113, benzoic acids described in JP-A No. 11-65021, paragraph 0114, salicylic acid derivatives described in JP-A No. 2000-206642, a formalin scavenger compound represented by Formula (S) in JP-A No. 2000-221634, a triazine compound described in claim 9 of JP-A No. 11-352624, a compound represented by Formula (III) in JP-A No. 6-11791, and 4-hydroxy-6-methyl-1,3,3a,7-tetrazaindene.

The photothermographic material of the invention may contain an azolium salt to prevent fogging. Examples of the azolium salt include a compound represented by Formula (XI) described in JP-A No. 59-193447; compounds described in Japanese Patent Application Publication (JP-B) No. 55-12581; and a compound represented by Formula (II) described in JP-A No. 60-153039. The azolium salt may be contained in any of the layer(s) of the photosensitive material, but is preferably contained in at least one of a layer or layers disposed on the surface of a support on which surface the image-forming layer is provided, and more preferably in the organic silver salt-containing layer. The azolium salt may be added to a coating liquid any time during preparation of the coating liquid. When incorporated into the organic silver salt-containing layer, the azolium salt can be added to a coating liquid any time during the process of preparing the organic silver salt and that of preparing the coating liquid, and is preferably added during a period starting after the end of the preparation of the organic silver salt and ending immediately before coating. The azolium salt may be added in any form of powder, a solution, or a fine particle dispersion.

The azolium salt may be added in the form of a solution that contains any other additive such as a sensitizing dye, a reducer, or a color tone adjusting agent, as well as the azolium salt. In the invention, the amount of the azolium salt added is not particularly limited, but is preferably $1\times10^{-6}$ to 2 mole, and more preferably $1\times10^{-3}$ to 0.5 mole per mole of silver.

1) Mercapto, Disulfide and Thion

In order to suppress or accelerate development, improve spectral sensitization efficiency, and improve storability before and after the development, the photothermographic material of the invention may include a mercapto compound, a disulfide compound and/or a thion compound such as those described in JP-A No. 10-62899, paragraph Nos. 0067–0069, that represented by Formula (I) and specific examples described in paragraph Nos. 0033–0052 of JP-A No. 10-186572, and those described in EP-A No. 0803764A1, page 20, lines 36–56. Among these, the photothermographic material preferably contains at least one of mercapto-substituted heteroaromatic compounds described in, for example, JP-A Nos. 9-297367, 9-304875, 2001-100358, 2002-303954 and 2002-303951.

2) Color Tone Adjusting Agent

The photothermographic material of the invention preferably contains a color tone adjusting agent, and typical examples thereof include those described in JP-A No. 10-62899, paragraph Nos. 0054 and 0055, EP No. 0803764A1, page 21, lines 23 to 48, and JP-A Nos. 2000-356317 and 2000-187298. The color tone adjusting agent is preferably at least one of phthalazinones (i.e., phthalazinone, phthalazinone derivatives and metal salts thereof such as 4-(1-naphthyl)phthalazinone, 6-chlorophthalazinone, 5,7-dimethoxyphthalazinone and 2,3-dihydro-1,4-phthalazinedione), combinations of phthalazinones and phthalic acids (e.g., phthalic acid, 4-methylphthalic acid, 4-nitrophthalic acid, diammonium phthalate, sodium phthalate, potassium phthalate and tetrachlorophthalic anhydride), phthalazines (i.e., phthalazine, phthalazine derivatives and metal salts thereof such as 4-(1-naphthyl)phthalazine, 6-isopropylphthalazine, 6-t-butylphtahlazine, 6-chlorophthalazine, 5,7-dimethoxyphthalazine and 2,3-dihydrophthalazine), and combinations of phthalazines and phthalic acids. The color tone adjusting agent is preferably a combination of at least one of phthalazines and at least one of phthalic acids. Among these, the color tone adjusting agent is more preferably a combination of 6-isopropylphthalazine and phthalic acid or 4-methylphthalic acid.

3) Plasticizer, and Lubricant

In the invention, the image-forming layer may contain a plasticizer, and/or a lubricant. The plasticizer and lubricant are described in JP-A No. 11-65021, paragraph No. 0117. The lubricant is also described in JP-A No. 11-84573, paragraph Nos. 0061–0064, and Japanese Patent Application No. 11-106881, paragraph Nos. 0049–0062.

4) Dye and Pigment

The image-forming layer in the invention may contain any dye or pigment from the viewpoints of improvement in color tone, prevention of interference fringe during laser exposure and prevention of inadequate irradiation. The dye and pigment are described in detail in WO98/36322, and JP-A Nos. 10-268465 and 11-338098. Among these, pigments and emulsified and dispersed dyes formed into fine particles may cause deterioration in image quality such as increase in haze, and thus use of a water-soluble dye is preferable.

The water-soluble dye is preferably a phthalocyanine dye from the viewpoints of light fastness and stability. Examples of the water-soluble phthalocyanine dye include a compound represented by Formula (PC-X) described in JP-A No. 2003-295388, and a compound represented by Formula (PC-1) described in Japanese Patent Application No. 2004-855655. The water-soluble phthalocyanine dye is preferably a compound represented by Formula (PC-1) described in Japanese Patent Application No. 2004-855655.

5) Nucleating Agent

The photothermographic material of the invention preferably contains a nucleating agent in the image-forming layer. Details on the nucleating agent, an addition method and the addition amount thereof can be found in JP-A No. 11-65021, paragraph No. 0118, JP-A No. 11-223898, paragraph Nos. 0136 to 0193, JP-A No. 2000-284399 (compounds represented by Formulae (H), (1) to (3), (A), and (B)), and Japanese Patent Application No. 11-91652 (compounds represented by Formulae (III) to (V), and specific compounds described in Formulae 21 to 24). A nucleation accelerator is described in JP-A No. 11-65021, paragraph No. 0102 and JP-A No. 11-223898, paragraph Nos. 0194 and 0195.

When formic acid or formate serving as a strong fogging agent is contained in the photothermographic material, it is preferably incorporated into any of a layer or layers disposed on the surface of a support on which surface the image-forming layer containing a photosensitive silver halide is formed in an amount of 5 mmol or less, and more preferably 1 mmol or less per mol of silver.

When the photothermographic material of the invention contains the nucleating agent, it is preferable that the material further contains an acid resulting from hydration of diphosphorus pentaoxide, or a salt thereof. Examples of such acid and salt thereof include metaphosphoric acid and salts thereof, pyrophosphoric acid and salts thereof, orthophosphoric acid and salts thereof, triphosphoric acid and salts thereof, tetraphosphoric acid and salts thereof, and hexametaphosphoric acid and salts thereof. The acid or salt is preferably orthophosphoric acid or a salt thereof, or hexametaphosphoric acid or a salt thereof. Specifically, the salt can be sodium orthophosphate, sodium dihydrogen orthophosphate, sodium hexametaphosphate, and/or ammonium hexametaphosphate.

The addition amount of the acid obtained by hydration of diphoshorus pentaoxide or the salt thereof (i.e., the coating amount thereof per $m^2$ of the photothermographic material) depends on properties such as sensitivity and fogging level, but is preferably 0.1 $mg/m^2$ to 500 $mg/m^2$, and more preferably 0.5 $mg/m^2$ to 100 $mg/m^2$.

Preparation of Coating Liquid and Coating

The temperature at which a coating liquid for image-forming layer in the invention is prepared is preferably from 30° C. to 65° C., more preferably not less than 35° C. and less than 60° C., and still more preferably from 35° C. to 55° C. Furthermore, the coating liquid for image-forming layer immediately after addition of a polymer latex is preferably maintained at a temperature in the range of from 30° C. to 65° C.

Layer Structure and Components

The photothermographic material of the invention may have at least one non-photosensitive layer in addition to the image-forming layer. Non-photosensitive layers are classified, according to its location, into (a) a surface protective layer formed on an image-forming layer (layer is farther from a support than the image-forming layer), (b) an intermediate layer formed between multiple image-forming layers or between an image-forming layer and a protective layer, (c) an undercoat layer formed between an image-forming layer and a support, and (d) a back layer formed on the surface of a support which surface is opposite to that on which an image-forming layer is provided.

In addition, the photothermographic material may have a layer functioning as an optical filter, and the layer is formed as layer (a) or (b). Furthermore, the photothermographic material may have an anti-halation layer and the anti-halation layer is formed as layer (c) or (d).

1) Surface Protective Layer

The photothermographic material of the invention may have a surface protective layer in order to, for example, prevent sticking of the image-forming layer. The surface protective layer may be formed by a single layer or by plural layers.

The surface protective layer is described in JP-A No. 11-65021, paragraph Nos. 0119 and 0120, and JP-A No. 2000-171936.

The binder of the surface protective layer in the invention is preferably gelatin, but is also preferably polyvinyl alcohol (PVA). The surface protective layer may contain both gelatin and polyvinyl alcohol. The gelatin can be inert gelatin (e.g., NITTA GELATIN 750), and/or phthalated gelatin (e.g., NITTA GELATIN 801). The PVA can be at least one of those described in JP-A No. 2000-171936, paragraph Nos. 0009 to 0020, and is preferably a completely saponified product PVA-105, a partially saponified product PVA-205 or PVA-335, or a modified polyvinyl alcohol MP-203, which is the trade name of a product available from Kuraray Ltd. The amount of coated polyvinyl alcohol (per $m^2$ of a support) in the surface protective layer (per one layer) is preferably in the range of from 0.3 g/m to 4.0 $g/m^2$, and more preferably from 0.3 $g/m^2$ to 2.0 $g/m^2$.

The coating amount of the binder(s), including water-soluble and latex polymers, in each surface protective layer, per $m^2$ of a support is preferably 0.3 to 5.0 $g/m^2$, and more preferably 0.3 to 2.0 $g/m^2$.

2) Anti-halation Layer

The photothermographic material of the invention may have an anti-halation layer on the side farther from a light source than the image-forming layer.

The anti-halation layer is described in JP-A No. 11-65021, paragraph Nos. 0123 and 0124, and JP-A Nos. 11-223898, 9-230531, 10-36695, 10-104779, 11-231457, 11-352625 and 11-352626.

The anti-halation layer contains an anti-halation dye that absorbs exposure light. When the wavelength of the exposure light is in the infrared region, the anti-halation dye is preferably an infrared absorbent. In such a case, it is preferable that the infrared absorbent does not absorb light having a wavelength in the visible region.

When a dye that absorbs light having a wavelength in the visible region is used to prevent halation, it is preferable to prevent the color of the dye from remaining after image formation. To attain this, it is preferable to use a means of decolorizing by the heat of thermal development. Such a means is preferable that a non-photosensitive layer containing thermally decolorizable dye and a base precursor functions as an anti-halation layer. The means is described in JP-A No. 11-231457.

The amount of the decolorizable dye added depends on the application of the dye. Generally, the amount is such that optical density (absorbance), measured at a desired wavelength, is more than 0.1. The optical density is preferably 0.15 to 2 and more preferably 0.2 to 1. In order to obtain an optical density in the above range, the amount of the dye used is generally, approximately 0.001 to approximately 1 $g/m^2$.

By removing the color of the dye in such a manner, it is possible to reduce the optical density after thermal development to 0.1 or less. The thermally decolorizable recording material or photothermographic material can contain two or more decolorizable dyes. Similarly, the material may also contain two or more base precursors.

When the photothermographic material is thermally decolorizable one containing a decolorizable dye and a base precursor, it is preferable that the material further contains a substance which, when mixed with the base precursor, can lower a melting point by 3° C. or more. This is because a good thermally decolorizing property can be obtained. The substance is described in, for example, JP-A No. 11-352626 and can be diphenylsulfon, 4-chlorophenyl(phenyl)sulfon, or 2-naphthylbenzoate.

3) Back Layer

A back layer that can be employed in the invention is described in JP-A No. 11-65021, paragraph Nos. 0128–0130.

The photothermographic material of the invention may contain a colorant having an absorption maximum in the wavelength range of 300 to 450 nm for improvement in silver tone and suppression of change of an image over time. The colorant is described in, for example, JP-A Nos. 62-210458, 63-104046, 63-103235, 63-208846, 63-306436, 63-314535, 01-61745, and 2001-100363.

The colorant is usually contained in an amount of 0.1 to 1 g/m$^2$, and is preferably contained in the back layer formed on the surface of a support which surface is opposite to that on which an image-forming layer is provided.

In addition, the photothermographic material preferably contains a dye having an absorption peak in the wavelength range of 580 to 680 nm for adjustment of base color tone. The dye is preferably a water-soluble phthalocyanine dye described in JP-A No. 2003-295388, or an oil-solubleazomethine dye described in JP-A Nos. 4-359967 and 4-359968, which has a small absorption intensity in the shorter wavelength range. The dye may be contained in any layer, but is preferably contained in a non-photosensitive layer disposed on the surface of a support on which surface the image-forming layer is provided or a layer on the other surface of the support (surface on which a back layer is provided).

The photothermographic material of the invention is preferably a so-called one-sided photosensitive material having at least one image-forming layer containing a silver halide emulsion on one surface of a support, and a back layer on the other surface of the support.

4) Matting Agent

The photothermographic material of the invention may contain a matting agent to improve transportability, and the matting agent is described in JP-A No. 11-65021, paragraph Nos. 0126 and 0127. The coating amount of the matting agent per m$^2$ of the photosensitive material is preferably 1 to 400 mg/m$^2$, and more preferably 5 to 300 mg/m$^2$.

In the invention, the matting agent particles may have a definite shape or an indefinite shape, and preferably have a definite shape, and more preferably have a spherical shape. The mean particle size of the matting agent particle is preferably in the range of from 0.5 μm to 10 μm, more preferably from 1.0 μm to 8.0 μm, and still more preferably from 2.0 μm to 6.0 μm. Furthermore, the variation coefficient of the size distribution is preferably 50% or lower, more preferably 40% or lower, and still more preferably 30% or lower. The variation coefficient is defined by (the standard deviation of the particle diameters)/(the mean value of the particle diameters)×100. Furthermore, it is preferred to use two types of matting agents having a low variation coefficient and the ratio of the mean particle size of one type of these to that of the other type of more than 3.

The degree of matting on the outer surface of layers provided on a surface of a support on which surface an image-forming layer is provided is set so that star-dust defects do not occur. However, the Beck's smoothness of the outer surface is preferably 30 seconds to 2000 seconds, and more preferably 40 seconds to 1500 seconds. The Beck's smoothness can be easily obtained by Japan Industrial Standard (JIS) P8119 "Method of measuring Beck's smoothness of paper and paperboard with Beck's tester", or TAPPI standard method T479.

The Beck's smoothness, which represents the degree of matting, of the outer surface of at least one layer provided on a surface of a support on which surface a back layer is provided is preferably 10 to 1200 seconds, more preferably 20 to 800 seconds, and still more preferably 40 to 500 seconds.

In the invention, the matting agent is preferably contained in the outermost layer of the photosensitive material, a layer functioning as an outermost layer, a layer close to the outer surface, or a layer functioning as a so-called protective layer.

5) Polymer Latex

A polymer latex is preferably contained in the surface protective layer or the back layer, especially when the photothermographic material of the invention is used for printing application demanding strict dimensional stability. Such a polymer latex is described in, for example, "Synthetic Resin Emulsions" (edited by Taira Okuda, and Hiroshi Inagaki, and published by Kobunshi Kankokai (1978)), "Applications of Synthetic Latexes" (edited by Takaaki Sugimura, Yasuo Kataoka, Soichi Suzuki, and Keiji Kasahara, and published by Kobunshi Kankokai (1993)), and "Chemistry of Synthetic Latexes" (written by Soichi Muroi, and published by Kobunshi Kankokai (1970)). Specific examples thereof include methyl methacrylate (33.5 mass %)/ethyl acrylate (50 mass %)/methacrylic acid (16.5 mass %) copolymer latex; methyl methacrylate (47.5 mass %)/butadiene (47.5 mass %)/itaconic acid (5 mass %) copolymer latex; ethyl acrylate/methacrylic acid copolymer latex; methyl methacrylate (58.9 mass %)/2-ethylhexyl acrylate (25.4 mass %)/styrene (8.6 mass %)/2-hydroxyethyl methacrylate (5.1 mass %)/acrylic acid (2.0 mass %) copolymer latex; and methyl methacrylate (64.0 mass %)/styrene (9.0 mass %)/butyl acrylate (20.0 mass %)/2-hydroxyethyl methacrylate (5.0 mass %)/acrylic acid (2.0 mass %) copolymer latex.

6) Film Surface pH

The photothermographic material of the invention preferably has a film surface pH of 7.0 or less before thermal development, and more preferably 6.6 or less. The lower limit of the film surface pH is not particularly restricted but is generally about 3. The pH is most preferably from 4 to 6.2. In order to adjust (lower) the film surface pH, it is preferable to use an organic acid such as a phthalic acid derivative, a non-volatile acid such as sulfuric acid, or a volatile base such as ammonia. In particular, to attain a low film surface pH, ammonia is preferable, since it can easily volatilize and can be removed from the photosensitive material during the coating step or before thermal development.

It is also preferable to use a non-volatile base such as sodium hydroxide, potassium hydroxide or lithium hydroxide in combination with ammonia. A method for measuring a film surface pH is described in JP-A No. 2000-284399, paragraph No. 0123.

7) Hardener

A hardener may be contained in the image-forming layer, the protective layer, or the back layer in the invention. Examples of the hardener are described in T. H. James, "The Theory of the Photographic Process Fourth Edition" (Macmillan Publishing Co. Inc., 1977) pages 77–87. The hardener is preferably chromium alum, sodium 2,4-dichloro-6-hydroxy-s-triazine, N,N-ethylenebis(vinylsulfonacetamide), N,N-propylenebis(vinylsulfonacetamide), a polyvalent metal ion described in page 78 of the aforementioned reference, polyisocyanate described in U.S. Pat. No. 4,281,060, or JP-A No. 6-208193, an epoxy compound described in U.S. Pat. No. 4,791,042, or a vinylsulfone compound described in JP-A No. 62-89048.

The hardener is added to a coating liquid for protective layer as a solution, and the addition is conducted within a period starting at 180 minutes before the coating operation and ending immediately before the coating operation, preferably within a period starting at 60 minutes before the coating operation and ending at 10 seconds before the coating operation. The mixing method and mixing conditions are selected such that the effects of the invention can be sufficiently exhibited. Specific examples of the mixing method include a method of mixing the hardener and the coating liquid in a tank so that the average residence time calculated from the flow rate of liquid added and the rate of liquid supplied to a coater is controlled to a desired value, and a method using a static mixer which is described in the eighth chapter of "Ekitai Kongo Gijutu" sritten by N. Hamby, M. F. Edwards and A. W. Nienow, translated by Koji Takahashi, and published by Nikkan Kogyo Shinbunsha in 1989.

8) Surfactant

A surfactant employable in the invention is described in JP-A No. 11-65021, paragraph No. 0132. Also, this reference describes a solvent in paragraph No. 0133, a support in paragraph No. 0134, an antistatic or electrically conductive layer in paragraph No. 0135, and a method for obtaining a color image in paragraph No. 0136. A lubricant is described in JP-A No. 11-84573, paragraph Nos. 0061–0064 and Japanese Patent Application No. 11-106881, paragraph Nos. 0049–0062.

The photothermographic material of the invention preferably contains a fluorinated surfactant. Specific examples of the fluorinated surfactant include those described in JP-A Nos. 10-197985, 2000-19680 and 2000-214554. Moreover, the fluorinated surfactant is preferably a fluorinated polymer surfactant described in JP-A No. 9-281636.

The photothermographic material more preferably contains a fluorinated surfactant described in JP-A Nos. 2002-82411, 2003-57780 and 2001-264110. In particular, the fluorinated surfactant described in JP-A Nos. 2003-57780 and 2001-264110 has a good charge regulating ability, good stability of a coated surface and a good lubricating ability when it is coated in the form of an aqueous coating liquid. The fluorinated surfactant described in JP-A No. 2001-264110 is the most preferable in that it has a high charge regulating ability and in that it can be effective even in a small amount.

In the invention, the fluorinated surfactant may be contained in a surface layer provided on one side of the photothermographic material on which one side an image-forming layer is provided and/or a surface layer provided on the other side of the material on which a back layer is provided, and is preferably contained the surface layer provided on the one side and that on the other side. In addition, it is particularly preferable to use it in combination with an electrically conductive layer containing the metal oxide described above. In such a case, even when the amount of the fluorinated surfactant contained in a surface layer provided on a side of the photothermographic material on which side the electrically conductive layer is provided is reduced or zero, the resultant photosensitive material can have satisfactory performance.

The amount of the fluorinated surfactant contained in each of a surface layer provided on one side of the photothermographic material on which one side an image-forming layer is provided and that provided on the other side of the material on which a back layer is provided is preferably in the range of 0.1 to 100 mg/m$^2$, more preferably 0.3 to 30 mg/m$^2$, and still more preferably 1 to 10 mg/m$^2$. The fluorinated surfactant described in JP-A No. 2001-264110 is particularly effective, and the amount thereof is preferably in the range of 0.01 to 10 mg/m$^2$ and more preferably 0.1 to 5 mg/m$^2$.

9) Antistatic Agent

The photosensitive material of the invention preferably has an electrically conductive layer containing a metal oxide or an electrically conductivity polymer. The antistatic layer may serve as an undercoat layer or a back layer surface protective layer. Alternatively, these layers can be provided separately. A metal oxide into which oxygen defects or a foreign metal atom is introduced to improve conductivity is preferably used as the conductivity material of the antistatic layer. The metal oxide is preferably ZnO, $TiO_2$, or $SnO_2$. Aluminum or indium is preferably added to ZnO. Antimony, Niobium or phosphorous or a halogen element is preferably added to $SnO_2$. Niobium or tantalum is preferably added to $TiO_2$. In particular, the metal oxide is more preferably $SnO_2$ to which antimony is added. The amount of the foreign atom added is preferably in the range of 0.01 to 30 mole % and more preferably 0.1 to 10 mole % with respect to the amount of the metal oxide. The shape of the metal oxide particles may be spherical, needle-like, or platy, but needle-like particles having a ratio of a major axis length/minor axis length of 2.0 or more, preferably 3.0 to 50, are preferable from the viewpoint of the effect of giving electrical conductivity. The amount of the metal oxide used is preferably in the range of 1 to 1,000 mg/m$^2$, more preferably 10 to 500 mg/m$^2$, and still more preferably 20 to 200 mg/m$^2$.

The antistatic layer can be provided on one side of the support on which one side an image-forming layer is provided and on the other side of the support on which a back layer is provided, but is preferably provided between the support and the back layer. Examples of the antistatic layer in the invention are described in JP-A No. 11-65021, paragraph No. 0135, JP-A Nos. 56-143430, 56-143431, 58-62646, and 56-120519, JP-A No. 11-84563, paragraph Nos. 0040 to 0051, U.S. Pat. No. 5,575,957, and JP-A No. 11-223898, paragraph Nos. 0078 to 0084.

10) Support

The photothermographic material of the invention preferably has a transparent support. The transparent support is preferably a polyester film, particularly a polyethylene terephthalate film, which has been subjected to heat treatment at a temperature in the range of 130° C. to 185° C. to relax internal stress accumulated during biaxial stretching and remaining in the film and to prevent thermal development from causing heat shrinkage deformation. If the photothermographic material is used for medical application, the transparent support may be colored with a blue dye (e.g., dye-1 described in Examples of JP-A No. 8-240877) or may be colorless. An undercoat layer made of, for example, a water-soluble polyester described in JP-A No. 11-84574, a styrene-butadiene copolymer described in JP-A No. 10-186565, a vinylidene chloride copolymer described in JP-A No. 2000-39684 or Japanese Patent Application No. 11-106881, paragraph Nos. 0063 to 0080 is preferably provided on the support. The moisture content of the support is preferably 0.5 wt % or less when an image-forming layer or a back layer is coated thereon.

11) Other Additives

The photothermographic material may contain an anti-oxidant, a stabilizer, a plasticizer, a UV absorbent, and/or a coating aid. Each of these additives is contained in either of the image-forming layer or the non-photosensitive layer. Reference can be made to WO No. 98/36322, EP-A No. 803764A1, JP-A Nos. 10-186567 and 10-18568.

12) Coating Method

The photothermographic material of the invention may be prepared by any coating method. Typical examples of the coating method include extrusion coating, slide coating, curtain coating, dip coating, knife coating, and flow coating methods, and an extrusion coating method using a hopper described in U.S. Pat. No. 2,681,294. Slide coating or extrusion coating described on pages 399 to 536 of "LIQUID FILM COATING", written by Stephen F. Kistler, and Petert M. Schweizer, and published by CHAPMAN & HALL in 1997 is preferably conducted, slide coating is more preferably conducted. Examples of the shape of the slide coater for use in slide coating are shown in FIG. 11b.1 on page 427 of the above book. In addition, two or more layers may be formed simultaneously, if desired, by a method described on pages 399 to 536 of the above book or a method described in U.S. Pat. No. 2,761,791 or British Patent No. 837,095. The coating method in the invention is still more preferably a method described in JP-A No. 2001-194748, 2002-153808, 2002-153803, or 2002-182333.

The coating liquid for organic silver salt-containing layer in the invention is preferably a so-called thixotropic fluid. This is described in JP-A No. 11-52509. The viscosity of the coating liquid for organic silver salt-containing layer in the invention is preferably 400 to 100,000 mPa·s, and more preferably 500 to 20,000 mPa·s at a shear rate of 0.1 $S^{-1}$. The viscosity is preferably 1 to 200 mPa·s and more preferably 5 to 80 mPa·s at a shear rate of 1000 $S^{-1}$.

If two liquids are mixed during preparation of a coating liquid used in the invention, a known in-line or in-plant mixer may be used in the mixing. In-line and in-plant mixers preferably used in the invention are described in JP-A Nos. 2002-85948 and 2002-90940, respectively.

The coating liquid used in the invention is preferably defoamed to form a coating having a good coated surface state. The defoaming method preferable in the invention is described in JP-A No. 2002-66431.

For prevention of deposition of dust and dirt due to electrification of the support, it is preferable to remove electricity of the support before coating of the coating liquid in the invention. The electricity-removing method in the invention is preferably one described in JP-A No. 2002-143747.

In the invention, it is important to strictly control drying air and drying temperature, since a non-setting coating liquid for image-forming layer is dried. The drying method preferably conducted in the invention is described in detail in JP-A Nos. 2001-194749 and 2002-139814.

The photothermographic material of the invention is preferably heated immediately after coating and drying, to improve a film-forming property. The heating temperature on the film surface is preferably in the range of 60° C. to 100° C., and the heating time is preferably in the range of 1 to 60 seconds. More preferably, the film temperature is in the range of 70° C. to 90° C. and the heating time is 2 to 10 seconds. The heating method preferable in the invention is described in JP-A No. 2002-107872.

A producing method described in JP-A No. 2002-156728 or 2002-182333 is preferably used in the invention to stably and continuously produce the photothermographic material of the invention.

13) Packaging Material

The photosensitive material of the invention is preferably packaged with a packaging material having a low oxygen permeability and/or a low water permeability for prevention of fluctuation of the photographic properties during raw stock storage, or curling thereof and winding deformation thereof. The oxygen permeability is preferably 50 ml/atm·$m^2$·day or less, more preferably 10 ml/atm·$m^2$·day or less, and still more preferably 1.0 ml/atm·$m^2$·day or less at 25° C. The water permeability is preferably 10 g/atm·$m^2$·day or less, more preferably 5 g/atm·$m^2$·day or less, and still more preferably 1 g/atm·$m^2$·day or less.

Typical examples of the packaging material having a low oxygen permeability and/or a low water permeability include those described in JP-A No. 8-254793 and 2000-206653.

14) Other Usable Techniques

Other techniques usable for the photothermographic material of the invention include those described in EP Nos. 803764A1 and 883022A1; WO No. 98/36322; and JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064, and 2000-171936.

Image-forming Method

1) Exposure

A light source in the invention can be a He—Ne laser emitting light having a wavelength in the range from the red region to the infrared region, a red light-emitting semiconductor laser, an $Ar^+$, He—Ne, or He—Cd laser emitting light having a wavelength in the range from the blue region to the green region, or a blue light-emitting semiconductor laser. The light source is preferably a semiconductor laser emitting light having a wavelength in the range from the red region to the infrared region, and the peak wavelength of the laser light is preferably in the range of 600 to 900 nm and more preferably 620 to 850 nm.

A module in which an SHG (Second Harmonic Generator) element and a semiconductor laser are integrated and a blue light-emitting semiconductor laser have been recently developed, and a laser output device emitting light in the shorter wavelength range has been spotlighted. The blue light-emitting semiconductor laser, which enables high-definition image recording and an increased recording density, and has a long life and provides stable output, is expected to be more demanded in the future. The peak wavelength of the light of the blue light-emitting laser is preferably 300 to 500 nm, and more preferably 400 to 500 nm.

Laser light oscillated in a longitudinal multi mode by, for example, a high frequency-superposing method can also be employed advantageously in the invention.

2) Thermal Development

The photothermographic material of the invention may be developed by any method, but is usually developed by heating the photothermographic material after imagewise exposure. The developing temperature is generally 80 to 250° C., preferably 100° C. to 140° C., and more preferably 110° C. to 130° C. The developing time is preferably 1 to 60 seconds, more preferably 3 to 30 seconds, still more preferably 5 to 25 second, and most preferably 7 to 15 seconds.

The thermal development may be performed by a drum heater or a plate heater, but is preferably performed by a plate heater. The thermal development using a plate heater is preferably performed by a method described in JP-A No. 11-133572, which discloses a thermal development device having, in a thermal development zone, a plate heater and press rollers disposed along one surface of the plate heater. In the device, a photothermographic material on which a latent image is formed is made to pass through a nip formed between the press rollers and the plate heater to bring the material into contact with the plate heater, forming a visible image. The plate heater is preferably divided into 2 to 6 zones, and the temperature of the top zone is preferably lowered than that of the other zones by approximately 1° C. to approximately 10° C. For example, a plate heater having four zones whose temperatures can be independently controlled is used, and the temperatures of the zones are controlled respectively to 112° C., 119° C., 121° C., and 120° C. Such a heating method is described in JP-A No. 54-30032, and allows removal of the water or organic solvent contained in the photothermographic material and ejection of the water or organic solvent from a system, and prevents deformation of the support of the photothermographic material caused by rapid heating.

More accurate heater control is preferable for miniaturization of the thermal development device and shortening of the heat developing time. When exposure of a sheet-type photosensitive material starts at the head portion of the material, it is preferable to start thermal development of the head portion before exposure of the foot portion of the material is finished. A high-speed imager preferably used in the invention is described in, for example, JP-A Nos. 2002-289804 and 2002-1287668. In such an imager, thermal development is conducted in 14 seconds on a plate heater having three zones respectively controlled at, for example, 107° C., 121° C., and 121° C., and the output period needed to process one sheet is shortened to about 60 seconds. For such a high-speed development, it is preferable to use photothermographic material-2 of the invention that is highly sensitive and is insensitive to environment temperature in combination with the above-described device.

3) System

Examples of a medical laser imager equipped with a light exposing zone and a thermal developing zone include FUJI MEDICAL DRY LASER IMAGER FM-DP L and DRYPIX 7000. FM-DP L is described in Fuji Medical Review No. 8, pages 39 to 55. These techniques may be applied to the laser imager for the photothermographic material of the invention. In addition, the photothermographic material of the invention can be used as a photothermographic material for the laser imager included in "AD network" which was proposed by Fuji Film Medical Co., Ltd. as a network system accommodated to DICOM standard.

APPLICATIONS OF THE INVENTION

The photothermographic material of the invention, which provides a monochromic image which is a silver image, may be used preferably as photothermographic materials for medical diagnosis, industrial photography, printing, and COM. In particular, it is suitable as a photothermographic material for medical diagnosis.

EXAMPLES

Hereinafter, the invention will be described in detail while referring Examples, however the invention is not restricted to these.

Example 1

Preparation of PET Support

1) Film Formation

PET was made by polymerizing terephthalic acid and ethylene glycol in an ordinary manner and had an intrinsic viscosity IV of 0.66 (measured in a mixture of phenol and tetrachloroethane at a mass ratio of 6/4 at 25° C.). This was pelletized, and the resultant was dried at 130° C. for 4 hours, and melted at 300° C. The melted PET was extruded out from a T-die, and rapidly cooled. Thus, a non-oriented film was prepared.

The film was longitudinally oriented by rolls rotating at different circumferential speeds at 110° C. so that the longitudinal length thereof after the orientation was 3.3 times as long as the original longitudinal length thereof. Next, the film was laterally oriented by a tenter at 130° C. so that the lateral length thereof after the orientation was 4.5 times as long as the original lateral length thereof. Next, the oriented film was thermally fixed at 240° C. for 20 seconds, and then laterally relaxed by 4% at the same temperature. Next, the portions of the film which portions were disposed at the chuck portions of the tenter were slit, and the both edges of the film were knurled, and the film was rolled up at 4 kg/cm$^2$. The rolled film having a thickness of 175 μm was obtained.

2) Corona Processing of Surface

Both surfaces of this support were processed at a rate of 20 m/minute at room temperature by using a solid state corona processing machine (6 KVA MODEL manufactured by Pillar Company). From current and voltage data read at this time, it was found that the support had been processed at 0.375 kV·A·min/m$^2$. At this time, the processing frequency was 9.6 kHz, and the gap clearance between an electrode and a dielectric roll was 1.6 mm.

3) Undercoating

<Preparation of Coating Liquids for Undercoat Layer>

Coating Liquid (1) (for Photosensitive Layer-side Undercoat Layer)

PES RESIN A-520 manufactured by Takamatsu Oil & Fat Co. (30 mass % solution) 59 g Polyethylene glycol monononylphenylether (average number of ethylene oxide: 8.5) (10 mass % solution) 5.4 g MP-1000 manufactured by Soken Chemical & Engineering Co., Ltd. (polymer fine particles having an average particle size of 0.4 μm) 0.91 g
Distilled water 935 ml Coating Liquid (2) (for First Back Surface Layer)
Styrene-butadiene copolymer latex 158 g (solid content of 40 mass %, and the mass ratio of styrene/butadiene of 68/32)
Sodium salt of 2,4-Dichloro-6-hydroxy-5-triazine (8 mass % aqueous solution) 20 g
1 Mass % aqueous solution of sodium laurylbenzylsulfonate 10 ml
Distilled water 854 ml Coating Liquid (3) (for Second Back Surface Layer)
$SnO_2$/SbO (mass ratio of 9/1, average particle size of 0.038 μm, 17 mass % dispersion) 84 g
Gelatin (aqueous 10 mass % solution) 89.2 g
METOLOSE TC-5 manufactured by Shin-Etsu Chemical Co., Ltd. (2 mass % aqueous solution) 8.6 g
MP-1000 manufactured by Soken Chemical & Engineering Co., Ltd. 0.01 g
1 Mass % aqueous solution of sodium dodecylbenzenesulfonate 10 ml
NaOH (1 mass %) 6 ml
PROXEL (manufactured by ICI) 1 ml
Distilled water 805 ml <Undercoating>

After both surfaces of the biaxially oriented polyethylene terephthalate support having a thickness of 175 μm were subjected to the corona discharge treatment respectively, the coating liquid (1) for undercoat layer was coated on one side (image-forming layer side) thereof with a wire bar so that the wet coating amount was 6.6 ml/m$^2$ (per one side). The coating was dried at 180° C. for 5 minutes. The coating liquid (2) for undercoat layer was coated on the rear side (back layer side) of the support with a wire bar so that the wet coating amount was 5.7 ml/m$^2$. The coating was dried at 180° C. for 5 minutes. The coating liquid (3) for undercoat layer was coated on the coating (on the back layer side) with a wire bar so that the wet coating amount was 7.7 ml/m$^2$. The coating was dried at 180° C. for 6 minutes. Thus, an undercoated support was prepared.

Back Layer

1) Preparation of Coating Liquid for Back Layer

<Preparation of Dispersion of Solid Fine Particles (a) of Base Precursor>

2.5 kg of base precursor compound 1, 300 g of a surfactant (DEMOL N™ manufactured by Kao Corporation), 800 g of diphenyl sulfone and 1.0 g of benzoisothiazolinone sodium salt were mixed with distilled water so that the total amount was 8.0 kg. The resultant liquid blend was stirred with a horizontal sand mill (UVM-2 manufactured by AIMEX Co., Ltd.) containing beads. In the stirring, the liquid blend was supplied to UVM-2 mill containing zirconia beads having a mean particle diameter of 0.5 mm with a diaphragm pump, and was stirred at an inner pressure of 50 hPa or higher until a desired mean particle diameter could be achieved.

In the stirring, the spectral absorption of the dispersion was measured. The stirring was continued until the ratio of the absorbance of the dispersion at 450 nm to that at 650 nm ($D_{450}/D_{650}$) became 3.0. The resulting dispersion was diluted with distilled water so that the concentration of the base precursor became 25% by mass. Thereafter, the dispersion was filtrated (with a polypropylene filter having a mean fine pore diameter of 3 μm) to eliminate dust and the resultant was put into practical use.

<Preparation of Dispersion of Solid Fine Particle of Dye>

6.0 kg of cyanine dye compound 1, and 3.0 kg of sodium p-dodecylbenzenesulfonate, 0.6 kg of DEMOL SNB (surfactant manufactured by Kao Corporation), and 0.15 kg of a defoaming agent (SURFYNOL 104E™ manufactured by Nissin Chemical Industry Co., Ltd.) were mixed with distilled water to give the total amount of 60 kg. The resultant mixture was stirred with a horizontal sand mill (UVM-2 manufactured by AIMEX Co., Ltd.) containing zirconia beads having a diameter of 0.5 mm.

In the stirring, the spectral absorption of the dispersion was measured. The stirring was continued until the ratio of the absorbance of the dispersion at 650 nm to that at 750 mm ($D_{650}/D_{750}$) became 5.0 or more. The resulting dispersion was diluted with distilled water so that the concentration of the cyanine dye compound 1 became 6% by mass. Thereafter, the dispersion was filtrated (with a filter having a mean fine pore diameter of 1 μm) to eliminate dust and the resultant was put into practical use.

<Preparation of Coating Liquid for Anti-halation Layer>

A vessel was kept at 40° C., and 40 g of gelatin, 20 g of monodispersed polymethyl methacrylate fine particles (mean particle size of 8 μm, and standard deviation of particle diameters of 0.4), 0.1 g of benzoisothiazolinone and 490 mL of water were put into the vessel to dissolve the gelatin. Additionally, 2.3 mL of a 1 mol/L aqueous sodium hydroxide solution, 40 g of the aforementioned dispersion of solid fine particles of dye, 90 g of the aforementioned dispersion of solid fine particles (a) of base precursor, 12 mL of a 3 mass % aqueous solution of sodium polystyrenesulfonate, and 180 g of a 10 mass % SBR latex were mixed with the resultant solution. Just prior to coating, 80 mL of a 4 mass % aqueous solution of N,N-ethylenebis(vinylsulfone acetamide) was mixed with the resulting blend to prepare a coating liquid for anti-halation layer.

<Preparation of Coating Liquid for Back Surface Protective Layer>

A vessel was kept at 40° C., and 40 g of gelatin, 35 mg of benzoisothiazolinone and 840 mL of water were put into the vessel to dissolve the gelatin. Additionally, 5.8 mL of a 1 mol/L aqueous sodium hydroxide solution, 5 g of a 10 mass % emulsion of liquid paraffin, 5 g of a 10 mass % emulsion of trimethylolpropane triisostearate, 10 mL of a 5 mass % aqueous solution of di(2-ethylhexyl) sodium sulfosuccinate, 20 mL of a 3 mass % aqueous solution of sodium polystyrenesulfonate, 2.4 mL of a 2 mass % solution of a fluorinated surfactant (F-1), 2.4 mL of a 2 mass % solution of another fluorinated surfactant (F-2), and 32 g of a 19 mass % solution of methyl methacrylate/styrene/butyl acrylate/hydroxyethyl methacrylate/acrylic acid copolymer (mass ratio of these monomers of 57/8/28/5/2) latex were mixed with the resultant solution. Just prior to coating, 25 mL of a 4 mass % aqueous solution of N,N-ethylenebis(vinylsulfone acetamide) was mixed with the resulting mixture to prepare a coating liquid for back surface protective layer.

4) Back Layer Coating

The coating liquid for anti-halation layer and that for back surface protective layer were simultaneously coated on the back surface of the undercoated support so that the coating amount of gelatin of the former coating liquid and that of the latter coating liquid became 0.52 g/m$^2$ and 1.7 g/m$^2$, respectively. The coatings were dried to form a back layer.

Image-forming Layer, Intermediate Layer and Surface Protective Layer

1. Preparation of Coating Materials

1) Silver Halide Emulsion

<<Preparation of Silver Halide Emulsion 1>>

3.1 mL of a 1 mass % potassium bromide solution, 3.5 mL of 0.5 mol/L sulfuric acid, 31.7 g of phthalated gelatin were added to 1421 mL of distilled water. The resulting mixture was kept at 30° C. in a stainless steel reaction pot while it was being stirred. Solution A was prepared by diluting 22.22 g of silver nitrate with distilled water such that the total volume of the resultant mixture was 95.4 mL. Soution B was prepared by diluting 15.3 g of potassium bromide and 0.8 g of potassium iodide with distilled water such that the total volume of the resultant mixture was 97.4 mL. These solutions A and B were added to the content in the reaction pot at constant flow rates over 45 seconds. Then, 10 mL of a 3.5 mass % aqueous solution of hydrogen peroxide, and 10.8 mL of a 10 mass % aqueous solution of benzimidazole were added to the system. Solution C was prepared by diluting 51.86 g of silver nitrate with distilled water such that the total volume of the resultant mixture was 317.5 mL. Moreover, Solution D was prepared by diluting 44.2 g of potassium bromide and 2.2 g of potassium iodide with distilled water such that the total volume of the resultant mixture was 400 mL. These solutions C and D were added to the system by a controlled double jet method. At this time, the whole of Solution C was added at a constant flow rate over 20 minutes. Moreover, Solution D was added while pAg was kept at 8.1. When ten minutes had lapsed since staring of addition of Solutions C and D, potassium hexachloroiridate (III) was added to the system in an amount of $1\times10^{-4}$ mol per mol of silver. Further, when five seconds had lapsed since completion of addition of Solution C, an aqueous solution of potassium hexacyanoiron (II) was added to the system in an amount of $3\times10^{-4}$ mol per mol of silver. 0.5 mol/L sulfuric acid was added to the system so as to adjust the pH of the system at 3.8. Then stirring was stopped, and precipitating, desalting and washing steps were carried out. One mol/L sodium hydroxide was added to the system so as to adjust the pH of the system at 5.9 and then a silver halide dispersion having pAg of 8.0 was prepared.

Five ml of a 0.34 mass % 1,2-benzisothiazolin-3-one methanol solution was added to the silver halide dispersion, which was kept at 38° C. and was being stirred. Forty minutes later, the resultant mixture was heated to 47° C. After heating for 20 minutes, a methanol solution of sodium benzenethiosufonate was added to the mixture (system) in an amount of $7.6\times10^{-5}$ mole per mole of silver. Five minutes later, a methanol solution of tellurium sensitizer C was added to the system in an amount of $2.9\times10^{-4}$ mole per mole of silver, and the resultant mixture was ripened for 91 minutes. Thereafter, a methanol solution of spectrally sensitizing dyes A and B at a molar ratio of 3:1 was added thereto. At this time, the total amount of the sensitizing dyes A and B was $1.2\times10^{-3}$ mole per mole of silver. One minute later, 1.3 ml of a 0.8 mass % N,N'-dihydroxy-N"-diethylmelamine methanol solution was added to the resultant blend. Four minutes later, a methanol solution of 5-methyl-2-mercapto benzimidazole in an amount of $4.8\times10^{-3}$ mole per mole of silver, a methanol solution of 1-phenyl-2-heptyl-5-mercapto-1,3,4-triazole in an amount of $5.4\times10^{-3}$ mole per mole of silver, and an aqueous solution of 1-(3-methylureidophenyl)-5-mercaptotetrazole in an amount of $8.5\times10^{-3}$ mole per mole of silver were added additionally to the resulting admixture. Thus, a silver halide emulsion 1 was prepared.

The silver halide emulsion thus obtained contained silver iodobromide particles having an average sphere-equivalent diameter of 0.042 μm and a variation coefficient of the sphere-equivalent diameters of 20% and uniformly containing iodine at 3.5 mole %. The particle size and the like were determined by measuring the diameters of 1,000 particles under an electron microscope. The {100} plane proportion of these particles was determined by Kubelka Munk method and was 80%.

<<Preparation of Silver Halide Emulsion 2>>

Silver halide emulsion 2 was prepared in the same manner as the silver halide emulsion 1, except that the liquid temperature during particle formation was changed from 30° C. to 47° C., except that the solution B was replaced with a solution obtained by diluting 15.9 g of potassium bromide with distilled water to give a total volume of 97.4 ml, except that the solution D was replaced with a solution obtained by diluting 45.8 g of potassium bromide with distilled water to give a total volume of 400 ml, except that the solution C was added over 30 minutes, except that potassium hexacyanoiron (II) was not added, except that the amount of the tellurium sensitizer added was change to $1.1\times10^{-4}$ mole per mole of silver, except that the total addition amount of the methanol solution containing the spectrally sensitizing dyes A and B at a molar ratio of 3:1 was change to $7.0\times10^{-4}$ mole per mole of silver, and except that the amounts of 1-phenyl-2-heptyl-5-mercapto-1,3,4-triazole and 1-(3-methylureidophenyl)-5-mercaptotetrazole were respectively changed to $3.3\times10^{-3}$ mole and $4.7\times10^{-3}$ mole per mole of silver. The emulsified particles in the silver halide emulsion 2 were pure silver bromide cubic particles having an average sphere-equivalent diameter of 0.080 μm and a variation coefficient of the sphere-equivalent diameters of 20%.

<<Preparation of Silver Halide Emulsion 3>>

Silver halide emulsion 3 was prepared in the same manner as the silver halide emulsion 1, except that the liquid temperature during particle formation was changed from 30° C. to 27° C., except that a solid dispersion (aqueous gelatin solution) containing the spectrally sensitizing dyes A and B at a molar ratio of 1:1 was added in a total amount of $6\times10^{-3}$ mole per mole of silver, and except that the amount of tellurium sensitizer C added was change to $5.2\times10^{-4}$ per mole of silver, except that bromoauric acid and potassium thiocyanate were added in respective amounts of $5\times10^{-4}$ mole and $2\times10^{-3}$ mole per mole of silver when three minutes had lapsed since addition of the tellurium sensitizer. The emulsified particles in the silver halide emulsion 3 were silver iodobromide particles uniformly containing iodine at 3.5 mole % and having an average sphere-equivalent diameter of 0.034 μm and a variation coefficient of the sphere-equivalent diameters of 20%.

<<Preparation of Mixed Emulsion a for Coating Liquid>>

Seventy mass % of the silver halide emulsion-1, 15 mass % of the silver halide emulsion-2, and 15 mass % of the silver halide emulsion-3 were melted. A 1 mass % aqueous solution of benzothiazolium iodide was added to the resultant mixture in an amount of $7\times10^{-3}$ mol per mole of silver. Further, water was added thereto so that the amount of silver of silver halide contained in 1 kg of the resultant mixed emulsion for coating liquid was 38.2 g. Thereafter, 1-(3-methylureidophenyl)-5-mercaptotetrazole was added to the mixed emulsion in an amount of 0.34 g per kg of the mixed emulsion for coating liquid.

Further, each of compounds 2, 20, and 26 was added as a "compound that can be one-electron-oxidized to provide a one-electron oxidant which releases one or more electrons" in an amount of $2\times10^{-3}$ mole per mole of silver of silver halide.

2) Preparation of Dispersion of Silver Salt of Fatty Acid

<Preparation of Recrystallized Behenic Acid>

Hundred kg of behenic acid (EDENOR C22-85R™ manufactured by Henkel) was mixed with 1,200 kg of isopropyl alcohol, and dissolved therein at 50° C., and the resultant solution was filtered through a filter having a pore size of 10 μm, and cooled down to 30° C., causing the behenic acid to recrystallize. The cooling speed during the recrystallization was controlled to 3° C./hour. The crystal obtained was centrifuged, washed with 100 kg of isopropyl alcohol, and dried. The crystal was esterified and the resultant was subjected to GC-FID measurement. The result revealed that it contained 96 mole % of behenic acid, 2 mole % of rignoceric acid, 2 mole % of arachidic acid, and 0.001 mole % of erucic acid.

<Preparation of Dispersion of Silver Salt of Fatty Acid>

Eighty-eight kg of recrystallized behenic acid, 422 L of distilled water, 49.2 L of a 5 mol/L aqueous NaOH solution and 120 L of t-butyl alcohol were mixed and reacted at 75° C. for one hour while the resultant system was being stirred. Thus, a sodium behenate solution B was obtained. Separately, 206.2 L of an aqueous solution (pH 4.0) containing 40.4 kg of silver nitrate was prepared and kept at 10° C. A reaction vessel containing 635 L of distilled water and 30 L of t-butyl alcohol was kept at 30° C. The entire amount of the sodium behenate solution and the entire amount of the aqueous solution of silver nitrate were added to the content of the vessel at constant flow rates over 93 minutes and 15 seconds and over 90 minutes, respectively, while the content in the vessel was being sufficiently stirred. At this time, only the aqueous solution of silver nitrate was added for 11 minutes after starting the addition of the aqueous solution of silver nitrate, addition of the sodium behenate solution B was started subsequently, and only the sodium behenate solution was added for 14 minutes and 15 seconds after completion of the addition of the aqueous solution of silver nitrate. At this time, the internal temperature of the reaction vessel was kept at 30° C. The external temperature was controlled such that the liquid temperature was constant. The pipe line for the sodium behenate solution was a double-walled pipe and thermally insulated by circulating hot water through the interspace of the double-walled pipe, and the temperature of the solution at the outlet of the nozzle tip was adjusted at 75° C.

The pipe line for the aqueous solution of silver nitrate was also a double-walled pipe and thermally insulated by circulating cold water through the interspace of the double-walled pipe. The position at which the sodium behenate solution was added to the reaction system and that at which the aqueous solution of silver nitrate was added thereto were disposed symmetrically relative to the shaft of the stirrer disposed in the reactor, and the nozzle tips of the pipes were spaced apart from the reaction solution level in the reactor.

After adding the sodium behenate solution B was finished, the reaction system was stirred for 20 minutes at that temperature, and then heated to 35° C. over 30 minutes. Thereafter, the system was ripened for 210 minutes. Immediately after completion of the ripening, the system was centrifugally filtered to collect a solid component, which was washed with water until the conductivity of the washing waste reached 30 μS/cm. The solid thus obtained was the silver salt of a fatty acid and was stored as a wet cake without drying it.

The shapes of the silver behenate particles were analyzed on the basis of their images taken through electronmicroscopic photography. The average values of a, b, and c were 0.21 μm, 0.4 μm and 0.4 μm, respectively (a, b and c are defined hereinabove). The average aspect ratio was 2.1. The variation coefficient of the sphere-equivalent diameters of the particles was 11%.

19.3 kg of polyvinyl alcohol (PVA-217 ™) and water were added to the wet cake whose amount corresponded to 260 kg of the dry weight thereof so that the total amount of the resultant became 1000 kg. The resultant was formed into slurry with a dissolver blade, and then pre-stirred with a pipe-line mixer (Model PM-10 available from Mizuho Industry Co.).

Next, the pre-stirred stock slurry was processed three times with a disperser (MICROFLUIDIZER M-610 obtained from Microfluidex International Corporation, and equipped with a Z-type interaction chamber) at a controlled pressure of 1150 kg/cm$^2$. A silver behenate dispersion was thus prepared. To cool it, corrugated tube-type heat exchangers were disposed before and behind the interaction chamber, respectively. The temperature of the coolant in these heat exchangers was so controlled that the system could be processed at a stirring temperature of 18° C.

3) Preparation of Reducer Dispersion

<<Preparation of Reducer-1 Dispersion>>

Ten kg of reducer-1 (2,2'-methylenebis-(4-ethyl-6-tert-butylphenol)), 16 kg of a 10 mass % aqueous solution of modified polyvinyl alcohol (POVAL MP203 available from Kuraray Co., Ltd.) and 10 kg of water were sufficiently mixed to form slurry. The slurry was fed by a diaphragm pump into a horizontal sand mill (UVM-2 available from Imex Corporation) including zirconia beads which had a mean diameter of 0.5 mm, and stirred therewith for 3 hours. Then, 0.2 g of sodium salt of benzoisothiazolinone and water were added thereto to adjust the reducer concentration of the resultant at 25% by mass. The resultant dispersion was heated at 60° C. for 5 hours. A reducer-1 dispersion was thus prepared. The reducer particles in the dispersion had a median diameter of 0.40 μm, and a maximum particles size of at most 1.4 μm. The reducer dispersion was filtered through a polypropylene filter having a pore size of 3.0 μm to remove foreign objects such as dirt from it, and then stored.

<<Preparation of Reducer-2 Dispersion>>

Ten kg of reducer-2 (6,6'-di-t-butyl-4,4'-dimethyl-2,2'-butylidenediphenol), 16 kg of a 10 mass % aqueous solution of modified polyvinyl alcohol (POVAL MP203 available from Kuraray Co., Ltd.) and 10 kg of water were sufficiently mixed to form slurry. The slurry was fed by a diaphragm pump into a horizontal sand mill (UVM-2 available from Imex Corporation) including zirconia beads which had a mean diameter of 0.5 mm, and stirred therewith for 3 hours and 30 minutes. Then, 0.2 g of sodium salt of benzoisothiazolinone and water were added thereto to adjust the reducer concentration of the resultant at 25% by mass. The resultant dispersion was then heated at 40° C. for 1 hour, and subsequently heated at 80° C. for 1 hour. A reducer-2 dispersion was thus prepared. The reducer particles in the dispersion had a median diameter of 0.50 μm, and a maximum particle size of at most 1.6 μm. The reducer dispersion was filtered through a polypropylene filter having a pore size of 3.0 μm to remove foreign objects such as dirt from it, and then stored.

4) Preparation of Hydrogen-bonding Compound-1 Dispersion

Ten kg of hydrogen-bonding compound-1 (tri(4-t-butylphenyl)phosphine oxide), 16 kg of a 10 mass % aqueous solution of modified polyvinyl alcohol (POVAL MP203 available from Kuraray Co., Ltd.) and 10 kg of water were sufficiently mixed to form slurry. The slurry was fed by a diaphragm pump into a horizontal sand mill (UVM-2 available from Imex Corporation) containing zirconia beads which had a mean diameter of 0.5 mm, and stirred therewith for 4 hours. Then, 0.2 g of sodium salt of benzoisothiazolinone and water were added thereto to adjust the hydrogen-bonding compound concentration of the resultant at 25% by mass. The resultant dispersion was heated at 40° C. for 1 hour and subsequently heated at 80° C. for 1 hour. A hydrogen-bonding compound-1 dispersion was thus prepared. The hydrogen-bonding compound particles in the dispersion had a median diameter of 0.45 μm, and a maximum particle size of at most 1.3 μm. The hydrogen-bonding compound dispersion was filtered through a polypropylene filter having a pore size of 3.0 μm to remove foreign objects such as dirt from it, and then stored.

5) Preparation of Development Accelerator-1 Dispersion

Ten kg of development accelerator-1, 20 kg of a 10 mass % aqueous solution of modified polyvinyl alcohol (POVAL MP203 available from Kuraray Co., Ltd.) and 10 kg of water were sufficiently mixed to form slurry. The slurry was fed by a diaphragm pump into a horizontal sand mill (UVM-2 available from Imex Corporation) containing zirconia beads which had a mean diameter of 0.5 mm, and stirred therewith for 3 hours and 30 minutes. Then, 0.2 g of sodium salt of benzoisothiazolinone and water were added thereto to prepare a development accelerator-1 dispersion having a development accelerator concentration of 20% by mass. The development accelerator particles in the dispersion had a median diameter of 0.48 μm, and a maximum particle size of at most 1.4 μm. The development accelerator dispersion was filtered through a polypropylene filter having a pore size of 3.0 μm to remove foreign objects such as dirt from it, and then stored.

6) Preparation of Development Accelerator-2 Dispersion and Color Tone Adjusting Agent Dispersion Development accelerator-2 and color tone adjusting agent-1 solid dispersions respectively having concentrations of 20 mass % and 15 mass % were prepared in the same manner as the development accelerator-1 dispersion. The structures of the development accelerator-2 and the color tone adjusting agent-1 are shown later.

7) Preparation of Polyhalogen Compound Dispersion

<<Preparation of Organic Polyhalogen Compound-1 Dispersion>>

Ten kg of organic polyhalogen compound-1 (tribromomethanesulfonylbenzene), 10 kg of a 20 mass % aqueous solution of modified polyvinyl alcohol (POVAL MP203 available from Kuraray Co., Ltd.), 0.4 kg of a 20 mass % aqueous solution of sodium triisopropylnaphthalenesulfonate, and 14 kg of water were sufficiently mixed to prepare slurry. The slurry was fed by a diaphragm pump into a horizontal sand mill (UVM-2 available from Imex Corporation) including zirconia beads which had a mean diameter of 0.5 mm, and stirred therewith for 5 hours. Then, 0.2 g of sodium salt of benzoisothiazolinone and water were added thereto to prepare an organic polyhalogen compound-1 dispersion having an organic polyhalogen compound concentration of 26 mass %. The organic polyhalogen compound particles in the dispersion had a median diameter of 0.41 μm, and a maximum particle size of at most 2.0 μm. The organic polyhalogen compound dispersion was filtered through a polypropylene filter having a pore size of 10.0 μm to remove foreign objects such as dirt from it, and then stored.

<<Preparation of Organic Polyhalogen Compound-2 Dispersion>>

Ten kg of organic polyhalogen compound-2 (N-butyl-3-tribromomethanesulfonylbenzamide), 20 kg of a 10 mass % aqueous solution of modified polyvinyl alcohol (POVAL MP203 available from Kuraray Co., Ltd.), and 0.4 kg of a 20 mass % aqueous solution of sodium triisopropylnaphthalenesulfonate were sufficiently mixed to prepare slurry. The slurry was fed by a diaphragm pump into a horizontal sand mill (UVM-2 available from Imex Corporation) including zirconia beads which had a mean diameter of 0.5 mm, and stirred therewith for 5 hours. Then, 0.2 g of sodium salt of benzoisothiazolinone and water were added thereto to adjust the organic polyhalogen compound concentration of the resultant at 30 mass %. The resultant dispersion was heated at 40° C. for 5 hours. An organic polyhalogen compound-2 dispersion was thus obtained. The organic polyhalogen compound particles in the dispersion had a median diameter of 0.40 μm, and a maximum particle size of at most 1.3 μm. The organic polyhalogen compound dispersion was filtered through a polypropylene filter having a pore size of 3.0 μm to remove foreign objects such as dirt from it, and then stored.

8) Preparation of Phthalazine Compound-1 Solution

Eight kg of modified polyvinyl alcohol (MP203 manufactured by Kuraray Co., Ltd.) was dissolved in 174.57 kg of water. Thereafter, 3.15 kg of a 20 mass % aqueous solution of sodium triisopropylnaphthalenesulfonate and 14.28 kg of a 70 mass % aqueous solution of phthalazine compound-1 (6-isopropylphthalazine) were added to the resultant solution to prepare a 5 mass % phthalazine compound-1 solution.

9) Preparation of Mercapto Compound

<<Preparation of Aqueous Solution of Mercapto Compound-1>>

Seven g of mercapto compound-1 (sodium salt of 1-(3-sulfophenyl)-5-mercaptotetrazole) was dissolved in 993 g of water to form a 0.7 mass % aqueous solution.

<<Preparation of Aqueous Solution of Mercapto Compound-2>>

Twenty g of mercapto compound-2 (1-(3-methylureidophenyl)-5-mercaptotetrazole) was dissolved in 980 g of water to form a 2.0 mass % aqueous solution.

10) Preparation of Pigment-1 Dispersion

Sixty-four g of C.I. Pigment Blue 60 and 6.4 g of DEMOL N manufactured by Kao Corp. were added to and well mixed with 250 g of water to prepare slurry. 800 g of zirconia beads having a mean diameter of 0.5 mm was placed in a vessel together with the slurry, and the mixture was stirred with a dispersing machine (1/4 G sand grinder mill manufactured by Imex Co.) for 25 hours. Water was added to the resultant dispersion to prepare a pigment-1 dispersion having a pigment concentration of 5 mass %. The pigment dispersion thus obtained contained pigment particles having a mean particle size of 0.21 μm.

11) Preparation of SBR Latex

An SBR latex was prepared as follows.

287 g of distilled water, 7.73 g of a surfactant (PIONIN A-43-S produced by Takemoto Yushi Corporation and having a solid content of 48.5 mass %), 14.06 ml of 1 mol/liter NaOH, 0.15 g of tetrasodium ethylenediaminetetraacetate, 255 g of styrene, 11.25 g of acrylic acid, and 3.0 g of tert-dodecylmercaptan were put into the polymerization reactor of a gas monomer reaction apparatus (TAS-2J Model available from Taiatsu Techno Corporation). The reactor was sealed off, and the content therein was stirred at 200 rpm. The internal air was exhausted via a vacuum pump, and replaced a few times repeatedly with nitrogen. Then, 108.75 g of 1,3-butadiene was introduced into the reactor under pressure, and the internal temperature of the reactor was raised to 60° C. A solution in which 1.875 g of ammonium persulfate was dissolved in 50 ml of water was added to the system, and the system was stirred for 5 hour. It was heated to 90° C. and stirred for 3 hours at that temperature. After the reaction was completed, the internal temperature was lowered to room temperature. Then, NaOH and $NH_4OH$ (both 1 mol/liter) were added to the system at a molar ratio of $Na^+$ to $NH_4^+$ of 1/5.3 so as to adjust the pH of the system at 8.4. Next, the system was filtered through a polypropylene filter having a pore size of 1.0 μm to remove foreign objects such as dirt from it, and then stored. 774.7 g of SBR latex was thus obtained. Its halide ion content was measured through ion chromatography, and the chloride ion concentration of the latex was 3 ppm. The chelating agent concentration thereof was measured through high-performance liquid chromatography, and was 145 ppm.

The mean particle size of the latex was 90 nm, Tg thereof was 17° C., the solid content thereof was 44% by mass, the equilibrium moisture content thereof at 25° C. and 60% RH was 0.6 mass %, and the ion conductivity thereof was 4.80 mS/cm. To measure the ion conductivity, a conductivity meter CM-30S manufactured by To a Denpa Kogyo K.K. was used. In the device, the 44 mass % latex was used at 25° C.

12) Preparation of Hydrophilic Polymer Solution

The solutions of hydrophilic polymers recited in the invention and those of hydrophilic polymers for comparison each having a concentration of 5 mass % were prepared.

The hydrophilic polymers recited in the invention are shown in Table 1.

Hydrophilic polymer A for comparison was gelatin (lime treated, inert gelatin).

Hydrophilic polymer B for comparison was polyvinyl alcohol (PVA-217 manufactured by Kuraray Co., Ltd.) (polymerization degree of 1,700, and saponification degree of 87 to 89%).

2. Preparation of Coating Liquid

1) Preparation of Image-forming Layer Coating Liquid 1,000 g of the dispersion of silver salt of fatty acid, 135 ml of water, 35 g of the pigment-1 dispersion, 19 g of the organic polyhalogen compound-1 dispersion, 58 g of the organic polyhalogen compound-2 dispersion, 162 g of the phthalazine compound-1 solution, 1,060 g of the SBR latex (Tg of 17° C.) solution, the hydrophilic polymer solution (the kind and addition amount thereof are shown in Table 1), 75 g of the reducer-1 dispersion, 75 g of the reducer-2 dispersion, 106 g of the hydrogen-bonding compound-1 dispersion, 4.8 g of the development accelerator-2 dispersion, 9 ml of the aqueous mercapto compound-1 solution, and 27 ml of the aqueous mercapto compound-2 solution were mixed one by one, and 118 g of the silver halide emulsion A was added to the resultant mixture immediately before coating, and the resulting image-forming layer coating liquid was stirred well and fed into a coating die as it was.

2) Preparation of Intermediate Layer-coating Liquid

Twenty-seven ml of a 5 mass % aqueous solution of AEROSOL OT (manufactured by American Cyanamide), and 135 ml of a 20 mass % aqueous diammonium phthalate solution were added to a mixture of 1,000 g of polyvinyl alcohol PVA-205 (manufactured by Kuraray Co., Ltd.), 163 g of the pigment-1 dispersion, 27 ml of a 5% aqueous di(2-ethylhexyl) sodium sulfoscuccinate solution, and 4200 ml of a 19 mass % latex of methyl methacrylate/styrene/butyl acrylate/hydroxyethyl methacrylate/acrylic acid copolymer (copolymerization mass ratio of these monomers of 57/8/28/5/2). Water was added to the resultant mixture so that the total amount of the resulting blend was 10,000 g. NaOH was added to the blend to adjust the pH of the blend at 7.5. An intermediate layer-coating liquid was thus prepared, and was then fed to a coating die at a rate equivalent to a coating amount of 8.9 ml/$m^2$.

The viscosity of the coating liquid was measured by a type-B viscometer at 40° C. (No. 1 rotor, 60 rpm), and was 58 mPa·s.

3) Preparation of First Surface Protective Layer-coating Liquid 100 g of inert gelatin and 10 mg of benzisothiazolinone were dissolved in 840 ml of water, and 180 g of a 19 mass % latex of methyl methacrylate/styrene/butyl acrylate/hydroxyethyl methacrylate/acrylic acid copolymer (copolymerization mass ratio of these monomers of 57/8/28/5/2), 46 ml of a 15 mass % phthalic acid methanol solution, and 5.4 ml of a 5 mass % aqueous solution of di(2-ethylhexyl) sodium sulfoscuccinate were added to the resultant solution. Forty ml of a 4 mass % chromium alum solution was added to the resulting blend immediately before coating, and the resulting mixture was fed to a coating die at a rate equivalent to a coating liquid amount of 26.1 ml/$m^3$.

The viscosity of the coating liquid was measured by a type-B viscometer at 40° C. (No. 1 rotor, 60 rpm), and was 20 mPa·s.

4) Preparation of Second Surface Protective Layer-coating Liquid 100 g of inert gelatin and 10 mg of benzisothiazolinone were dissolved in 800 ml of water, and 8.0 g of liquid paraffin emulsion serving as liquid paraffin, 180 g of a 19 mass % latex of methyl methacrylate/styrene/butyl acrylate/hydroxyethyl methacrylate/acrylic acid copolymer (copolymerization mass ratio of these monomers of 57/8/28/5/2), 40 ml of a 15 mass % phthalic acid methanol solution, 5.5 ml of a 1 mass % solution of fluorinated surfactant (F-1), 5.5 ml of a 1 mass % aqueous solution of fluorinated surfactant (F-2), 28 ml of a 5 mass % aqueous solution of di(2-ethylhexyl) sodium sulfoscuccinate, 4 g of polymethyl methacrylate fine particles (average particle size of 0.7 μm), and 21 g of polymethyl methacrylate fine particles (average particle size of 4.5 μm) were added to the resultant solution. A surface protective layer-coating liquid was thus obtained, and was then fed to a coating die at a rate equivalent to a coating amount of 8.3 ml/$m^2$.

The viscosity of the coating liquid was measured by a type-B viscometer at 40° C. (No. 1 rotor, 60 rpm), and was 19 mPa·s.

3. Preparation of Photothermographic Material

The image-forming layer-coating liquid, the intermediate layer-coating liquid, the first surface protective layer-coating liquid and the second surface protective layer coating liquid were simultaneously applied to the surface of the undercoated support which was opposite to the back layer side of the undercoated support in that order by a slide bead coating method to prepare a sample of a photothermographic material. At this time, the temperature of the image-forming layer-coating liquid and the intermediate layer-coating liquid was adjusted at 31° C., the temperature of the first surface protective layer-coating liquid was adjusted at 36° C., and the temperature of the second surface protective layer-coating liquid was adjusted at 37° C.

The amount (g/m$^2$) of each of the compounds of the image-forming layer is as follows.

| | |
|---|---|
| Fatty acid silver | 5.42 |
| Pigment (C.I. Pigment Blue 60) | 0.036 |
| Polyhalogen compound-1 | 0.12 |
| Polyhalogen compound-2 | 0.25 |
| Phthalazine compound-1 | 0.18 |
| SBR latex | 9.70 |
| Hydrophilic polymer (shown in Table 1) | |
| Reducer-1 | 0.40 |
| Reducer-2 | 0.40 |
| Hydrogen-bonding compound-1 | 0.58 |
| Development accelerator-1 | 0.019 |
| Development accelerator-2 | 0.016 |
| Mercapto compound-1 | 0.002 |
| Mercapto compound-2 | 0.012 |
| Silver of silver halide | 0.10 |

Coating and drying conditions are as follows.

Before coating, the electricity of the support was eliminated by blowing an ion blow to the support. The coating speed was 160 m/minute. The distance between the coating die tip and the support was within the range of 0.10–0.30 mm. The pressure in the decompression chamber was lower by 196 to 882 Pa than the atmospheric pressure. In the subsequent chilling zone, the coated support was chilled with an air blow (its dry-bulb temperature was 10 to 20° C.). The support was transported to the next zone, while kept not in contact with any member. In the next helix-type contactless drying zone, the support was dried with a dry air blow (its dry-bulb temperature was 23 to 45° C., and its wet-bulb temperature was 15 to 21° C.). After the drying, the support was conditioned at 25° C. at humidity in the range of 40 to 60% RH. Then, the support was heated so that the surface temperature was between 70 and 90° C. After the heating, the support was cooled down to reduce the surface temperature to 25° C.

The degree of matting, in terms of the Beck's smoothness, of the image-forming layer side of the thermographic material thus prepared was 550 seconds and that of the back layer side was 130 seconds. The pH of the image forming layer side was measured and was found to be 6.0.

TABLE 1

| Sample No. | Type of hydrophilic polymer | Addition amount (mass %) of hydrophilic polymer with respect to SBR | Fogging level | Sensitivity | Development irregularity | Image storability | Note |
|---|---|---|---|---|---|---|---|
| 1 | — | — | 0.07 | 100 | 1 | 2 | Comparative Example |
| 2 | Polymer A for comparison | 3 | 0.06 | 100 | 2 | 2 | Comparative Example |
| 3 | Polymer B for comparison | 3 | 0.06 | 101 | 2 | 2 | Comparative Example |
| 4 | NC-1 | 3 | 0.03 | 100 | 3 | 3 | Inventive Example |
| 5 | NC-2 | 3 | 0.03 | 102 | 3 | 3 | Inventive Example |
| 6 | N-1 | 3 | 0.03 | 101 | 4 | 4 | Inventive Example |
| 7 | N-1 | 1 | 0.04 | 102 | 3 | 4 | Inventive Example |
| 8 | N-1 | 10 | 0.02 | 102 | 4 | 4 | Inventive Example |
| 9 | NB-1 | 3 | 0.04 | 101 | 3 | 3 | Inventive Example |
| 10 | NB-2 | 3 | 0.04 | 100 | 3 | 3 | Inventive Example |

The chemical structures of the compounds used in Examples are shown below.

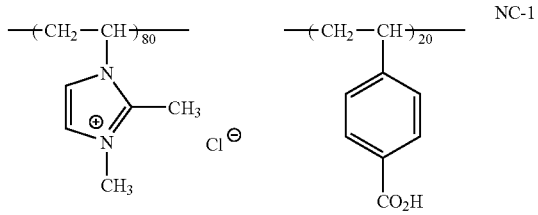

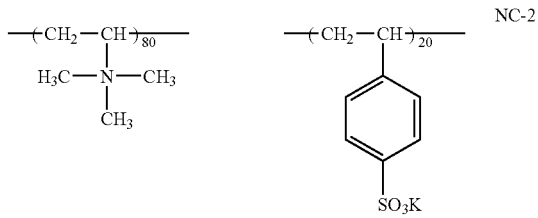

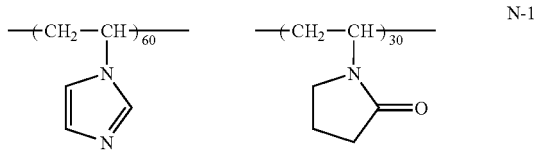

-continued

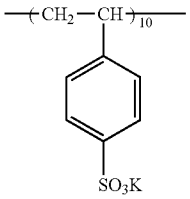

NB-1

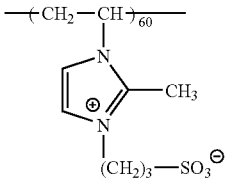

NB-2

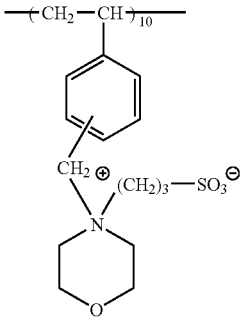

Spectrally sensitizing dye A

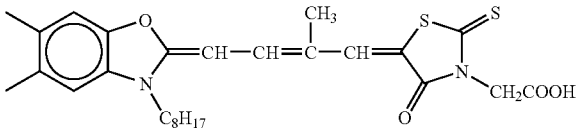

Spectrally sensitizing dye B

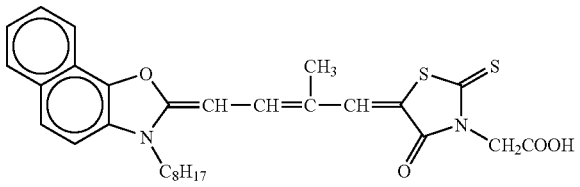

Tellurium sensitizer C

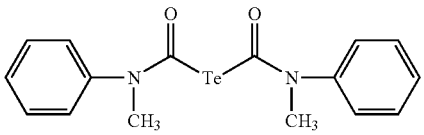

Compound 2 that can be One-electron-oxidized to Provide a One-electron Oxidant which Releases One or More Electrons

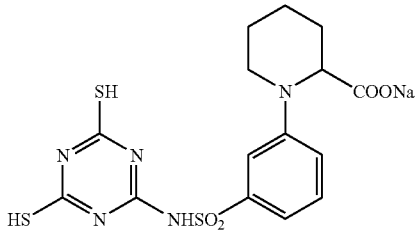

Compound 20 that can be One-electron-oxidized to Provide a One-electron Oxidant which Releases One or More Electrons

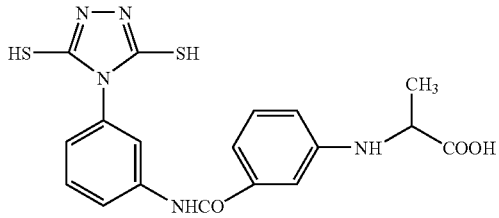

Compound 26 that can be One-electron-oxidized to Provide a One-electron Oxidant which Releases One or More Electrons

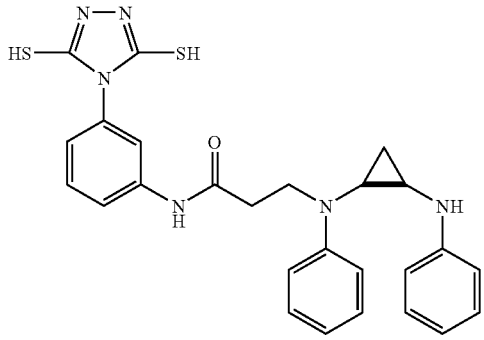

Reducer 1

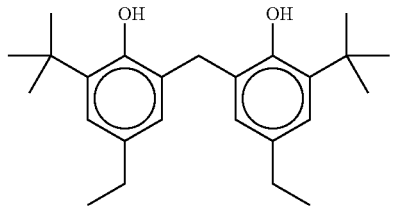

Reducer 2

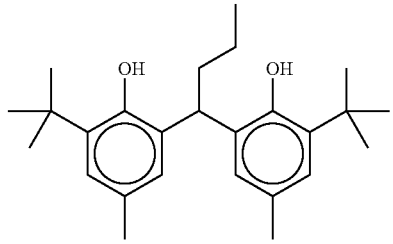

-continued
Hydrogen-bonding compound 1
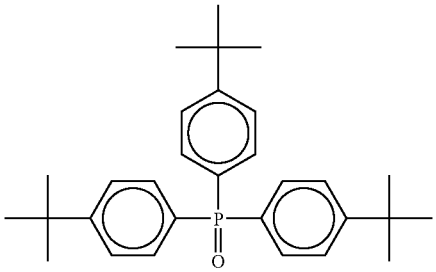
Polyhalogen compound 1
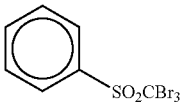
Polyhalogen compound 2
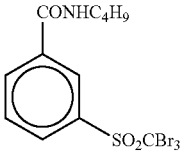
Mercapto compound 1
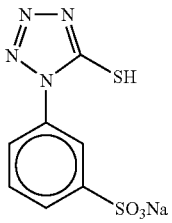
Mercapto compound 2
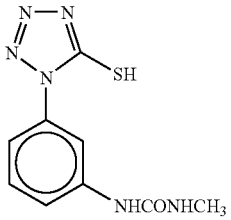
Phthalazine compound 1
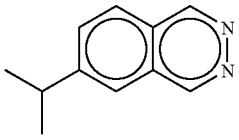
-continued
Development accelerator 1
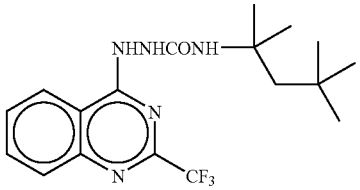
Development accelerator 2
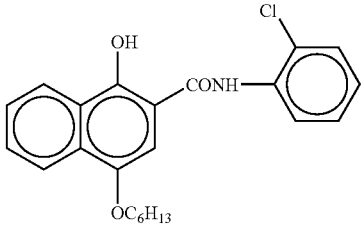
Color tone adjusting agent 1
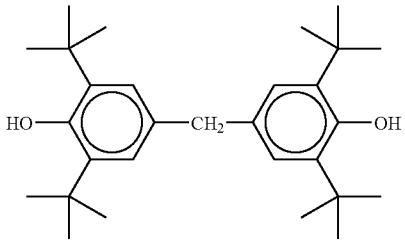
F-1
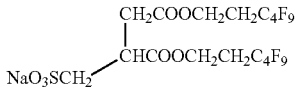
F-2
Mixture of the following compounds
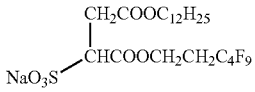
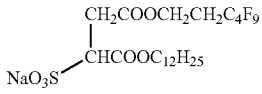

Evaluation of Photographic Performance

1) Preparation

Each sample thus prepared was cut into pieces of a half-size, and the pieces were packaged with a packaging material mentioned below at 25° C. and 50% RH, stored at ordinary temperature for two weeks, and tested according to test methods described later.

<Packaging Material>

The packaging material used herein was a laminated film including a PET film having a thickness of 10 μm, a PE film having a thickness of 12 μm, an aluminum foil having a thickness of 9 μm, a nylon film having a thickness of 15 μm, and a 2% carbon-containing polyethylene film having a thickness of 50 μm, and having an oxygen permeability of 0.02 ml/atm·$m^2$·25° C.·day and a moisture permeability of 0.10 g/atm·$m^2$·25° C.·day.

2) Exposure and Development of Photosensitive Material

Each sample was exposed to light with a dry laser imager DRYPIX 7000 manufactured by Fuji Film Medical Co., Ltd. (equipped with a semiconductor laser emitting light having a wavelength of 660 nm and having a maximum output of 50 mW (IIIB)), and thermally developed with three panel heaters respectively kept at 107° C., 121° C., and 121° C. to form an image. The total developing time was 14 seconds. The optical density of the image was measured with a densitometer.

3) Evaluation of Properties

Each photosensitive material was irradiated by the laser. In this exposure, the light exposures were changed stepwise. The material was then thermally developed to form an image. The optical density of each of the images was measured with a Macbeth densitometer. A characteristic curve showing a relationship between the image density and the light exposure was drawn.

<Fogging>

The density of the unirradiated area of each sample after development was designated as $D_{min}$.

<Sensitivity>

Sensitivity is defined as follows. The reciprocal of light exposure for each sample which light exposure was needed to obtain a density of ($D_{min}$+1.0) was obtained. The relative value of the reciprocal of each sample to that of a standard photosensitive material was designated as the sensitivity of the sample.

<Development Irregularity>

In the above exposure and thermal development, the entire surface of each sample was irradiated by the laser at a light exposure needed to obtain an image density of 1.2, and the sample was thermally developed by the panel heaters on which foreign materials were placed to make the thermal development partially insufficient. Irregularity in density of the thermally developed sample was evaluated on the basis of the following 5 criteria.

5: No irregularity.

4: Slight irregularity, which is practically no problem.

3: Some irregularity, which is at the lower limit of a practically allowable range.

2: Obvious irregularity, which is not practically acceptable.

1: Definite irregularity in which the difference in density between the deep and light areas is 0.1 or more.

<Image Storability>

Each sample after development was irradiated with schaukasten light at 3000 Lux for 3 days, and change in color tone in the non-image portion was evaluated on the basis of five grades. Grade "5" indicates the smallest change, while grade "1" indicates definite color change. Grade "3" indicates slight change, which is practically acceptable.

The results obtained are summarized in Table 1.

The samples of the invention had low Dmin, few irregularity in density and superior image storability.

Example 2

Samples No. 11 to 16 were prepared and evaluated in the same manner as samples No. 1, 3 to 6, and 9 of Example 1, except that the SBR latex for the image-forming layer was replaced with an alkali-treated inert gelatin in the same amount. The results are summarized in Table 2. The samples of the invention had low Dmin, few irregularity in density and superior image storability.

TABLE 2

| Sample No. | Type of hydrophilic polymer | Addition amount (mass %) of hydrophilic polymer with respect to SBR | Fogging level | Sensitivity | Development irregularity | Image storability | Note |
|---|---|---|---|---|---|---|---|
| 11 | — | — | 0.06 | 80 | 1 | 2 | Comparative Example |
| 12 | Polymer B for comparison | 3 | 0.05 | 82 | 1 | 2 | Comparative Example |
| 13 | NC-1 | 3 | 0.02 | 92 | 4 | 5 | Inventive Example |
| 14 | NC-2 | 3 | 0.02 | 91 | 4 | 4 | Inventive Example |
| 15 | N-1 | 3 | 0.02 | 96 | 5 | 5 | Inventive Example |
| 16 | NB-1 | 3 | 0.02 | 90 | 4 | 5 | Inventive Example |

Example 3

Samples No. 21 to 23 were prepared and evaluated in the same manner as sample No. 6 of Example 1, except that the pigment in the image-forming layer was respectively replaced with water-soluble dyes shown in Table 3. The results are summarized in Table 3. The samples of the invention sample had low $D_{min}$, few irregularity in density and superior image storability.

Dye-1
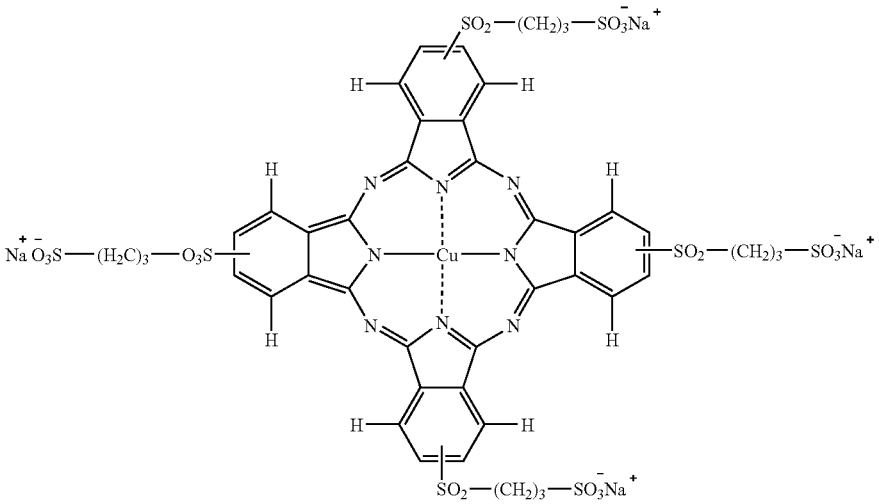
Dye-2
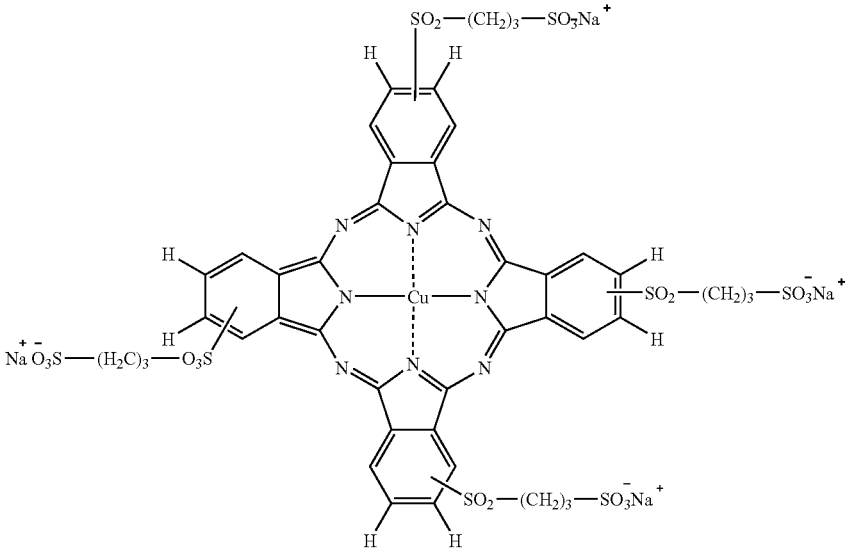
TABLE 3
| Sample No. | Type of pigment or dye | Fogging level | Sensitivity | Development irregularity | Image storability | Note |
|---|---|---|---|---|---|---|
| 21 | P.B.60 | 0.03 | 100 | 4 | 4 | Comparative Example |
| 22 | Dye 1 | 0.02 | 102 | 5 | 5 | Inventive Example |
| 23 | Dye 2 | 0.02 | 100 | 5 | 5 | Inventive Example |

What is claimed is:

1. A photothermographic material, comprising a support and an image-forming layer containing a binder, a photosensitive silver halide, a non-photosensitive organic silver salt, and a reducer for the organic silver salt on at least one surface of the support, wherein the image-forming layer contains in addition to the binder, a hydrophilic polymer which has a vinyl monomer unit containing a quaternary nitrogen atom-containing group or a nitrogen-containing heterocyclic group.

2. The photothermographic material according to claim 1, wherein the vinyl monomer unit containing a nitrogen-containing heterocyclic group comprises a repeating unit represented by Formula (N):

Formula (N)

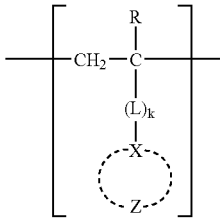

wherein: R represents a hydrogen atom or an alkyl group; L represents a bivalent connecting group or a simple bond; k denotes 0 or 1; X represents a nitrogen atom or a —CH— or —C═ group; Z represents a bivalent group containing a nitrogen or carbon atom; and at least one of X and Z contains a nitrogen atom.

3. The photothermographic material according to claim 1, wherein the vinyl monomer unit containing a quaternary nitrogen atom comprises a repeating unit represented by Formula (M):

Formula (M)

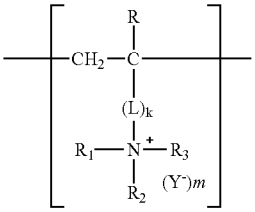

wherein: R represents a hydrogen atom or an alkyl group; L represents a bivalent connecting group or a simple bond; $R_1$, $R_2$, and $R_3$ each represent a substituted or unsubstituted alkyl group; $Y^-$ represents an anionic atom or group; k denotes 0 or 1; m is the number of $Y^-$ needed for neutralizing a cationic charge; if any one of $R_1$ to $R_3$ has an anionic charge neutralizing the cationic charge, m denotes 0; and $R_1$, $R_2$, and $R_3$ may bind to each other to form a ring.

4. The photothermographic material according to claim 3, wherein the repeating unit represented by Formula (M) contains a ring formed by binding at least two of $R_1$, $R_2$, and $R_3$.

5. The photothermographic material according to claim 3, wherein the repeating unit represented by Formula (M) contains a repeating unit represented by the following Formula (NB):

Formula (NB)

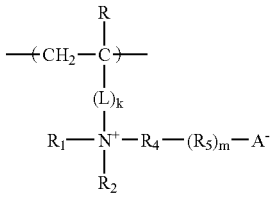

wherein: R, L, k, $R_1$, and $R_2$ are the same as in Formula (M); $R_4$ and $R_5$ each represent a bivalent connecting group; m denotes 0 or 1; and $A^-$ represents an anionic residue containing an anionic group selected from sulfonate, carboxylate, and phosphate groups.

6. The photothermographic material according to claim 4, wherein the repeating unit represented by Formula (M) contains a repeating unit represented by the following Formula (NB):

Formula (NB)

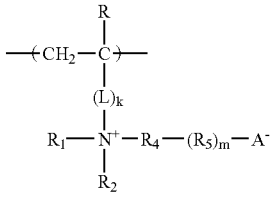

wherein: R, L, k, $R_1$ and $R_2$ are the same as in Formula (M); $R_4$ and $R_5$ each represent a bivalent connecting group; m denotes 0 or 1; and $A^-$ represents an anionic residue containing an anionic group selected from sulfonate, carboxylate, and phosphate groups.

7. The photothermographic material according to claim 2, wherein the vinyl monomer unit containing a nitrogen-containing heterocyclic group is one selected from the group consisting of vinylpyrrolidone, vinylimidazole, vinylpyridine, vinylpyrazine, vinylimidazoline, and vinylimidazolidine.

8. The photothermographic material according to claim 3, wherein the vinyl monomer unit containing a quaternary nitrogen atom is one selected from the group consisting of vinyl-N-substituted-quaternary ammonium, vinyl-N-substituted-imidazole, vinylpyridinium, vinyl-N-substituted-pyridine, vinyl-N-substituted-pyrazine, vinyl-N-substituted-imidazoline, and vinyl-N-substituted-imidazolidine.

9. The photothermographic material according to claim 4, wherein the vinyl monomer unit having a quaternary nitrogen atom is one selected from the group consisting of vinyl-N-substituted-quaternary ammonium, vinyl-N-substituted-imidazole, vinylpyridinium, vinyl-N-substituted-pyridine, vinyl-N-substituted-pyrazine, vinyl-N-substituted-imidazoline, and vinyl-N-substituted-imidazolidine.

10. The photothermographic material according to claim 5, wherein the vinyl monomer unit having a repeating unit represented by Formula (NB) is one selected from the group consisting of vinyl quaternary ammonium salt, vinyl-N-substituted-imidazole, vinyl-N-substituted-pyridine, vinyl-N-substituted-pyrazine, and vinyl-N-substituted-imidazoline, each having a sulfonate, carboxylate or phosphate group.

11. The photothermographic material according to claim 6, wherein the vinyl monomer unit having a repeating unit represented by Formula (NB) is one selected from the group consisting of vinyl quaternary ammonium salt, vinyl-N-substituted-imidazole, vinyl-N-substituted-pyridine, vinyl-N-substituted-pyrazine, and vinyl-N-substituted-imidazoline, each having a sulfonate, carboxylate or phosphate group.

12. The photothermographic material according to claim 1, wherein the hydrophilic polymer contains the vinyl monomer unit in an amount of 10 mole % to 80 mole %.

13. The photothermographic material according to claim 1, wherein the hydrophilic polymer is contained in an amount of 0.1 mass % to 30 mass % with respect to the binder in the image-forming layer.

14. The photothermographic material according to claim 1, wherein the binder in the image-forming layer is an aqueous latex.

15. The photothermographic material according to claim 1, wherein the binder in the image-forming layer is a hydrophilic, animal protein-derived polymer or polyvinyl alcohol.

16. The photothermographic material according to claim 15, wherein the hydrophilic animal protein-derived polymer is gelatin.

17. The photothermographic material according to claim 1, wherein the image-forming layer contains a water-soluble dye.

18. The photothermographic material according to claim 2, wherein the nitrogen atom contained in at least one of X and Z comprises a carbon-nitrogen double bond.

19. The photothermographic material according to claim 1, wherein the heterocyclic ring of the nitrogen-containing heterocyclic group is an imidazole, triazole, pyrazole, or pyrimidine ring.

* * * * *